US010525328B2

(12) United States Patent
Riordan et al.

(10) Patent No.: US 10,525,328 B2
(45) Date of Patent: Jan. 7, 2020

(54) AUTOMATIC CARD SHUFFLER AND MODIFIED PLAYING CARD SYSTEM CONFIGURED IN COMBINATION TO DETECT ADVANTAGE PLAYERS AND CHEATS

(71) Applicant: Shark Trap Gaming & Security Systems, LLC, Las Vegas, NV (US)

(72) Inventors: Michael Earnest Riordan, Las Vegas, NV (US); Louis Wilson DeGregorio, Las Vegas, NV (US); Steven Louis Forte, Las Vegas, NV (US)

( * ) Notice: Subject to any disclaimer, the term of this patent is extended or adjusted under 35 U.S.C. 154(b) by 0 days.

(21) Appl. No.: 15/686,051

(22) Filed: Aug. 24, 2017

(65) Prior Publication Data

US 2019/0060738 A1 Feb. 28, 2019

(51) Int. Cl.

| | |
|---|---|
| ***A63F 1/12*** | (2006.01) |
| *A63F 9/24* | (2006.01) |
| *A63F 1/14* | (2006.01) |

(52) U.S. Cl.

CPC ..... *A63F 1/12* (2013.01); *A63F 1/14* (2013.01); *A63F 2009/2425* (2013.01); *A63F 2009/2435* (2013.01); *A63F 2250/58* (2013.01)

(58) Field of Classification Search

CPC ..... A63F 1/12; A63F 2250/58; A63F 1/14; A63F 2009/2425

USPC ..... 273/149 R, 149 P

See application file for complete search history.

(56) References Cited

U.S. PATENT DOCUMENTS

| | | | | |
|---|---|---|---|---|
| 6,543,770 | B1 * | 4/2003 | Kaji | A63F 1/14 273/148 R |
| 8,920,229 | B1 * | 12/2014 | Chun | G07F 17/3293 273/149 P |
| 2003/0151194 | A1 * | 8/2003 | Hessing | A63F 1/12 273/149 R |
| 2014/0347471 | A1 * | 11/2014 | Blazevic | G01N 21/8806 348/128 |
| 2016/0166918 | A1 * | 6/2016 | Taft | A63F 1/12 273/149 R |

* cited by examiner

*Primary Examiner* — Benjamin Layno

(74) *Attorney, Agent, or Firm* — FisherBroyles, LLP; Rob L. Phillips

(57) ABSTRACT

An automatic playing card shuffler system including an automatic playing card shuffler and deck of modified playing cards. The modifications relate to asymmetrical information on each card face, back and/or side for identifying playing card orientation. The asymmetrical information is discernable by one or more image-capturing and/or sensors associated with the automatic playing card shuffler. Accordingly, the orientation of the playing cards may be monitored by the automatic playing card shuffler. The orientation data can be analyzed by a processor of the automatic playing card shuffler to determine unusual orientation patterns indicative of advantage play or cheats. Another version utilizes two distinct marks to identify important cards and less important cards.

22 Claims, 48 Drawing Sheets

AUTOMATIC CARD SHUFFLER AND MODIFIED PLAYING CARD SYSTEM CONFIGURED IN COMBINATION TO DETECT ADVANTAGE PLAYERS AND CHEATS

FIELD OF THE INVENTION

The embodiments of the present invention relate to an automatic card shuffler configured for use with modified playing cards to allow detection of advantage players and cheat.

BACKGROUND

Automatic card shufflers have been used by casinos since the 1980s and have helped revolutionize the gaming industry. Automatic card shufflers speed up play of casino games and may reduce cheating and advantage play. Automated shufflers may be configured to sit on a casino table or be incorporated therein.

The automatic shuffler industry is currently dominated by automatic shufflers which utilize rollers, elevators and bins to separate and randomly reorganize the cards. The shuffler described herein utilizes a method of separating a deck of cards into a lower portion and an upper portion at a pre-established deck position and grabbing and transporting the bottommost card from the upper portion into a post shuffle bin. This process occurs until all playing cards are randomly organized in the post shuffle bin.

The playing cards being randomly organized by the automatic shufflers have long been known to include asymmetrical rather than symmetrical backs as desired. That is, manufacturing tolerances during the printing, punching and cutting processes of 1/32" are considered acceptable. Unfortunately, skilled players and cheaters can discern such differences in symmetry and use it to take advantage of the casino. Attempts have been made by card manufacturers to improve the tolerances but have not been successful. Card manufacturers have also attempted to create card backs which conceal or otherwise obfuscate the asymmetries. Again, such efforts have been futile.

Edge sorting is a method of advantage play that uses natural irregularities in the cut on the backs of cards to be able to identify certain groups of cards. By being able to identify critical cards, advantage players can improve their betting and playing decisions. During play of a game, an advantage player (or team of advantage players) turns cards to be able to distinguish important cards from the other cards. For example, using a card with left/right diamond asymmetry, an advantage player may align the cards so that full diamonds along the left edge correspond to an important card, and half-diamonds on the left edge corresponds to the other cards. An advantage player attempts to turn most cards in the deck or shoe to identify its group. After the cards are sorted, an advantage player observes the appropriate edge during play of a hand. By knowing the card's group, an advantage player can make decisions shifting the edge in his or her favor. Cheaters can accomplish the same objective by colluding with a casino supervisor who turns the appropriate cards before the decks are brought to a live game, or by a dealer during a live game.

For example, in Baccarat the important cards are 6s, 7s, 8s and 9s. If an advantage player knows that the first card to be dealt is from this group, the advantage player bets on the player hand. If the first card is not in this group, the advantage player bets on the banker hand. Such a strategy can provide a significant player edge. The embodiments of the present invention solve edge sorting using the modified cards and automatic playing card shuffler configured to read the same and determine card and deck orientation.

It would be advantageous to develop an automatic shuffler and playing card system configured to identify advantage players and cheats. It would be further advantageous to render the system suitable for use with most automatic card shufflers including those disclosed herein.

SUMMARY

Identifying exploitable card back asymmetries can be difficult since the best advantage players and cheaters can discern manufacturing variances as small as $1/200^{th}$ of an inch. Increasing the challenge are the thousands of card back designs used in the casino market. Despite the discernable variances and countless card back designs, one constant remains—some cards must be turned or aligned relative to other cards to exploit the asymmetries (e.g., edge-sorting).

A first embodiment of the present invention relates to a deck of modified playing cards wherein said modification relates to an asymmetrical marking on each card face for identifying playing card orientation. The asymmetrical markings are discernable by a sensor or reader device associated with an automatic card shuffler. Accordingly, the orientation of the playing cards may be monitored by the automatic card shuffler. The orientation data can be analyzed by the automatic card shuffler to determine unusual patterns indicative of advantage play or cheats.

The analysis of the deck orientation involves identifying unusual situations indicative of advantage players and cheats. For edge-sorters surreptitiously turning cards in games wherein all players can touch cards, the turning process is accumulative and must be repeated until the deck's orientation is exploitable, after which the deck remains in an exploitable orientation as players continue to turn cards maintaining the orientation. In the context of the first time the deck or decks are shuffled, any exploitable deck orientation will be immediately and easily detected because some cards will not be in the new-deck orientation—an obvious indicator of foul play. Conversely, should the exploitable deck orientation be a random occurrence, it is unlikely to remain in that same orientation while exploitable orientations persist. Thus, should three consecutive shuffles result in the identification of exploitable deck orientations, edge sorters or cheaters are likely present in the game. In conclusion, manipulated orientations persist while random orientations come and go.

One suitable automatic card shuffler of the type suitable for embodiments of the present invention comprises broadly a pre-shuffle bin, card-selector assembly, drive wheel and post-shuffle bin. The pre-shuffle bin is configured to accept a single deck of cards (e.g., standard 52-card deck of playing cards). While in the pre-shuffle bin, a modest downward force may be applied to the single deck of cards. A weight, spring, roller or other physical article may be used to apply the modest downward force. Modest as used herein means a force that maintains the deck of cards substantially flat and square during the shuffling process. Any weight or other article in contact with the cards should have a soft padding between the weight or other article and the cards to prevent damage to the cards. A base or floor of the pre-shuffle bin is an independent member that may be selectively raised and lowered to position the deck of cards pursuant to a randomly-selected card number (e.g., 1-52). Two jokers may also be used such that a deck of playing cards includes 54 playing cards rather than 52. Once positioned correctly based on the randomly-selected card number, an upper body of the card-selector assembly moves a number of cards corresponding to the randomly-selected card number off the top of the deck thereby exposing a bottom card (i.e., the randomly-selected card) to a drive wheel. The drive wheel propels the bottom card from the pre-shuffle bin between offset lower and upper walls defining a passageway into the post-shuffle bin. The process is repeated 51 times until all cards in the deck in the pre-shuffle bin have been propelled into the post-shuffle bin In one embodiment, a photoelectric sensor integrated into the automatic card shuffler described above detects the asymmetrical markings based on an amount of reflected light. The photoelectric sensor may be positioned proximate to the post-shuffle bin such that the photoelectric sensor can analyze card faces as individual cards are propelled from the pre-shuffle bin to the post-shuffle bin. The collected data is then used to develop a model of the orientation of the shuffled cards. The models of deck orientations over consecutive shuffles may be used to uncover edge-sorters and cheaters.

Another embodiment of the present invention comprises an automatic card shuffler configured to shuffle eight decks of cards (or less) and deal a round of Baccarat. A round being a number of cards sufficient to deal a Baccarat hand in a traditional manner (i.e., one card at a time from left to right). In this embodiment, the automatic shuffler comprises two pre-shuffle bins, each configured to receive approximately four decks of cards wherein the pre-shuffle bins are adjacent to one another, each near a card slide leading to a card-receiving area. Cards are randomly selected from the cards in each of the pre-shuffle bins and propelled against a respective card slide directing the cards to the post-shuffle card-receiving area. Once a sufficient number of buffer cards (e.g., seven) have been deposited into the card-receiving area, a card flipper moves the seven cards against a face plate of an integral dealing shoe. A buffer-holder device maintains the buffer cards against the face plate for dealing as the card flipper returns to a home position to receive more shuffled cards. In this manner, while cards are being dealt in a round of Baccarat, new cards are being shuffled for the next round. Again, a photoelectric sensor proximate to the post-shuffle card-receiving area analyzes card faces as individual cards are propelled from the pre-shuffle bin to the post-shuffle card-receiving area.

Other variations, embodiments and features of the present invention will become evident from the following detailed description, drawings and claims.

DETAILED DESCRIPTION

Figure 1:
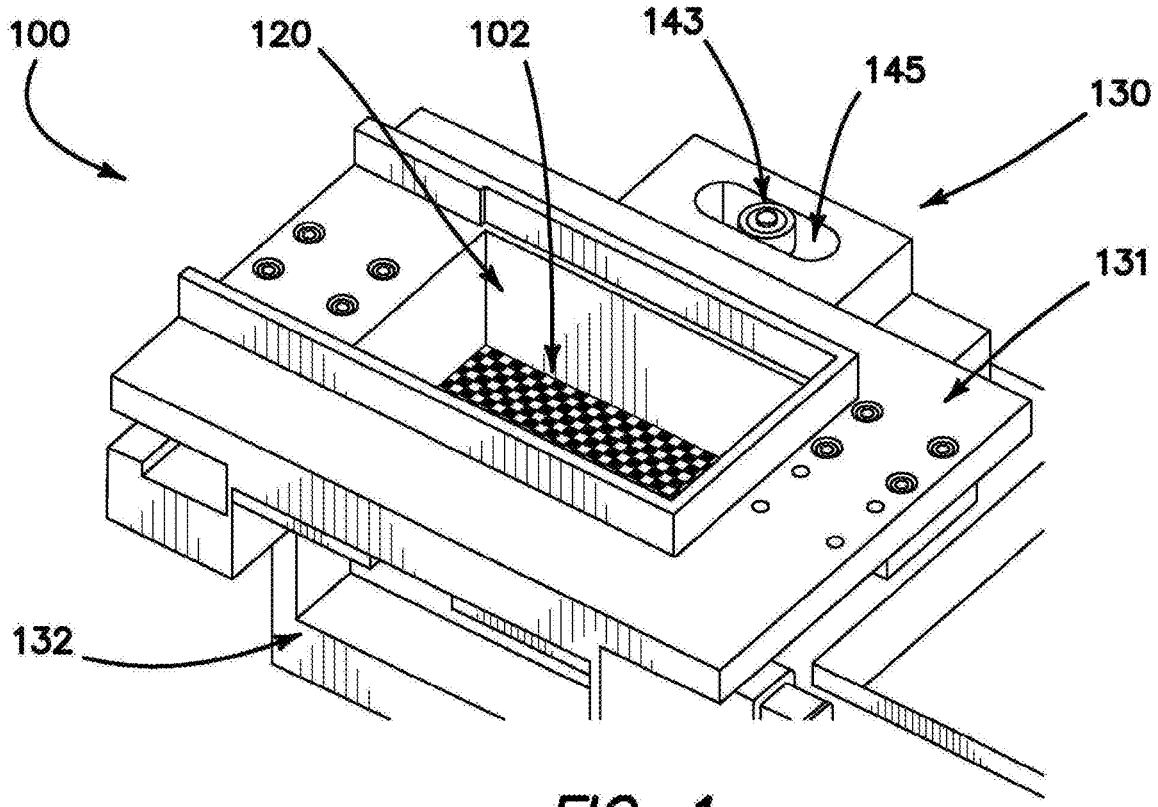
FIG. 1 illustrates a perspective upper view of an automatic card shuffler without a cover in place according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

As will be appreciated by one skilled in the art, the embodiments of the present invention combine software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

Computer program code for carrying out operations for embodiments of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof.

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The components of the embodiments of the present invention may be fabricated of any suitable materials, including, but not limited to, plastics, alloys, composites, resins and metals, and may be fabricated using suitable techniques, including, but not limited to, molding, casting, machining and rapid prototyping.

Detailed below is a single deck automatic card shuffler configured to insert into a poker table. In one embodiment, the single deck automatic card shuffler inserts into the chip tray cut-out in the poker table proximate to the poker game dealer. Those skilled in the art will recognize that the shuffler technology disclosed herein may be used with multi-deck shufflers which insert into a gaming table or secure to a gaming table top or bottom. The automatic card shuffler may be used to shuffle paper and plastic cards.

The single deck shuffler detailed herein comprises broadly a (i) pre-shuffle bin, (ii) card-selector assembly, (iii) drive wheel and (iv) post-shuffle bin. FIG. 1 illustrates a perspective upper view of the single deck shuffler 100 with the pre-shuffle bin 120 loaded with a deck of cards 102. In practice, a housing or cover may conceal the internal components of the automatic shuffler 100. The pre-shuffle bin 120 forms part of the card-selector assembly 130. Not shown in FIG. 1 is an optional article for creating a modest downward force of the deck of cards 102 to maintain said deck of cards 102 in a substantially flat and square orientation. FIGS. 8A through 11C show various articles of the type suitable to create the modest downward force on the deck of cards 102 in the pre-shuffle bin 120.

Figure 8A:
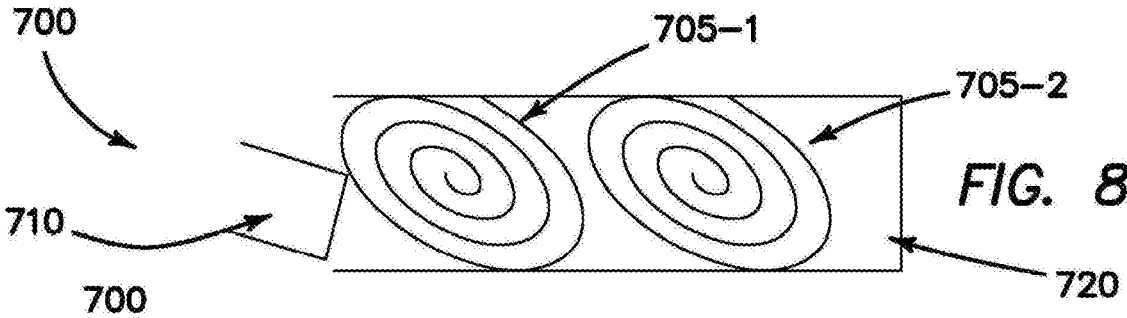
FIGS. 8A-8C illustrate a spring assembly for applying a modest downward force on a deck of cards in the pre-shuffle bin according to the embodiments of the present invention.
Figure 8B:
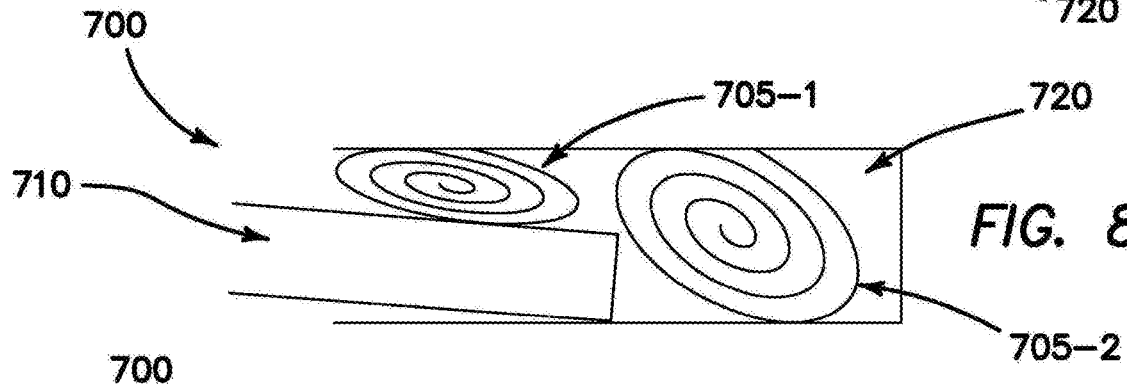
Figure 8C:
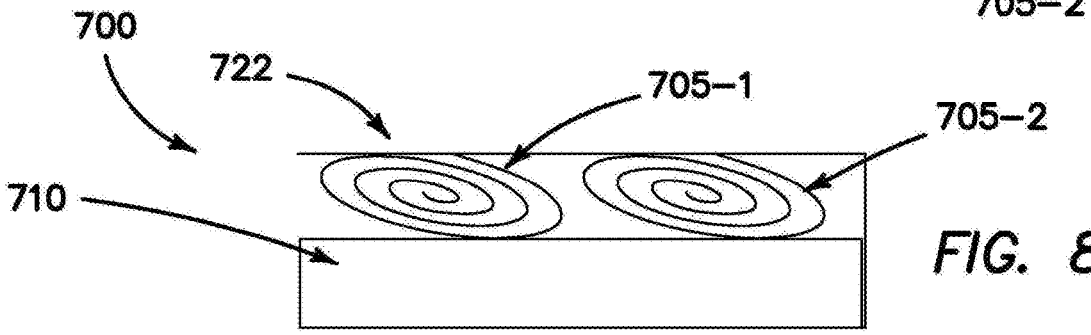

FIGS. 8A-8C show a spring assembly 700 for applying a modest downward force on a deck of cards 710 in the pre-shuffle bin 720 according to the embodiments of the present invention. A pair of clock springs 705-1 and 705-2 joined to a pre-shuffle bin cover, lid or top 722 compresses upward as the deck of cards 710 is inserted horizontally into the pre-shuffle bin 720. In the compressed state, the clock springs 705-1 and 705-2 apply a modest downward force on the deck of cards 710 thereby maintaining the deck of cards 710 in a substantially flat and square orientation.

Figure 9A:
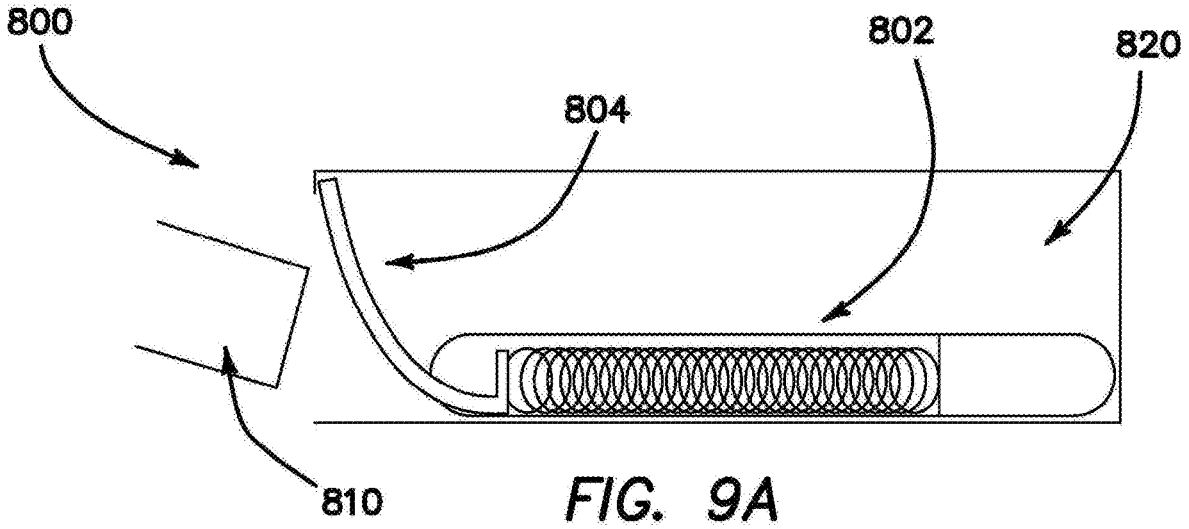
FIGS. 9A-9C illustrate an independent weight assembly for applying a modest downward force on a deck of cards in the pre-shuffle bin according to the embodiments of the present invention.
Figure 9B:
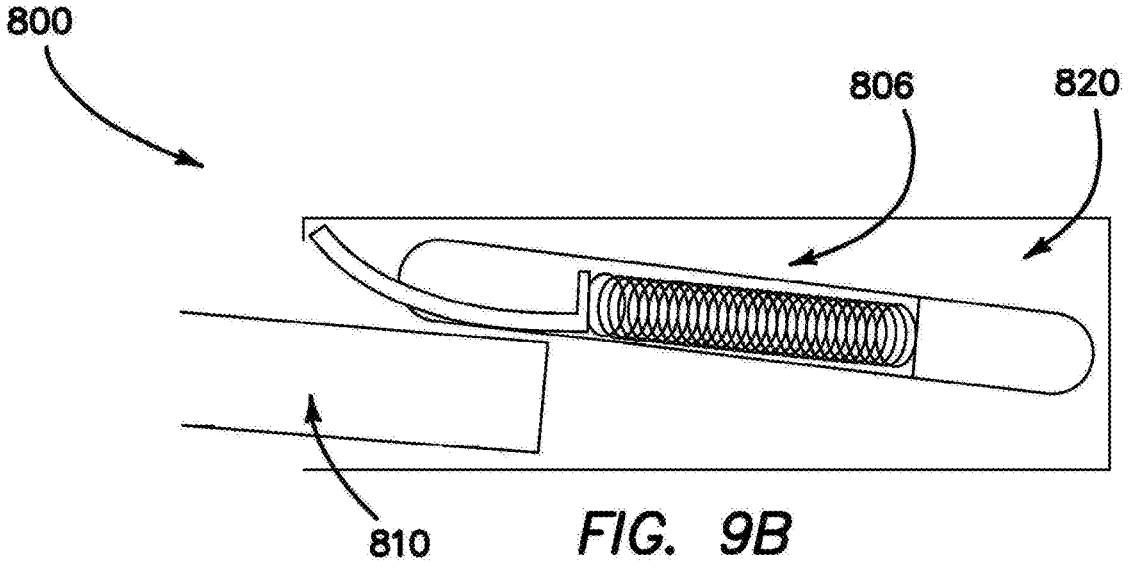
Figure 9C:
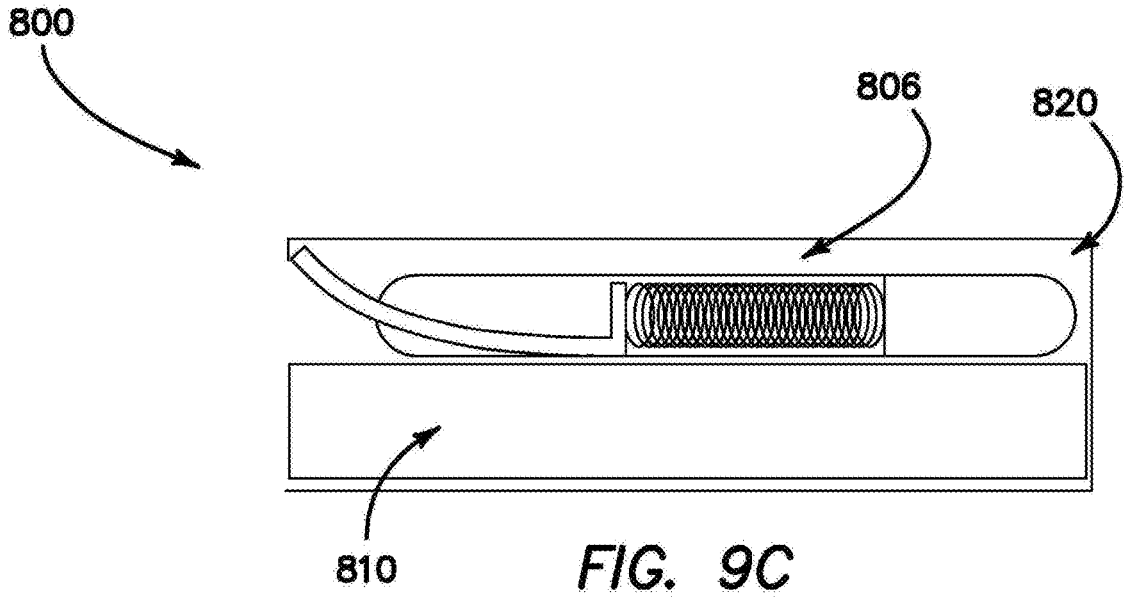

FIGS. 9A-9C show an independent weight assembly 800 for applying a modest downward force on a deck of cards 810 in the pre-shuffle bin 820 according to the embodiments of the present invention. The independent weight assembly 800 comprises a weight 802, guiding member 804 and internal spring 806. As the deck of cards 810 is inserted horizontally into the pre-shuffle bin 820, the guide member 804 elevates compressing internal spring 806 raising the weight 802 on top of the deck of cards 810.

Figure 10A:
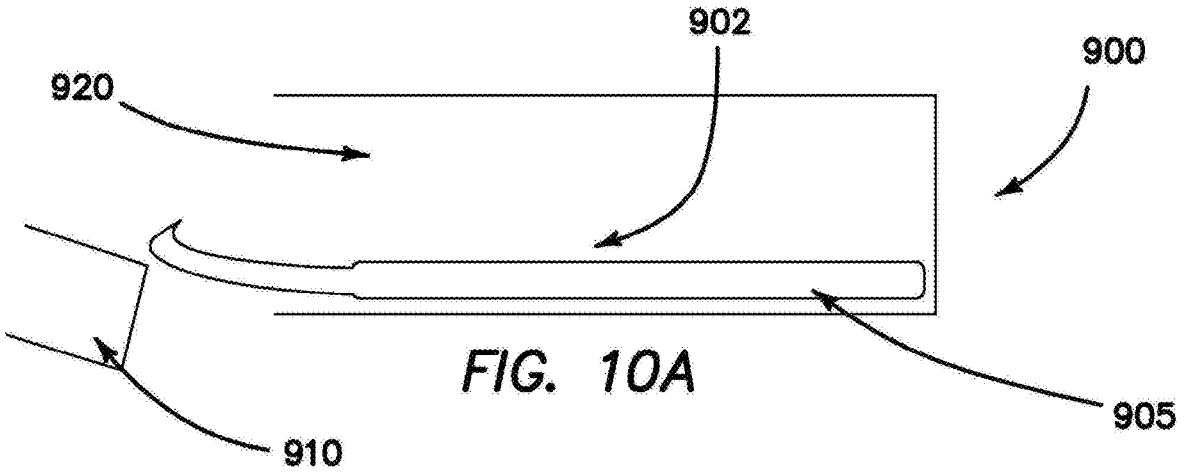
FIGS. 10A-10C illustrate a weighted lever for applying a modest downward force on a deck of cards in the pre-shuffle bin according to the embodiments of the present invention.
Figure 10B:
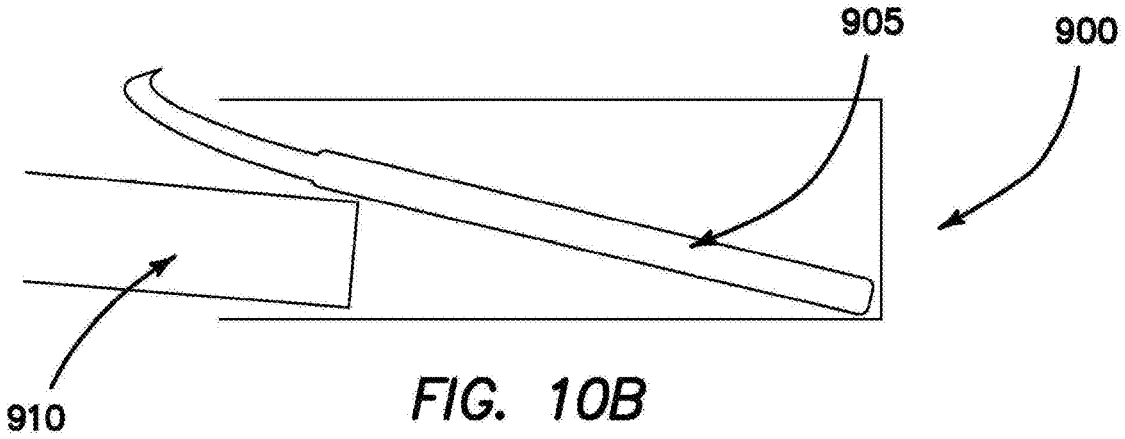
Figure 10C:
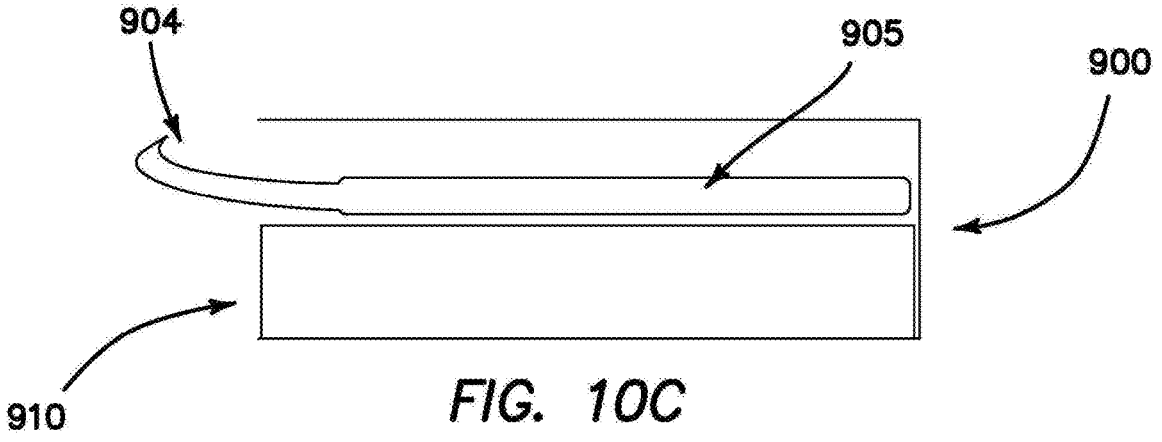

FIGS. 10A-10C show a weighted lever system 900 for applying a modest downward force to a deck of cards 910 in the pre-shuffle bin 920 according to the embodiments of the present invention. The weighted lever 905 is shaped with a flat first portion 902 and upwardly curved second portion 904 permitting the deck of cards 910 to slide horizontally under the weighted lever 900. As shown, the weighted lever 900 is not attached in any manner. Alternatively, one end of the weighted lever 900 may be slidably joined to a wall of the pre-shuffle bin 920.

Figure 11A:
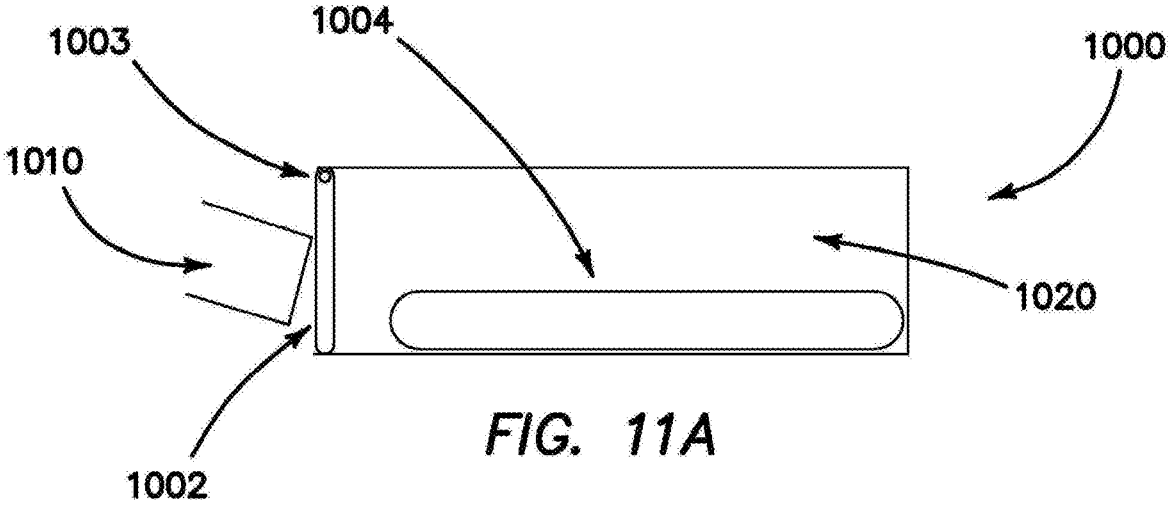
FIGS. 11A-11C illustrate an independent weight and door assembly for applying a modest downward force on a deck of cards in the pre-shuffle bin according to the embodiments of the present invention.
Figure 11B:
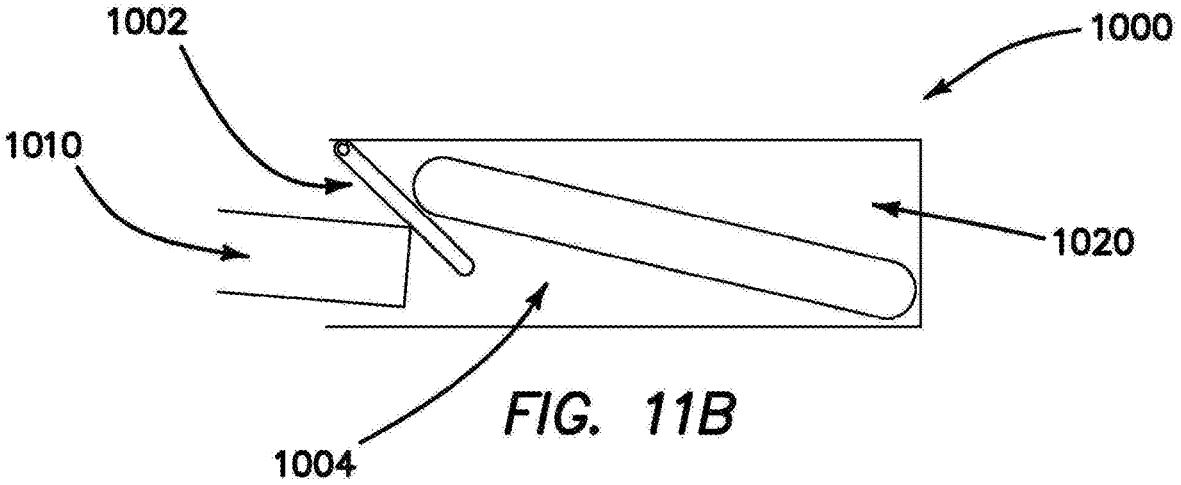
Figure 11C:
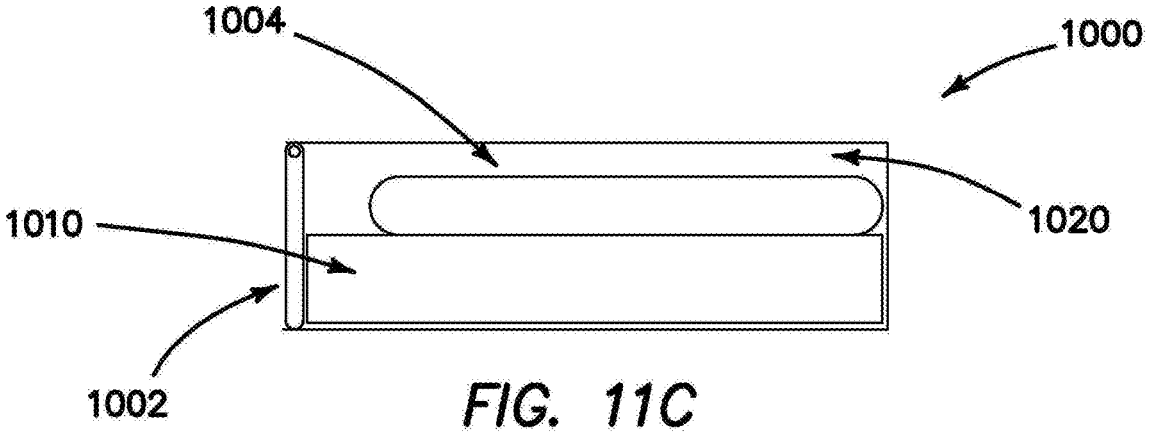

FIGS. 11A-11C show an independent weight and door assembly 1000 for applying a modest downward force on a deck of cards 1010 in the pre-shuffle bin 1020 according to the embodiments of the present invention. The independent weight and door assembly 1000 comprises a rotatable door 1002 and independent weight 1004. In operation, as the deck of cards 1010 is inserted horizontally into the pre-shuffle bin 1020, the door 1002 rotates about an upper rotation point 1003 such that the door 1002 lifts one end of the independent weight 1004 allowing the deck of cards to be inserted under the independent weight 1004.

While FIGS. 8A-11C show various solutions for applying a downward force on a deck of cards while in the pre-shuffle bin 102, those skilled in the art will recognize that other articles may suffice. In addition, electromechanical devices may be used as well. For example, idler rollers may be pushed downward on a deck of cards to apply the downward force.

Figure 2:
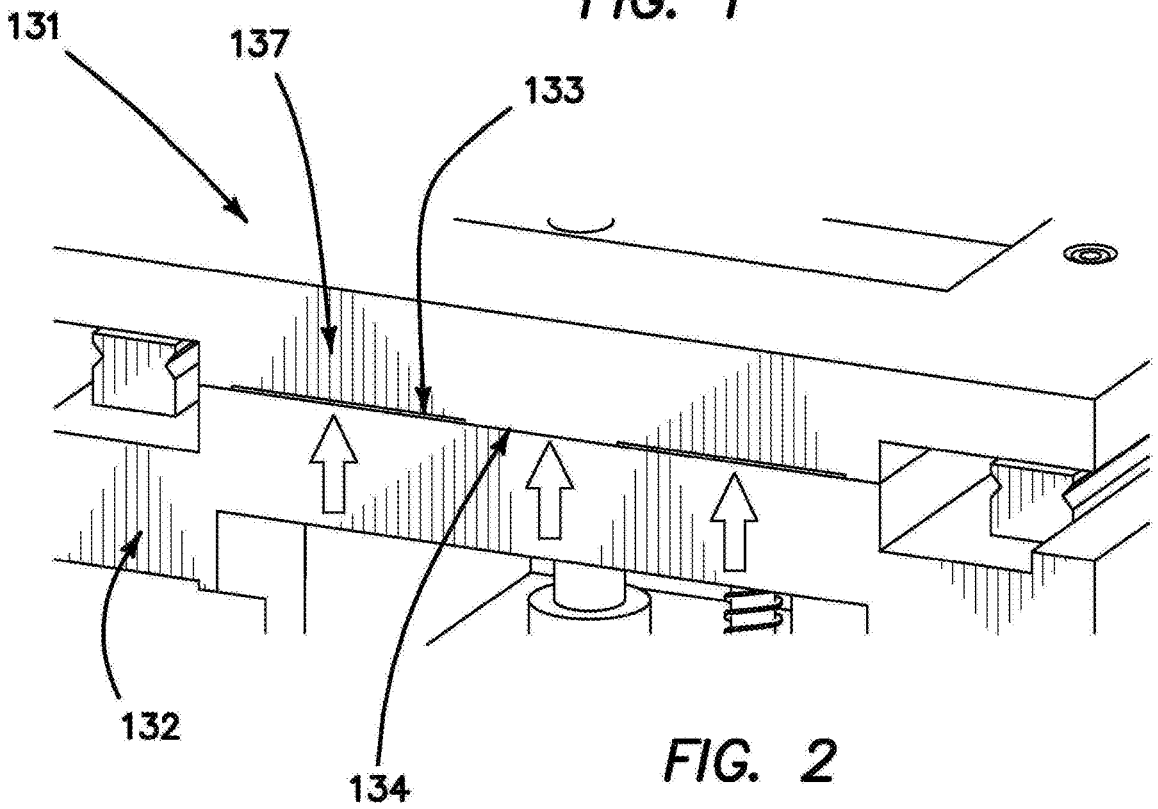
FIG. 2 illustrates a front view of a card-selector assembly of the automatic card shuffler according to the embodiments of the present invention.

FIG. 2 shows a side view of a card-selector assembly 130 of the automatic card shuffler 100 according to the embodiments of the present invention. The card-selector assembly 130 comprises the upper body 131 and lower body 132. The lower body 132 is stationary. The upper body 131 interconnects to the lower body 132 via a linear groove allowing the upper body 131 to slide on the lower body 132 via series of ball bearings. The lower body 132 and upper body 131, when aligned, define a gap 133 between walls thereof. A center notch 134 provides a location for drive wheel 160 or other drive mechanism to propel an exposed card as described below. When the upper body 131 and lower body 132 are aligned, the stepper motor 124 may raise and lower the pre-shuffle bin base 122. When the upper body 131 and lower body 132 are not aligned, the stepper motor 124 is not able to raise and lower the pre-shuffle bin base 122.

The base or floor 122 of the pre-shuffle bin 120 is free to raise and lower relative to an upper body 131 and lower body 132 of the card-selector assembly 130 thereby selectively positioning the deck of cards 102 into 1 of at least 52 vertical positions. In one embodiment, best seen in FIGS. 7B and 7C, a stepper motor 124 controls the selective positioning of the pre-shuffle bin base 122. A random number generator 126 in communication with the stepper motor 124 transmits instructions to the stepper motor 124 based on a randomly-generated number from 1 to 52 (or some other set of numbers capable of generating 52 random positions).

Figure 3:
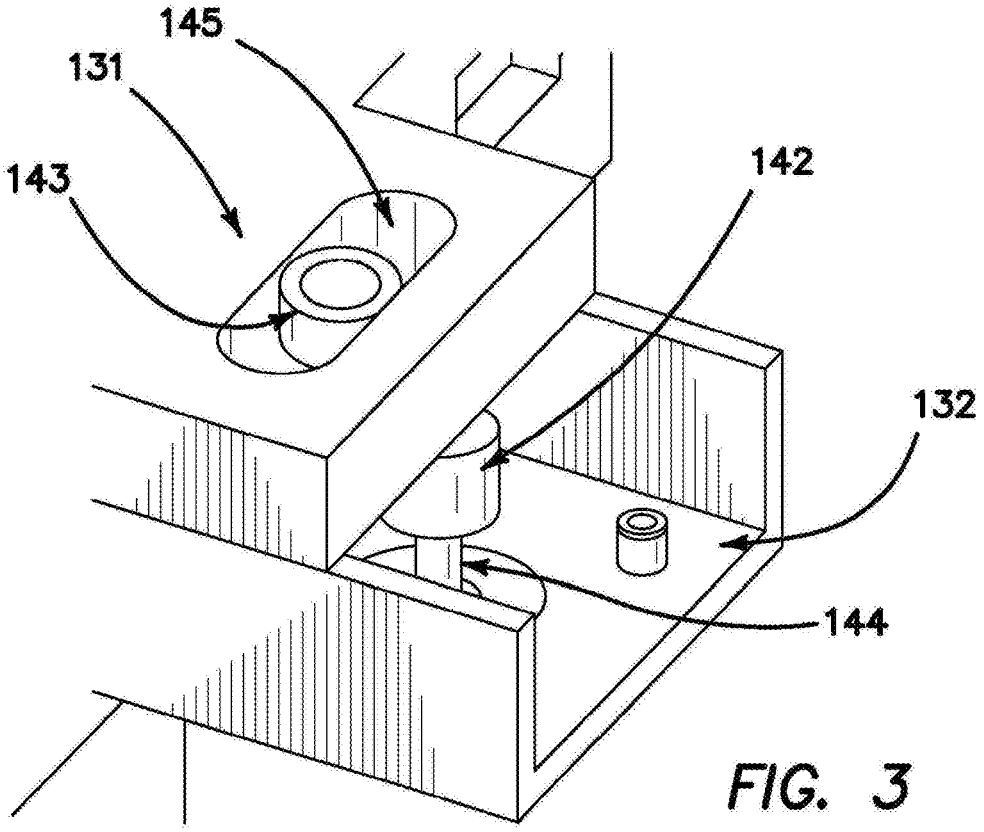
FIG. 3 illustrates an offset idler wheel of the card-selector assembly of the automatic card shuffler according to the embodiments of the present invention.
Figure 4:
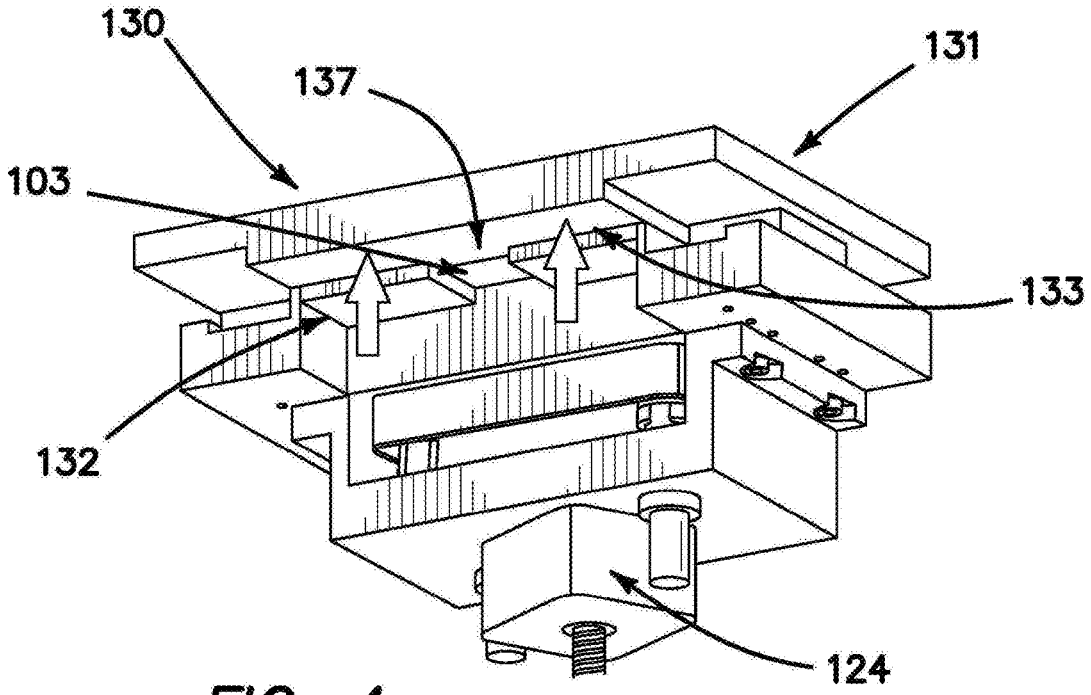
FIG. 4 illustrates an upper body of the card-selector assembly in a forward position according to the embodiments of the present invention.

FIG. 3 shows an offset idler wheel 142 of the card-selector assembly 130 according to the embodiments of the present invention. The offset idler wheel 142 is mounted to a vertical shaft 144 extending from said lower body 132 and driven by motor 110. The offset idler wheel 142 rotates an offset, attached secondary wheel 143 within a cam slot 145 in the upper body 131. Activation of the offset idler wheel 142 causes the secondary wheel 143 to force the upper body 131 to slide forward and rearward relative to the lower body 132 as needed. FIG. 4 shows the upper body 131 of the card-selector assembly 130 in a forward position.

Figure 5:
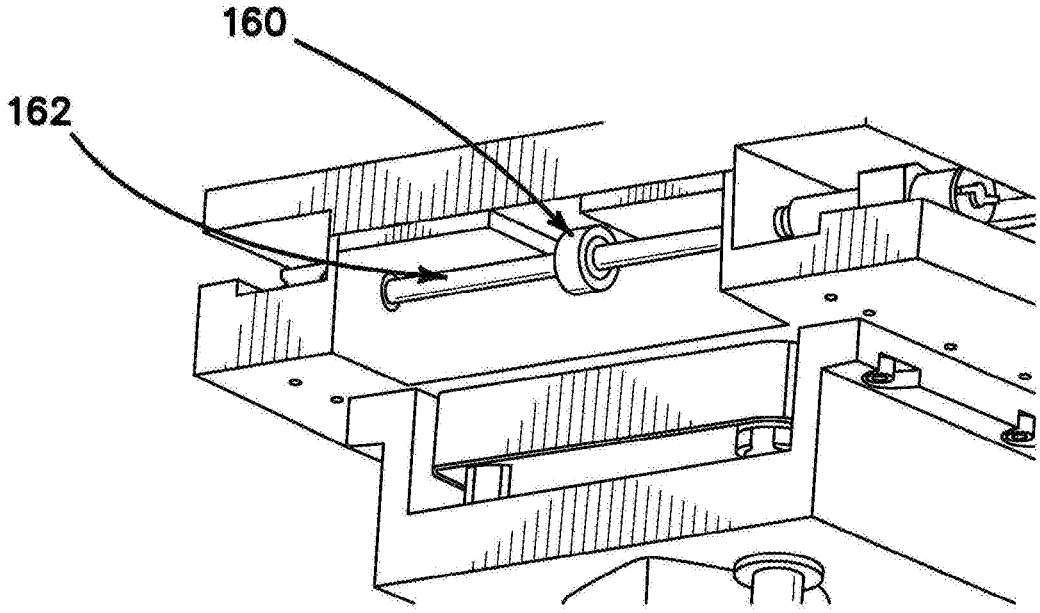
FIG. 5 illustrates a drive wheel relative to the card-selector assembly according to the embodiments of the present invention.
Figure 6B:
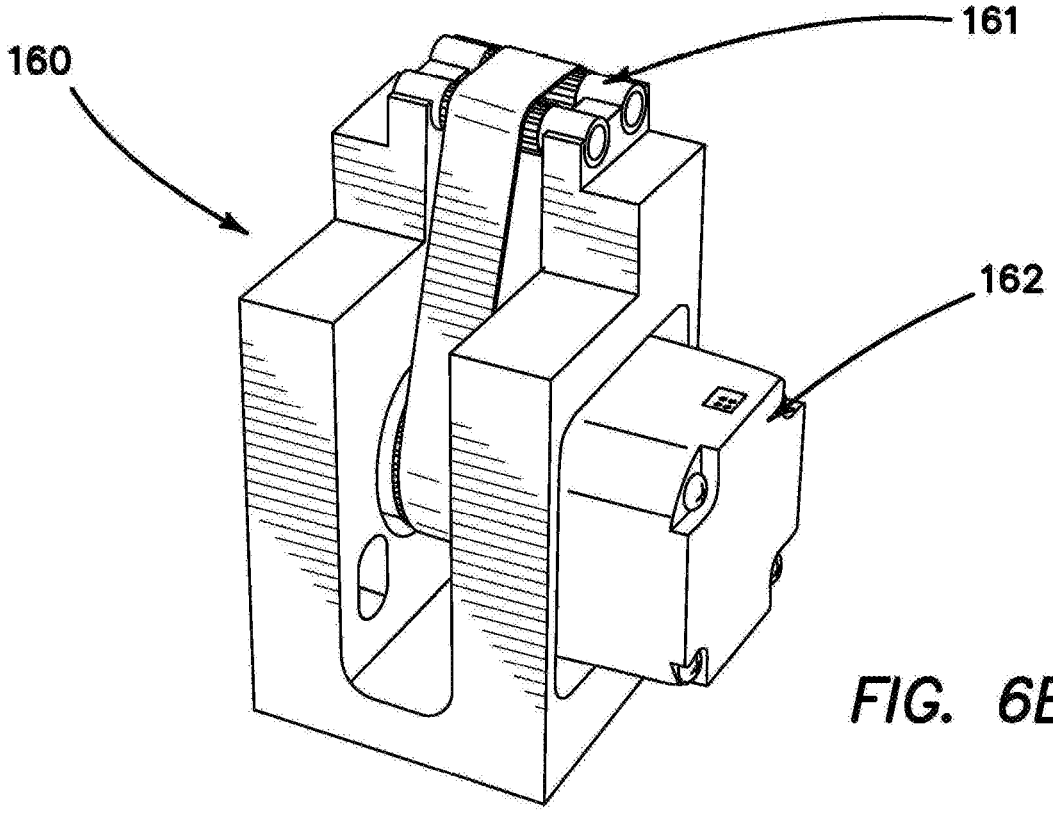
FIGS. 6A and 6B illustrates a cross-sectional view of the automatic card shuffler and drive mechanism, respectively, according to the embodiments of the present invention.
Figure 6A:
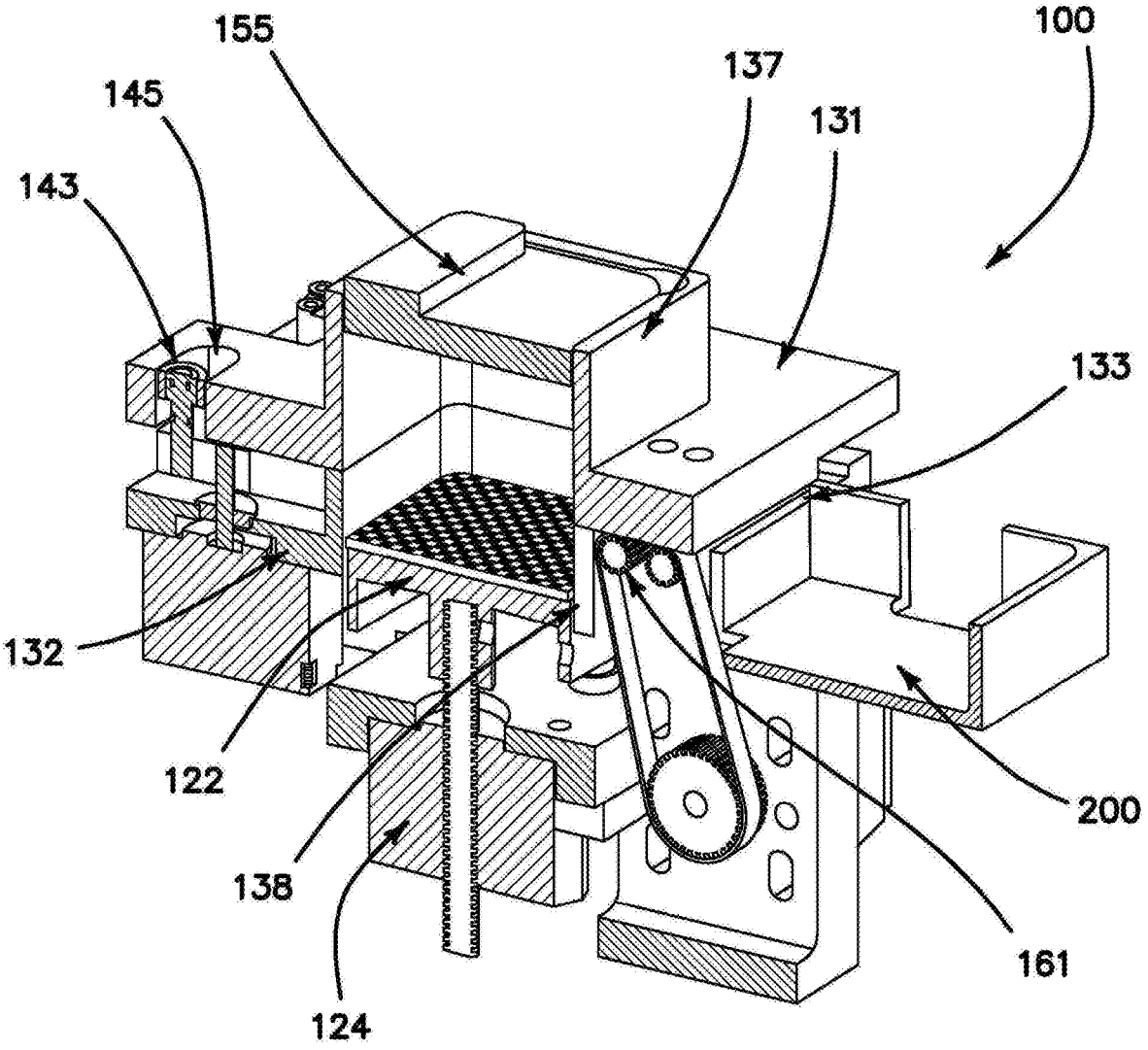

As seen in FIG. 4, when the upper body 131 moves forward, a card 103 is exposed in cut-out 104 in the lower body 132. The exposed card 103 may then be contacted by a drive wheel 160 mounted on a rotatable rod 162 shown in FIG. 5. As the upper body 131 moves forward, the upper body 131 serves to split the cards in the pre-shuffle bin 120 into an offset upper portion and lower portion with the bottom card of the offset portion being the card identified by the random number generator. The spinning drive wheel 160 contacting the exposed card 103 causes the exposed card 103 to be propelled to the post-shuffle bin 200. Once each of the 52 cards in the deck of cards has been propelled to the post-shuffle bin 200, the deck of cards is shuffled and available for play. FIG. 6A shows a cross-sectional view of the shuffler 100. In this embodiment, a weight 155 is positioned to apply a downward force to a deck of cards to be shuffled. Rather than a drive wheel 160, the drive mechanism (as shown in FIG. 6B) for propelling cards into the post-shuffle bin 200 is a belt and pulley arrangement 161 driven by motor 162.

Figure 13:
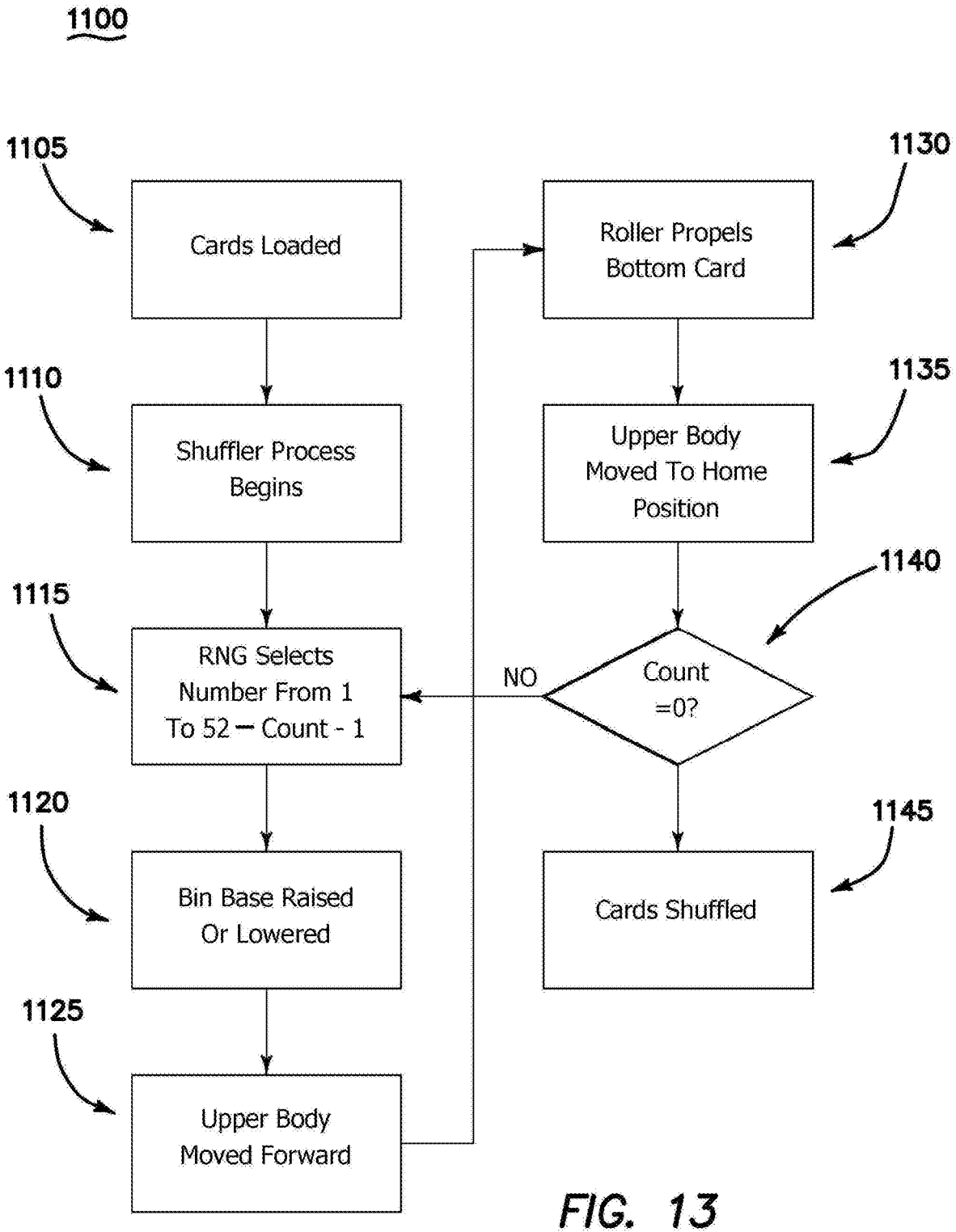
FIG. 13 illustrates a flow chart detailing one methodology for operating the automatic card shuffler according to the embodiments of the present invention.

FIG. 13 shows a flow chart 1100 detailing one methodology for operating the automatic card shuffler 100 according to the embodiments of the present invention. At 1100, a deck of cards is inserted into the pre-shuffle bin 120. The cards may be loaded via a top, back or side opening in a cover or housing of the shuffler 100. A sensor-controlled door for the pre-shuffle bin 120 may remain closed until all cards have been moved into the post-shuffle bin 200. As detailed above, in one embodiment, an article is used to apply a downward force on the deck of cards in the pre-shuffle bin. At 1110, upon detection by one or more sensors 104, 105 proximate to the pre-shuffle bin 120 and post-shuffle bin 200, respectively, indicating cards in the pre-shuffle bin 120 and no cards in the post-shuffle bin 200, the automatic shuffler 100 begins the shuffling process. In one embodiment, the shuffle process starts after a short delay (e.g., 2 seconds). At 1115, a random number generator selects a card number from 1 to 52 such that the corresponding card is propelled into the post-shuffle bin 200 and then the total number of remaining cards is reduced by one for the purpose of randomly selecting and shuffling the next card. The random number generator is software-based and in one embodiment uses a Fischer-Yates model to randomly select the card number. The card number is counted from the top of the deck of cards. For example, card number 23 is the $23^{rd}$ card from the top of the deck of cards. In an alternative embodiment, the card number may be counted from the bottom of the deck of cards. Once the card number is randomly selected, at 1120, the pre-shuffle bin base 122 is raised or lowered by stepper motor 124 to align the selected card with the gap 133. For example, if the first card number is 23, the pre-shuffle bin base 122 is moved so that the $23^{rd}$ card from the top of the deck of cards is aligned with the gap 133. At 1125, the upper body 131 moves forward thereby forcing the top 23 cards off the deck of cards in the pre-shuffle bin 120 slightly forward relative to and offset from to the pre-shuffle bin 120 and cards therein. The stationary lower body 123 prevents any card below the $23^{rd}$ card in the deck of cards from moving forward with the upper body 131. The $23^{rd}$ card is the bottom card of the stack of cards moved forward by the upper body 131. The other 29 cards in the deck of cards remain in the pre-shuffle bin 120 below and not impacted by the moving upper body 131. At 1130, once the 23 cards are moved a maximum distance (e.g., one inch offset relative to the lower body 132), the spinning drive wheel 160 contacts the bottom card (i.e., the $23^{rd}$ card) propelling it to the post-shuffle bin 200. The drive wheel 160 may be positioned to contact the exposed bottom card when the card is moved forward or the drive wheel 160 may selectively raise to contact the exposed bottom card as the card is forced forward by the upper body 131. More than one drive wheel may be used including vertically-oriented rollers to provide additional energy to propel cards from the pre-shuffle bin 120 to the post-shuffle bin 200. Blocking wall 137 of upper body 131 and wall 138 of the lower body 132 collectively allow only the bottom card of the offset upper portion of cards to be propelled into the post-shuffle bin 200 by the drive wheel 160. The blocking wall 137 is dimensioned to block all cards above the selected card while permitting the selected bottom card to be contacted by the drive mechanism. At 1135, once the exposed bottom card is propelled to the post-shuffle bin 200, the upper body 131 moves rearward depositing the offset upper portion of cards, minus the propelled card, back into the pre-shuffle bin 120 on top of the cards remaining in the pre-shuffle bin 120. At 1140, it is determined if the number from step 1115 equals zero meaning that all cards have been propelled to the post-shuffle bin 200. Moving each card into the post-shuffle bin 200 requires the automatic shuffler 100 to cycle 52 times (i.e., one cycle per card in the deck of cards). A cycle includes raising or lowering the pre-shuffle bin base 122 and moving the upper body 131 forward and rearward. If the current number representing cards remaining in the pre-shuffle bin 120 is not zero at 1135, the flow chart 1100 loops back to step 1115 where the random number generator selects a number between 1 and the current number or cards remaining. That is, each time a card is moved to the post-shuffle bin 200, the random number generator generates a random number based on the number of cards remaining to be moved into the post-shuffle bin 200. Once all cards have been moved to the post-shuffle bin 200, at 1145, the shuffled cards are accessed by the dealer for play of a game.

Figure 7A:
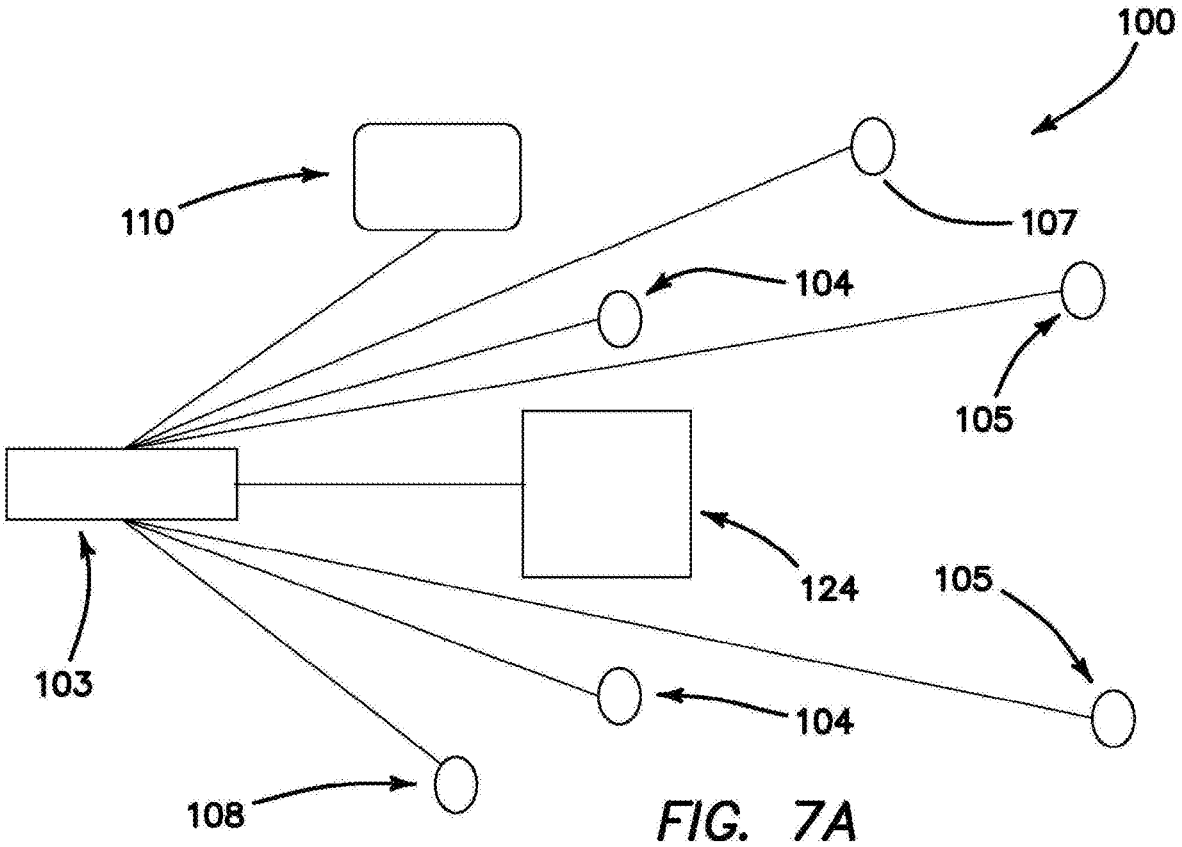
FIG. 7A illustrates a block diagram of a single deck card shuffler according to the embodiments of the present invention.

FIG. 7A shows a block diagram of the single deck shuffler 100. A controller, processor 103 or like runs executable instructions for controlling the operations of the single deck shuffler 100. The processor 103 communicates with hardware including: (i) sensors 104 located proximate to the pre-shuffle bin 120; (ii) sensors 105 located proximate to the post-shuffle bin 200; (iii) stepper motor 124 and (iv) motor 110 for driving the offset idler wheel 142. The processor 103 is further in communication with memory 107 and random number generator 108. The random number generator 108 may be part of the executable instructions or a separate module as shown. In one embodiment, the single deck shuffler 100 is approximately 400 $in^3$.

Figure 7B:
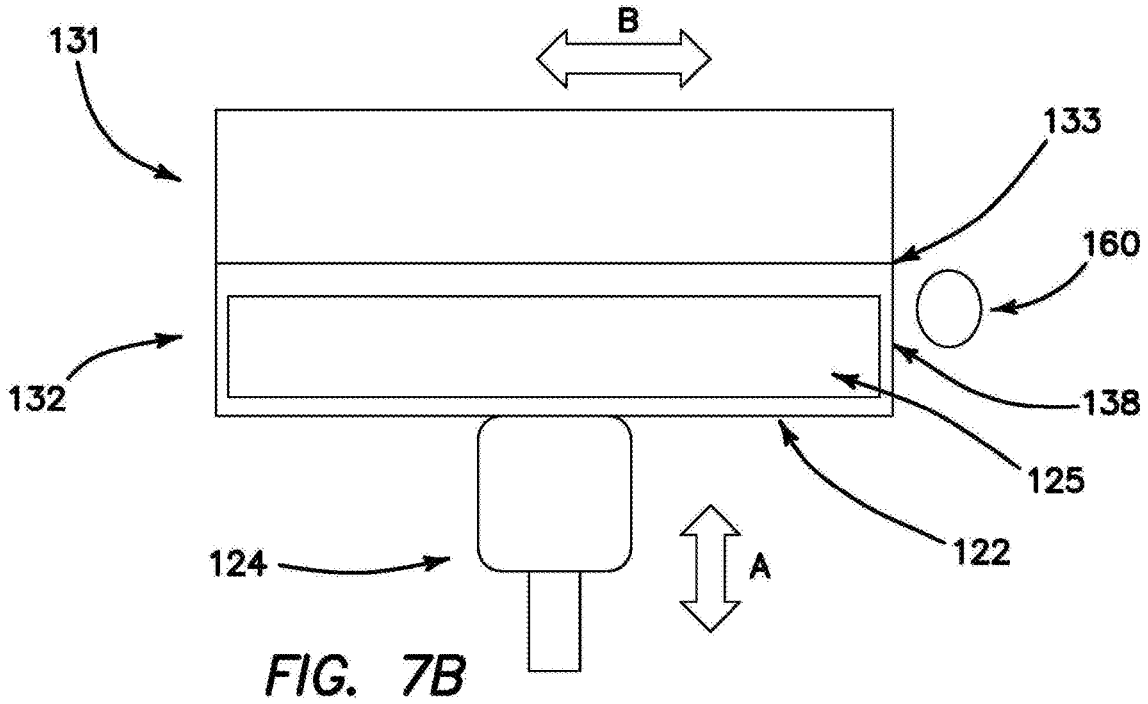
FIG. 7B illustrates a cross-sectional side view of the card-selector assembly in a home position according to the embodiments of the present invention.
Figure 7C:
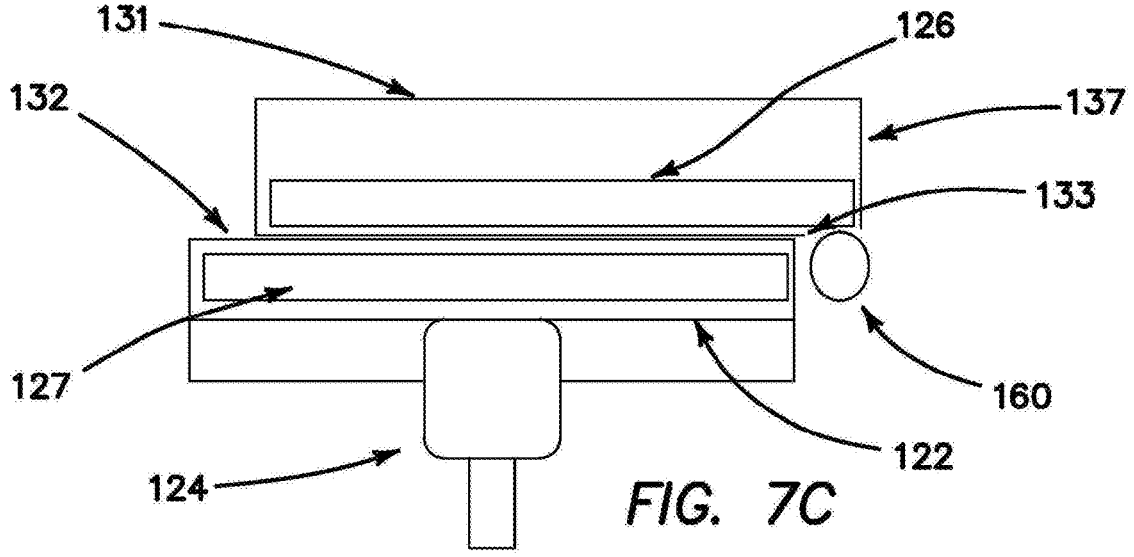
FIG. 7C illustrates a cross-sectional side view of the card-selector assembly with upper body in forward position according to the embodiments of the present invention.

FIGS. 7B and 7C show cross-sectional views of the card-selector assembly 130 in a home position and forward position. In FIG. 7B, the upper body 131 and lower body 132 are aligned with a deck of cards 125 in the pre-shuffle bin 120. Stepper motor 124 acts on pre-shuffle bin base 122. Arrows A and B represent potential movements of the upper body 131 and pre-shuffle bin base 122. FIG. 7C shows the pre-shuffle bin base 122 raised and the upper body 131 moved forward pursuant to a randomly-generated card number. The forward movement of the upper body 131 separates the deck of cards 125 into an upper portion 126 and lower portion 127. In this offset position, the drive wheel 160 may propel the bottom card in the upper portion 126 of cards into a post-shuffle bin 200. Wall 137 of upper body 131 and wall 138 of the lower body 132 collectively allow only the bottom card of the offset upper portion of cards 126 to be propelled into the post-shuffle bin 200 by the drive wheel 160. Wall 137 prevents cards above the selected card from being propelled while wall 138 prevents any cards 127 below the selected card from being moved from the pre-shuffle bin 200 by the movement of the upper body 131. That is, once the upper body 131 moves into an offset position relative to the lower body 132, the gap 133 transforms into a passageway or similar clearance for the selected card to be propelled by the drive wheel 160 into the post-shuffle bin 200.

In one embodiment, the processor 103 is configured to place the shuffler 100 in a short-cycle mode. Responsive to one or more sensors detecting a time below a pre-established threshold time (e.g., 20 seconds) between cuts of successive shuffled decks of cards by the dealer, the processor 103 places the shuffler 100 into short-cycle mode wherein, the shuffler randomly selects a pre-established number of cards (e.g., 35) for shuffling as described herein and then moves consecutively in order the remaining cards from the pre-shuffle bin 120 to the post-shuffle bin 200 on top of the previously shuffled cards. When the deck is removed from the post-shuffle bin 200, the dealer cuts the deck such that the consecutively-moved cards are moved to the bottom of the deck prior to dealing. The consecutively-moved cards are those remaining after the shuffling of the pre-established number of cards so even if some on the consecutively-moved card end up in play, they have been adequately shuffled. The short cycle mode is advantageous for fast-paced games (i.e., heads-up).

In one embodiment, an automatic calibration system is premised on card or deck thicknesses as measured by sensors proximate to the pre-shuffle and/or post-shuffle bin. Sensors 104, 105 may measure card thicknesses or additional sensors may be installed for the specific purpose. Given the tendency of playing cards (paper and plastic) to expand during use, it is beneficial to calibrate the automatic card shuffler so that the stepper motor 124 is moved at accurate tolerances to ensure that the randomly-selected card is the card propelled by the drive wheel 160 to the post-shuffle bin 200. Responsive to detecting the thicknesses of cards expanding, the automatic calibration system, via processor 103, communicates to the stepper motor 124 to alter the distance the stepper motor 124 raises and lowers for each card position.

In another embodiment, a card-counting sensor 106 may be used to sense each card moving from the pre-shuffle bin 120 to the post-shuffle bin 200 so the deck count may be verified. The card-counting sensor 106 may be positioned between the pre-shuffle bin 120 and post-shuffle bin 200. In an alternative embodiment, the automatic card shuffler 100 may incorporate a card reading system (e.g., image capturing technology) to identify the rank and suit of each card thereby verifying the exactness of the deck of cards.

Figure 12A:
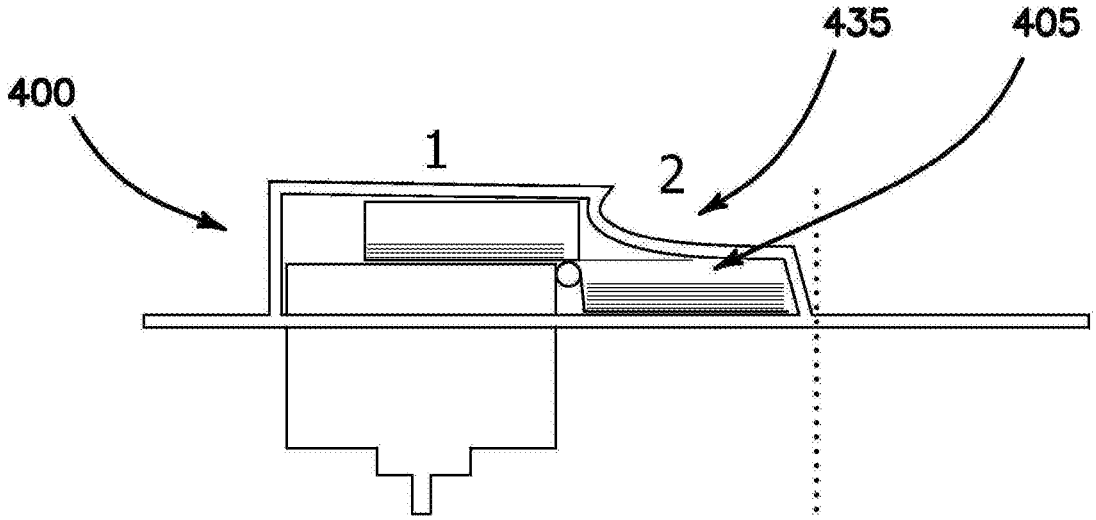
FIGS. 12A-12H illustrate various post-shuffle bin configurations according to the embodiments of the present invention.
Figure 12B:
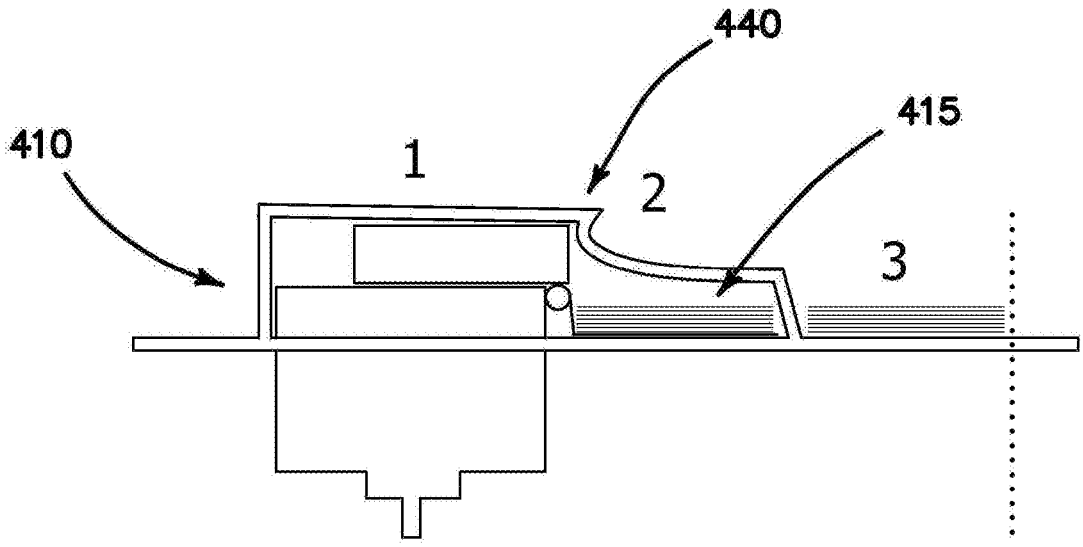

FIGS. 12A-12H show various post-shuffle bin configurations according to the embodiments of the present invention. Once the deck of cards has been shuffled, the shuffled cards must then be accessed by the dealer. In one embodiment, unshuffled cards are placed in the pre-shuffle bin 120 before the shuffled cards are removed from the post-shuffle bin 200 in batch shuffler style so that two decks of cards are shuffled in a revolving fashion. Depending on the embodiment, the shuffler 100 may be a two-position automatic shuffler or three-position automatic shuffler. As shown in FIGS. 12A and 12B, a two-position automatic shuffler 400 permits the dealer to access the shuffled cards directly from the post-shuffle bin 405 while a three-position automatic shuffler 410 involves automatically moving the shuffled cards from the post-shuffle bin 415 to a position external to the shuffler. Covers 435, 440 conceal the internal components of the automatic shufflers 400, 410. It is evident from FIGS.

12A-12H that a majority of the automatic card shuffler is positioned below the upper surface of the card table. In one embodiment, the automatic card shuffler raises no more than 2" above the upper surface of the card table or chip tray. It is conceivable that the automatic card shuffler may be oriented at an angle to permit gravity to assist with moving cards from a pre-shuffle bin to the post-shuffle bin.

Figure 12C:
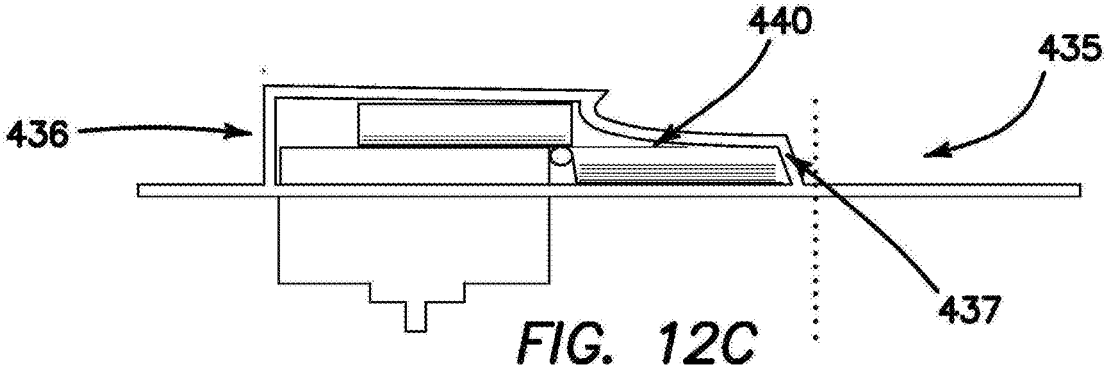
Figure 12D:
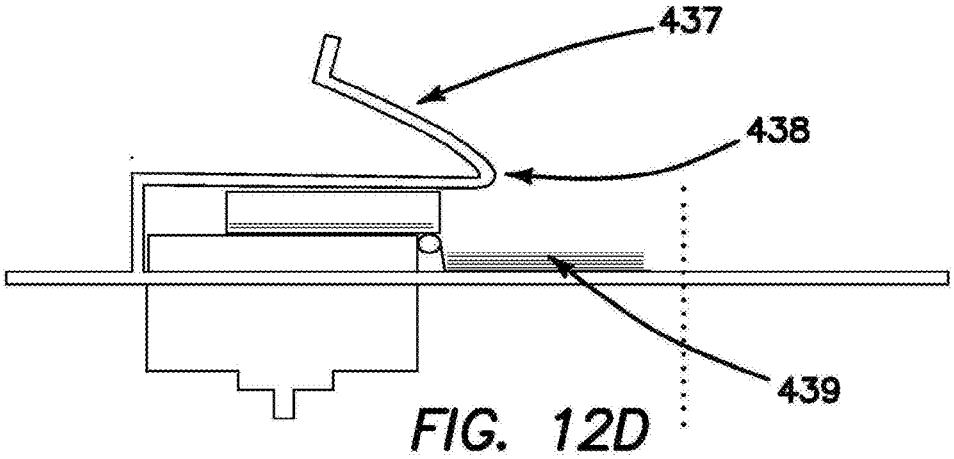
Figure 12E:
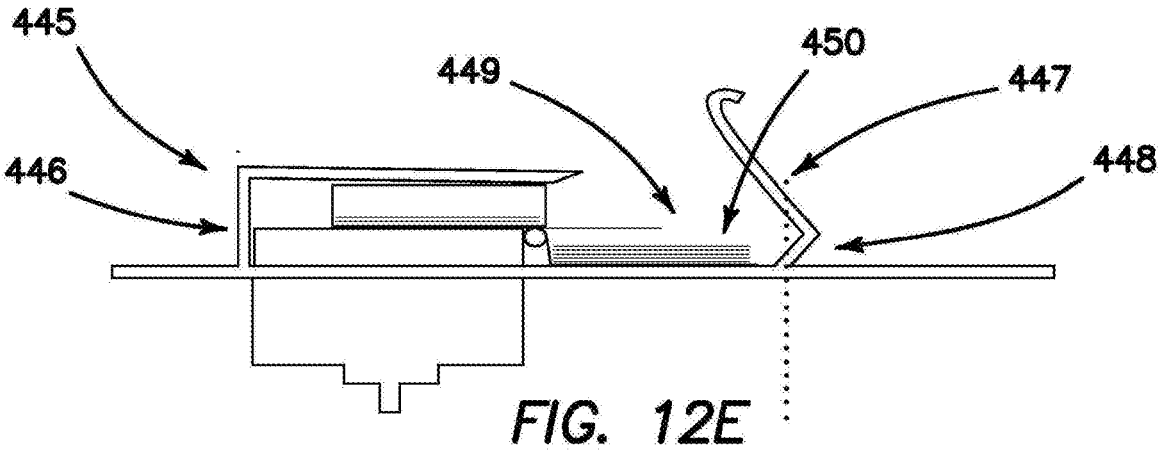

FIGS. 12C and 12D show a two-position automatic shuffler 435 having a cover 436 with a door 437 which flips upward about a hinge 438 permitting access to the shuffled cards 439 in the post-shuffle bin 440. FIG. 12E shows another two-position automatic shuffler 445 having a cover 446 with a door 447 which flips upward about a hinge 448 permitting access to the shuffled cards 449 in the post-shuffle bin 450.

Figure 12F:
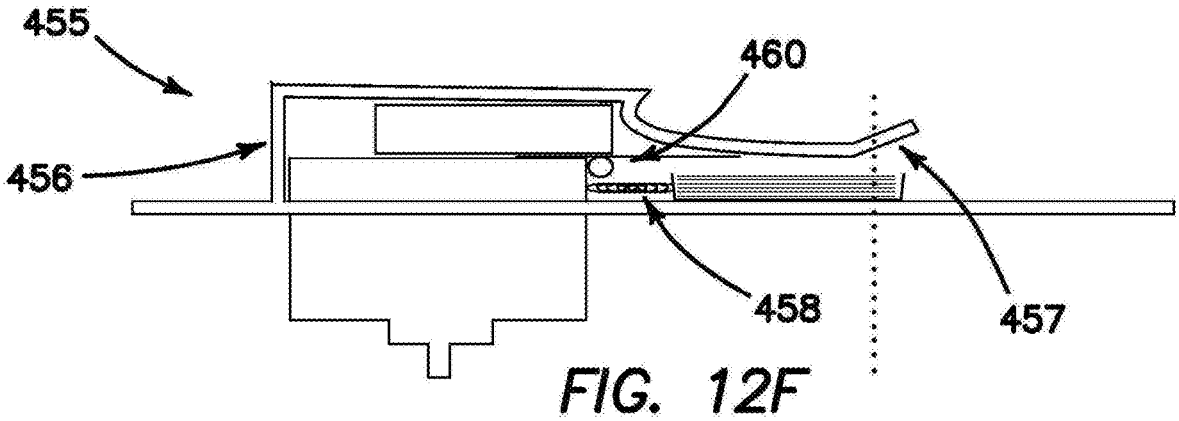
Figure 12G:
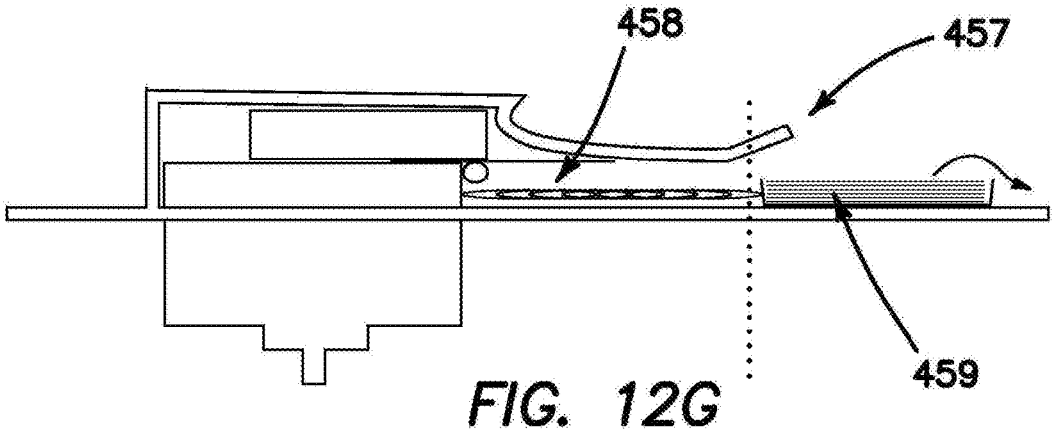
Figure 12H:
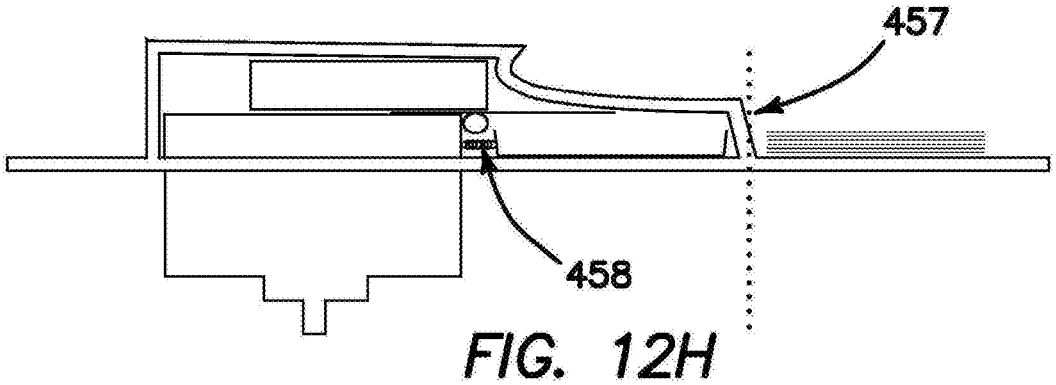

FIGS. 12F through 12H show a three-position automatic shuffler 455 having a cover 456 with a door 457 which flips upward allowing a plunger 458 to push shuffled cards 459 from the confines of the automatic shuffler 455. While a plunger 458 is described, it is apparent that any physical article capable of pushing, or otherwise moving, a deck of cards a short distance from the post-shuffle bin 460 to a position external and proximate thereto may be utilized to achieve the objective of the three-position automatic shuffler.

The processor 103, as described above, also controls the doors 437, 447, 457 and plunger 458, or other article, pursuant to sensor feedback indicating the deck of cards has been shuffled and is ready for game play.

Figure 14A:
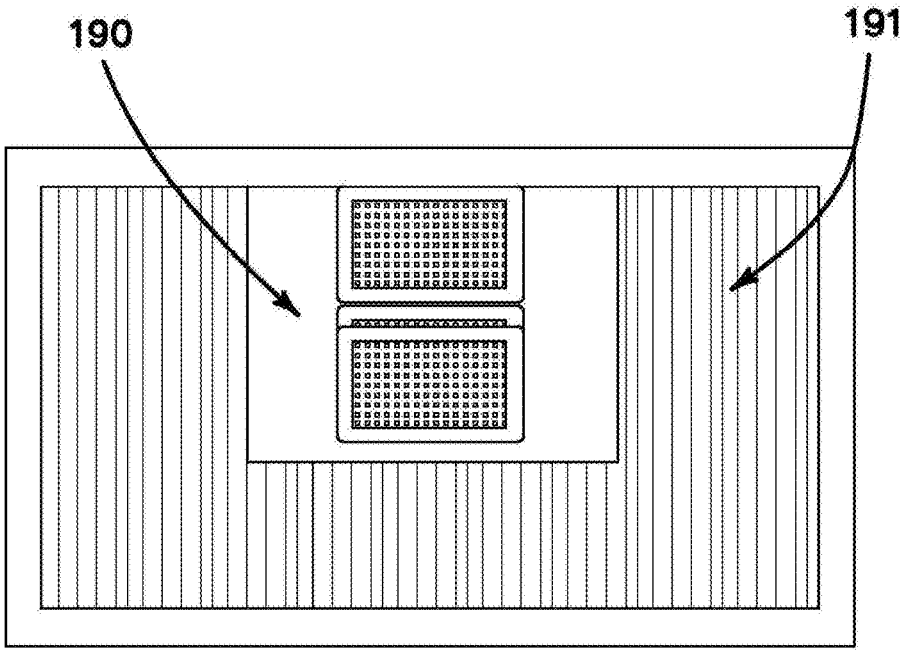
FIGS. 14A and 14B illustrate positioning of the automatic shuffler integrated into a poker table and chip tray according to the embodiments of the present invention.
Figure 14B:
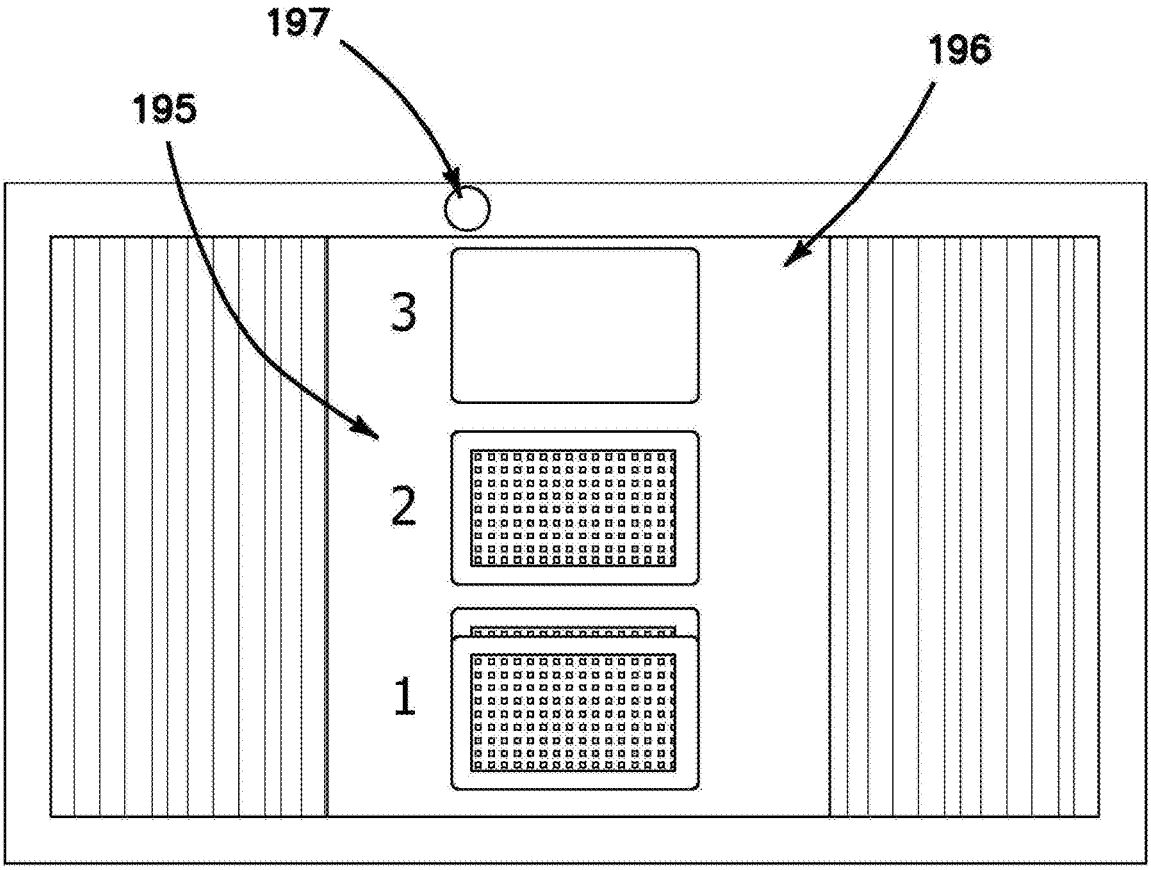
Figure 15A:
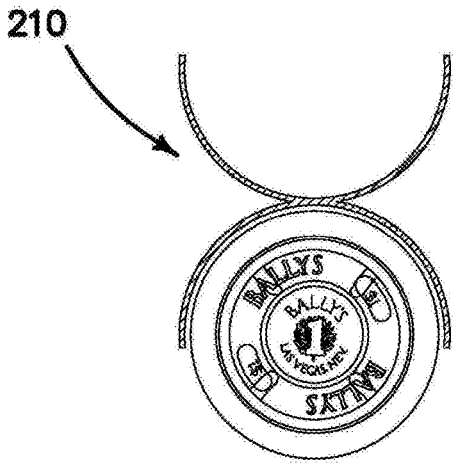
FIGS. 15A and 15B illustrate chip tray toppers according to the embodiments of the present invention.
Figure 15B:
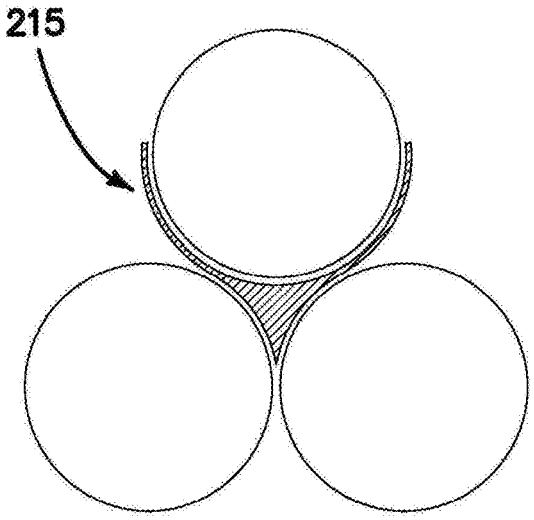

FIGS. 14A and 14B show positioning of the automatic shuffler integrated into a poker table adjacent to a modified chip tray according to the embodiments of the present invention. FIG. 14A shows a footprint 190 of a two-position shuffler integrated into a poker table within a cut-out in chip tray 191 while FIG. 14B shows a footprint 195 of a three-position shuffler integrated into a poker table within a cut-out in chip tray 196. In another embodiment, the chip tray may be U-shaped and configured to slide onto the poker table around the shuffler. FIG. 14B also shows an optional reader 197 for identifying the bottom card as it passes thereover and a bottom card after a deck cut. In conjunction with an internal card reading system, the readings of sensor 197 can be used to verify deck order, etc. In either embodiment, a portion of the chip tray 191, 196 meant to retain gaming chips is eliminated. Accordingly, FIGS. 15A and 15B illustrate chip tray toppers 210, 215 according to the embodiments of the present invention. The chip tray toppers 210, 215 permit gaming chips to be stacked in the chip trays 191, 196 to increase capacity eliminated by the integration of the automatic card shuffler. The chip trays toppers 210, 215 may be fabricated of plastics, composites, alloys, metals or combinations thereof. In one embodiment, the chip tray toppers 210, 215 incorporate magnets, hooks, latches or other connectors to secure the chip tray toppers 210, 215 to the chip rack or other article.

One or more LEDs may be integrated into the automatic card shuffler to indicate shuffler status. With an LED, different colors and/or blinking speeds are indicative of shuffler status including ready to load status, ready to remove shuffled cards status, card jam status, missing card status, etc.

While the shuffler 100 has been detailed relative to a poker game, it should be understood that the shuffler 100 may be suitable for any number of cards games with modification. As described herein, the shuffler 100 can be used for a single blackjack game. A two-deck blackjack game requires that the shuffler 100 have a slightly increased profile (<1" more than a single deck) to accommodate the additional deck of cards.

With carnival games or novelty games (e.g., Three Card Poker) the hands are dealt by a dealing module forming part of the shuffler. Each hand is then provided to the player by the dealer. Given the design of the shuffler 100, the process of dealing hands is very simple and efficient as the shuffler 100 may pause after each hand is formed and re-start after each hand is dealt. In one embodiment, a blocking wall is attached to sides of the shuffler 100 (with the post-shuffle bin 200 removed or re-configured to allow cards to exit the shuffler 100) so that cards propelled from the pre-shuffle bin 120 strike the blocking wall landing on the table surface or previous propelled cards. The blocking wall may be modest in height/width serving only to stop propelled cards so that the card 1s stack on top of one another. Once a hand is formed, the shuffler 100 pauses. An arm or lever then moves part or all of the formed hand away from the blocking wall allowing the dealer to grab and deal the hand. One or more sensors proximate to the blocking wall detect when the formed hand has been removed and trigger the shuffler 100 to begin again and deal a next hand. The process continues until a button or other input device, used by the dealer, alerts the shuffler 100 that the next hand is the final hand (i.e., dealer hand) to be dealt which causes the shuffler 100 to handle the remaining cards in the shuffler in one of several ways.

In a dual deck embodiment (i.e., batch), once each of the hands has been dealt, the shuffler 100 consecutively propels the remaining cards against the blocking wall thereby emptying the shuffler of cards for the second deck to be inserted. In another embodiment, the remaining cards may be pushed together from the shuffler 100 by a mechanical device (e.g., arm) or similar article. With such an embodiment, wall 137 of upper body 131 may rotate open allowing the remaining cards to be collectively pushed from the shuffler 100 by the mechanical device. In a single deck embodiment where only one deck is used, the remaining cards may be maintained in the pre-shuffle bin 120 until the played cards are inserted back on top so that the shuffling process may begin again.

To minimize movement and maximize dealing speed, the shuffler 100 may not propel the selected cards in the order they are randomly selected. For example, if the three randomly selected cards for a Three Card Poker game are numbers 1, 52 and 2 in that order, rather than deal the cards in the selected order, the shuffler 100 may deal the hand by propelling cards 52, 2 and 1 to minimize shuffler movement while increasing the deal pace. With a single player hand, the order of the cards in the hand is irrelevant.

Figure 16A:
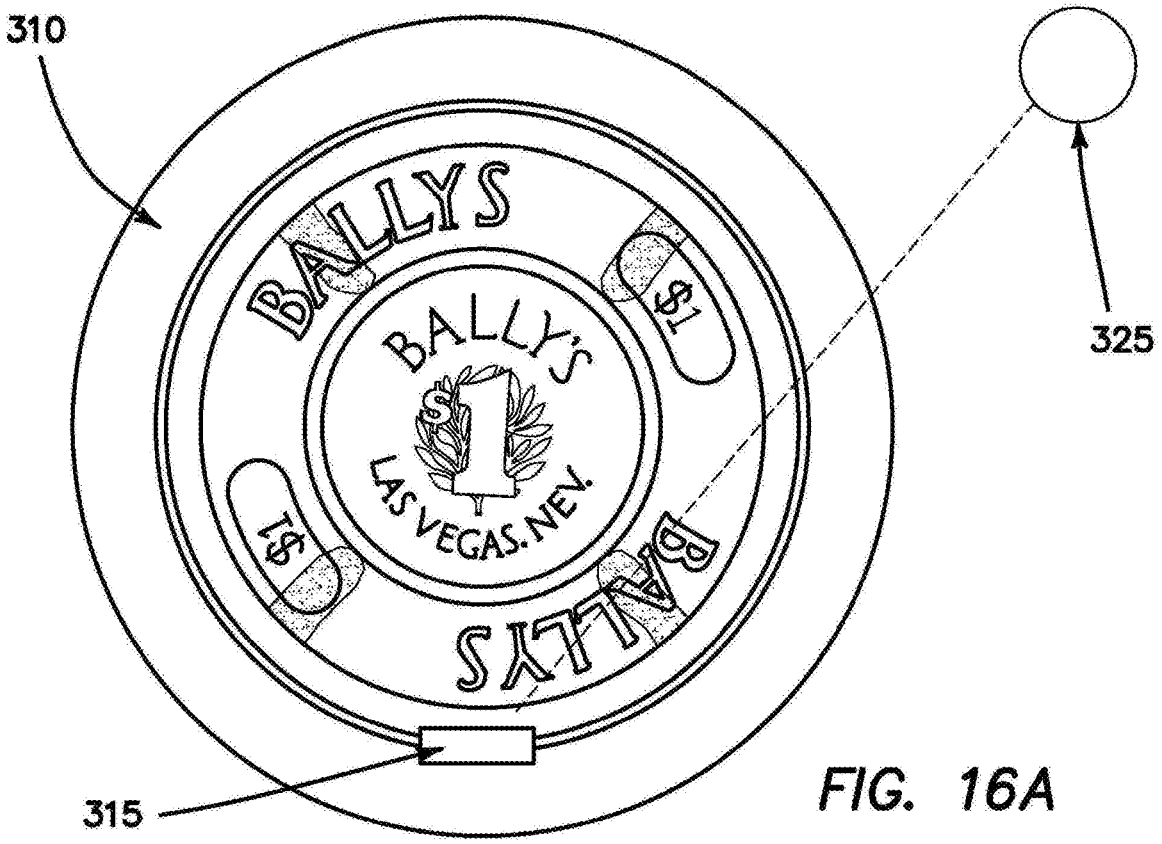
FIGS. 16A-16C illustrate a coin drop mechanism according to the embodiments of the present invention.
Figure 16B:
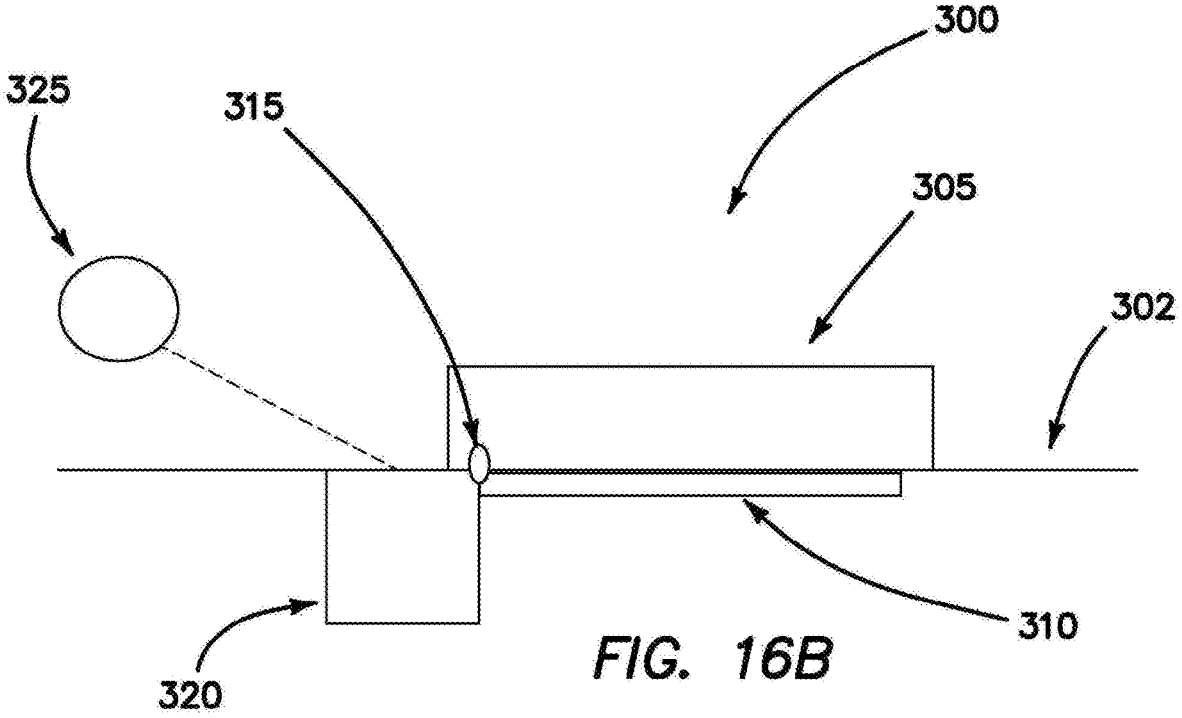
Figure 16C:
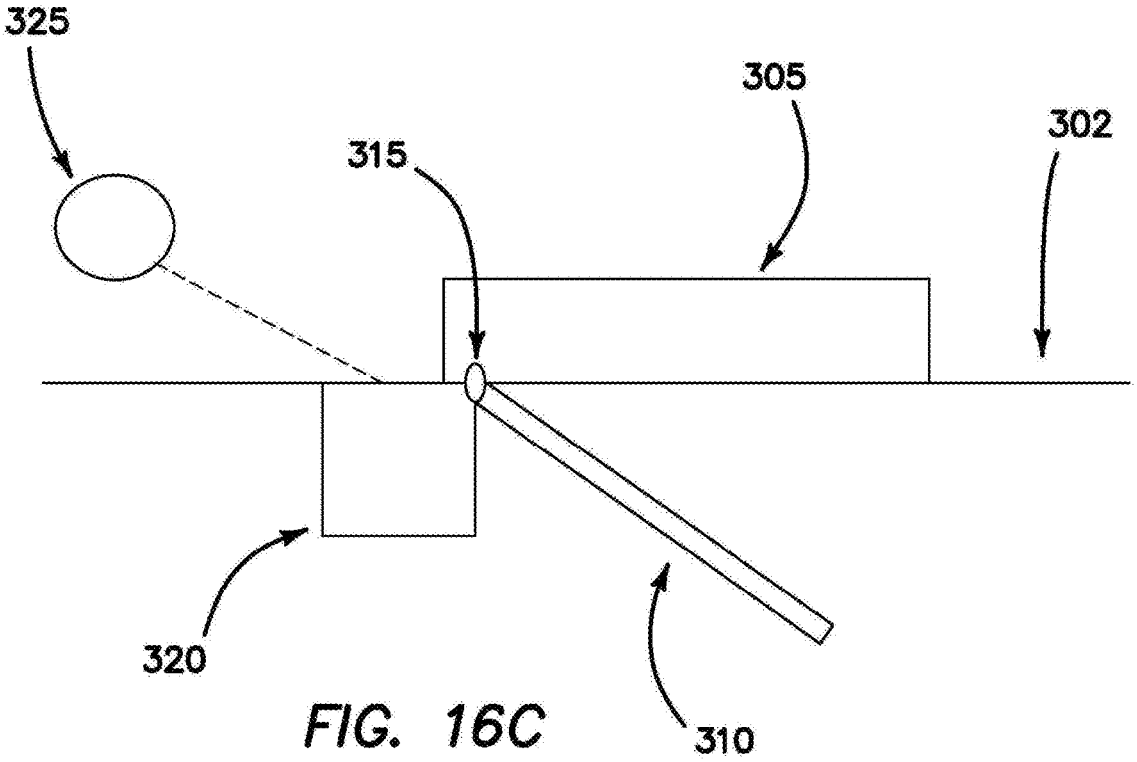

Another embodiment of the present invention involves an automated rake drop device 300. During live poker games, dealers rake (i.e., collect) a portion of each pot for the house. The rake acts as a fee for the house operating the game. The normal rake procedure involves the dealer taking chips from the poker pot and placing them onto a drop slot covered by a slidable lever. After the hand ends and the pot is pushed to the winning player(s), the dealer opens the slot using the slidable lever allowing the chips to fall through an opening in the poker table into a drop box connected to an underside of the poker table. As shown in FIGS. 16A through 16C, the present invention is directed to a circular drop 300 comprising a frame 305, drop cover 310, hinge 315, micro-switch/receiver 320 and sensor/transmitter 325 integrated into a poker tabletop 302. FIGS. 16B and 16C show a side view of the drop cover 310 in a closed position and open position respectively. The sensor 325 resides in the shuffler described herein or any shuffler such that the sensor 325 is able to detect when the next game's cards have been shuffled and removed from the shuffler. Once the shuffled deck is removed from the shuffler, the sensor 325 causes the micro-switch 320 to open the drop cover 310 via hinge 315 (as shown in FIG. 16C) allowing chips thereon to fall into the drop box below. The sensor 325 and micro-switch 320 may communicate via a wired or wireless connection.

The shuffler technology detailed herein may be used for a multi-deck shuffler (e.g., 4-8 decks) as well. In one embodiment, a multi-deck shuffler comprises a single unit having two shuffler components and a shared post-shuffle bin into which both shuffler components propel cards from bins of each shuffler. A vertical pre-shuffle bin accepts, for example, six decks of cards comprising 312 cards (6×52). A mechanism (e.g., rollers, pusher, etc.) separates the six decks in two substantially equivalent stacks with one stack being deposited into a bin of one shuffler component and a second stack being deposited into a bin of the other shuffler component. Selected random numbers then cause the shuffler component to propel cards into a common post-shuffle bin. In one embodiment, the random number generator selects a number from 1-312 and the shuffler component holding the selected card propels the card into the shared post-shuffle bin. Alternatively, each shuffler component may have its own random number generator such that each shuffle component may act independently. Regardless of the process, the result is six decks of shuffled cards requiring only a single shuffle. As the post-shuffle bin is vertically oriented, once the shuffle process concludes, a mechanism tips the post-shuffle bin into a horizontal position such that the shuffled cards are made available to the dealer. In one embodiment, a shallow frame associated with the post-shuffle bin maintains the decks in an orderly arrangement. A sensor detects when the post-shuffle bin is empty causing the post-shuffle bin to close.

Depending on the embodiment, the two shuffle apparatuses may have a different, unknown number of cards. For example, if a pusher is used to separate the 312 cards into two separate stacks, the number of cards in each shuffler apparatus may be unequal. The system firmware is configured to assume an equal number of cards in each shuffler apparatus so that the shuffling process continues in a normal fashion until it is determined that such is not the case. If one of the shuffler apparatuses attempts to shuffle a card but no card exists at the selected location, the bin base continually raises one spot until a card is located. From this exercise, the shuffler firmware can determine a number of cards in each shuffler apparatus and continue the shuffle normally until complete.

A multi-deck shuffler is ideal for handling a Baccarat game. The concept of shuffling and dealing simultaneously is only possible with a random-selection shuffler. In a game wherein players and a dealer each receive three cards, three cards are randomly selected and moved to the gaming table ready for dealing to the player or dealer. This occurs after only three cards have been moved from the unshuffled deck. Contrarily, random-position shufflers require each card to be moved to a random position, shelf or slot before they can be dispensed as complete, individual hands. That is, random-position shufflers require all unshuffled cards to be moved before the dealing phase.

In one embodiment, a Baccarat shuffler 400 is configured to randomly select and shuffle enough cards to complete a round of play as opposed to enough cards to fill a hand. In this manner, the round of cards may be used to deal cards in the traditional fashion (i.e., one card at a time to each player position). With current market shufflers, novelty game hands are dealt such that players and the dealer receive hands in a single group of cards rather than one at a time.

Figure 18A:
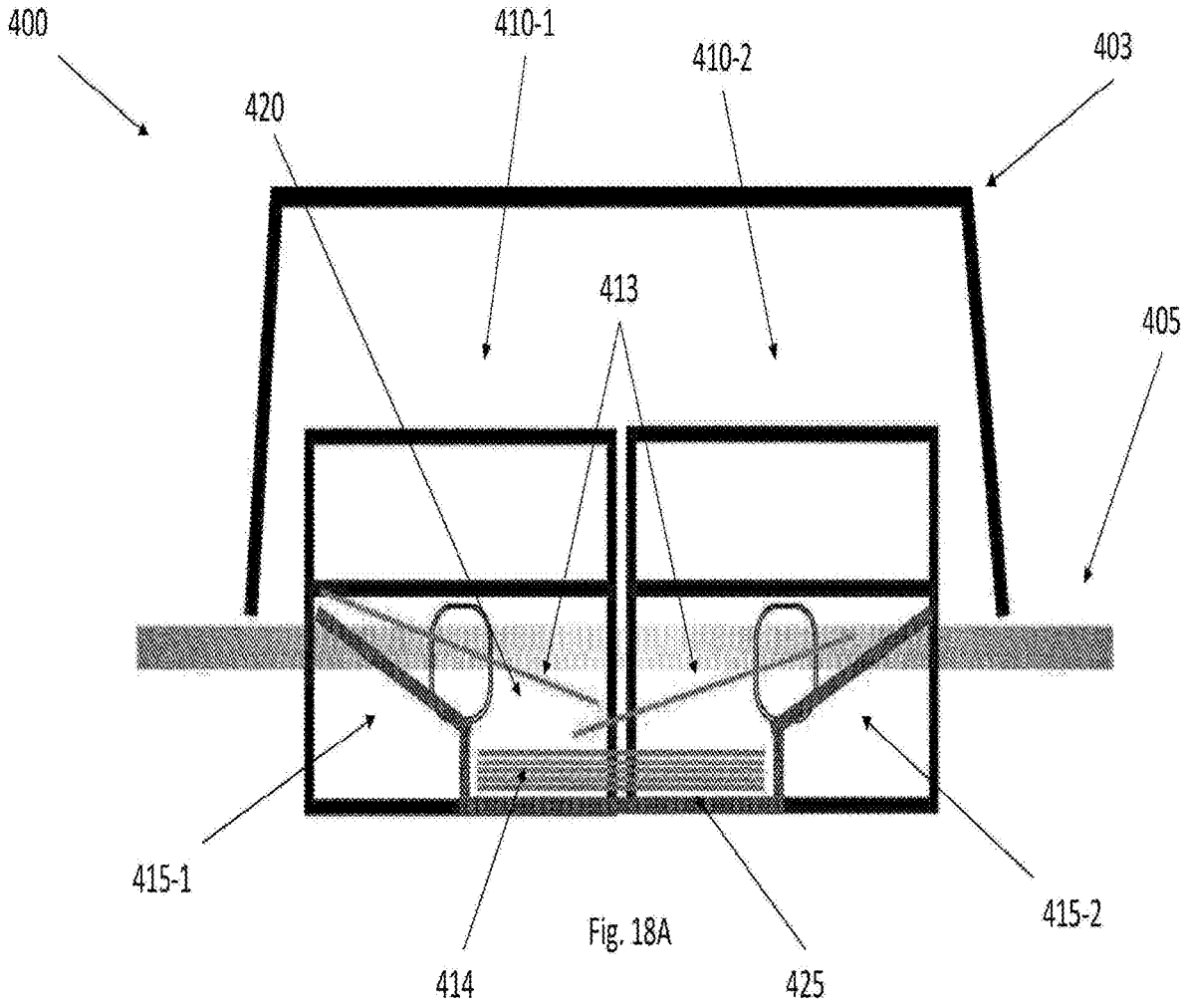
FIGS. 18A and 18B illustrate a cross-sectional front end view of a Baccarat shuffler according to the embodiments of the present invention.
Figure 18B:
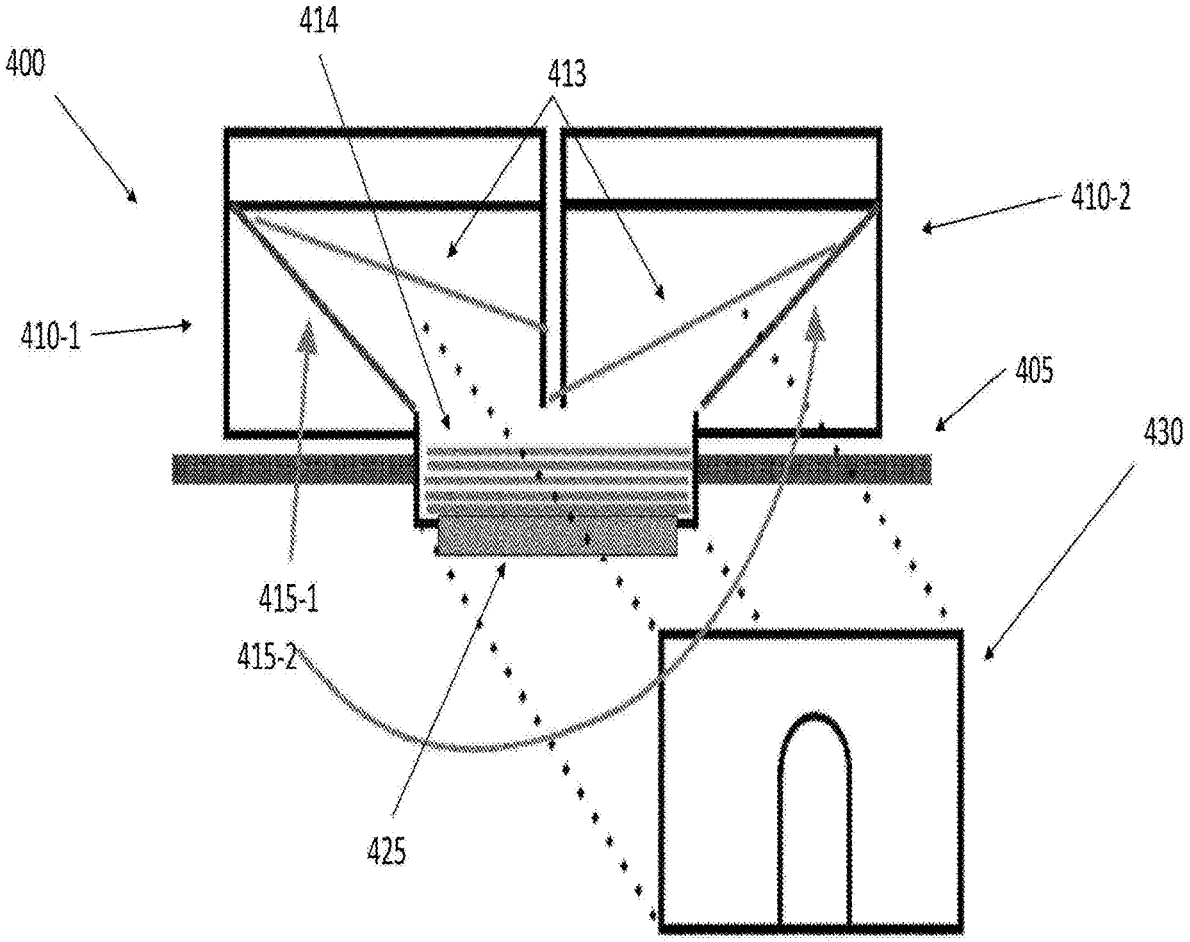

FIGS. 18A and 18B show cross-sectional front end views of the Baccarat shuffler 400 mounted to a gaming table 405 according to the embodiments of the present invention. The Baccarat shuffler 400 includes two separate random-selection shuffler devices 410-1, 410-2 within a shuffler housing 403. The two shuffler devices 410-1, 410-2 are spaced with card outputs facing a front of the Baccarat shuffler 400 (towards a viewer of FIG. 18) and a common card-receiving area 420. The card-receiving area receives cards randomly selected and propelled or moved from the first group of cards and second group of cards. Thus, the cards moved into the card-receiving area are shuffled. Each of the shuffler devices 410-1, 410-2 includes a pre-shuffle bin. The shuffler devices 410-1, 410-2 are each rear of a respective card slide 415-1, 415-2 positioned to direct randomly-selected and forwardly propelled or moved cards 414 from each shuffler device 410-1, 410-2 into the common card-receiving area 420 and on to a flipper mechanism 425. An integral dealing shoe 430 or partial shoe provides dealer access to shuffled cards as detailed below. The configuration of the Baccarat shuffler 400 provides a much smaller profile than other shufflers designed to shuffle multiple decks of cards. Accordingly, when installed on a gaming table, the Baccarat shuffler 400 does not interfere with dealer actions as larger profile shufflers might.

Besides providing a smaller profile, the use of two shuffler devices 410-1, 410-2 inherently results in a faster shuffling process. The speed of the two shuffler devices 410-1, 410-2 is further increased when the next two random cards are selected from different shuffle devices 410-1, 410-2, as the first shuffler device 410-1 moves to select the card in its pre-shuffle bin, the second shuffle device 410-2 can begin moving to locate the card in its pre-shuffle bin.

Loading the Baccarat shuffler 400 begins with a dealer dividing eight decks of cards into two piles of approximately equal cards. Given the operation of the two shuffler devices 410-1, 410-2, the two piles of cards do not have to be equal. Once the two piles are created, a two-step loading process begins. The Baccarat shuffler 400 is configured, responsive to a dealer "Load" input (e.g., button, touch screen interface, etc.), one of the pre-shuffle bins of one of the shuffler devices 410-1 raises to an upper-most position while the pre-shuffle bin of the other shuffler device 410-2 remains at a lowest-most position. Once the first pre-shuffle bin is loaded with one pile of cards, the dealer may utilize a "Loaded" input to cause the first pre-shuffle bin to move to a home position while the other pre-shuffle bin moves to a highest-most position. Alternatively, one or more sensors located in the pre-shuffle bins may automatically trigger the raising and lowering of the pre-shuffle bins upon cards being loaded into the first pre-shuffle bin. Once the second pre-shuffle bin raises to the upper-most position, the second pile of cards is loaded. The dealer may complete the loading process by utilizing the "Loaded" input again or sensors may trigger an automatic movement whereby the second pre-shuffle bin returns to a home position.

The shuffler operation is set forth above and the only difference is that the two shuffler devices 410-1, 410-2 operate individually to randomly select and propel cards 413 from the respective piles of cards into the common card-receiving area 420 and on to the card flipper 425.

Conducting a Baccarat game includes two procedures for burning cards. The first procedure involves burning a single card. The second procedure turns the top card face up and burns an additional number of cards equal to the face-up cards value. For example, if the top card is a seven, seven cards are burned whereas if the top card is a ten, ten cards are burned. Casinos may also implement other burn card procedures which the Baccarat shuffler 400 can be configured to shuffle and deal.

In a first embodiment, the Baccarat shuffler 400 shuffles eight cards and forces them against a dealing shoe face plate (see, FIGS. 19A-19M and 20A-20F) before the top card is burned and the first round is dealt. The maximum number of cards required to deal a Baccarat round is six cards—the player and the banker each receive two cards initially and may take, based on the rules, one additional card. Shuffling eight cards for the first round provides a burn card and one extra cover card remaining in the shoe in the event six cards are required to deal the round. In a second embodiment, the Baccarat shuffler 400 shuffles eighteen cards to accommodate one face-up burn card, a maximum number of six game cards, a maximum of ten burn cards and one cover card. Different casinos elect to burn one or eleven cards in the event the top card is an Ace. Another Baccarat variant involves burning no cards when the top card has a ten value (e.g., ten, Jack, Queen or King) since such cards have zero value in the Baccarat game. The Baccarat shuffler 400 is configured to handle at least the four most-common burn card variations, namely (i) a single face-down card; (ii) a single face-up card plus number of burn cards equal to the top card value (Ace=1); (iii) a single face-up card plus number of burn cards equal to the top card value (Ace=11) and (iv) single face-up card plus number of burn cards equal to the top card value (ten value cards=0). It is well-understood that the Baccarat shuffler 400 may be configured to accommodate any conceivable burn card variation.

With the single face-down card burn card variation, the Baccarat shuffler 400 first randomly selects and forces eight cards against the dealing shoe face plate (deemed an eight-card buffer) and then seven-card buffers for each subsequent round until a new fresh game shuffle. Dependent upon the number of cards used to play the previous hand of the Baccarat game, the Baccarat shuffler 400 is configured to shuffle a sufficient number of cards to create the seven-card buffer. If the first round requires six cards to play, six more cards are shuffled to maintain the seven-card buffer for the next round; if the first round requires five cards to play, five more cards are shuffled to maintain the seven-card buffer for the next round and if the first round requires four cards to play, four more cards are shuffled to maintain the seven-card buffer for the next round. With the single face-up card plus number of burn cards equal to the top card value (Ace=1) burn card variation, the Baccarat shuffler 400 first randomly selects and forces eighteen cards against the dealing shoe face plate and then seven-card buffers for each subsequent round until a new fresh game shuffle. With the single face-up card plus number of burn cards equal to the top card value (Ace=11) burn card variation, the Baccarat shuffler 400 first randomly selects and forces nineteen cards against the dealing shoe face plate and then seven-card buffers for each subsequent round until a new fresh game shuffle. With the single face-up card plus number of burn cards equal to the top card value (ten value cards=0) burn card variation, the Baccarat shuffler 400 first randomly selects and forces seventeen cards against the dealing shoe face plate and then seven-card buffers for each subsequent round until a new fresh game shuffle.

Figure 19A:
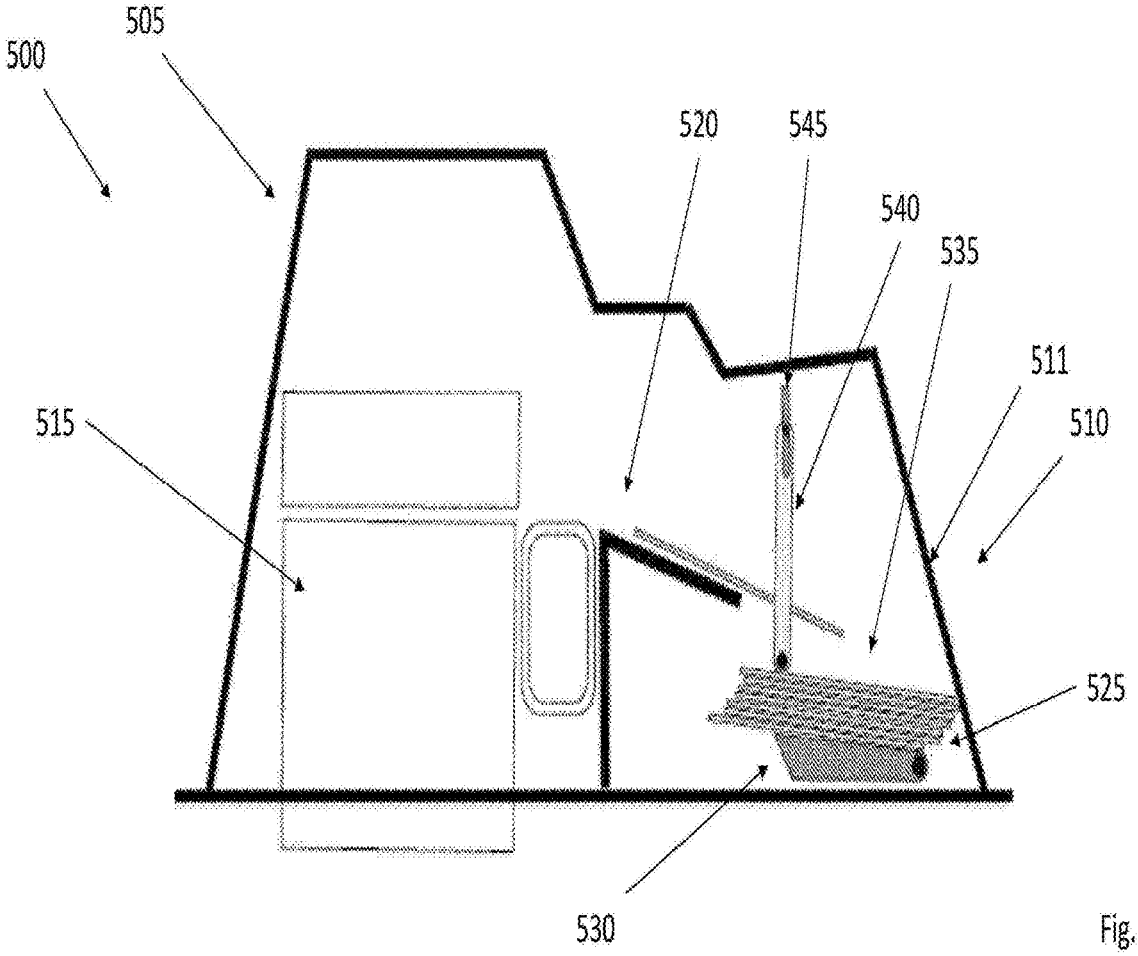
FIGS. 19A-19M illustrate a cross-sectional view of a first embodiment of a Baccarat shuffler and buffer apparatus according to the embodiments of the present invention.
Figure 19B:
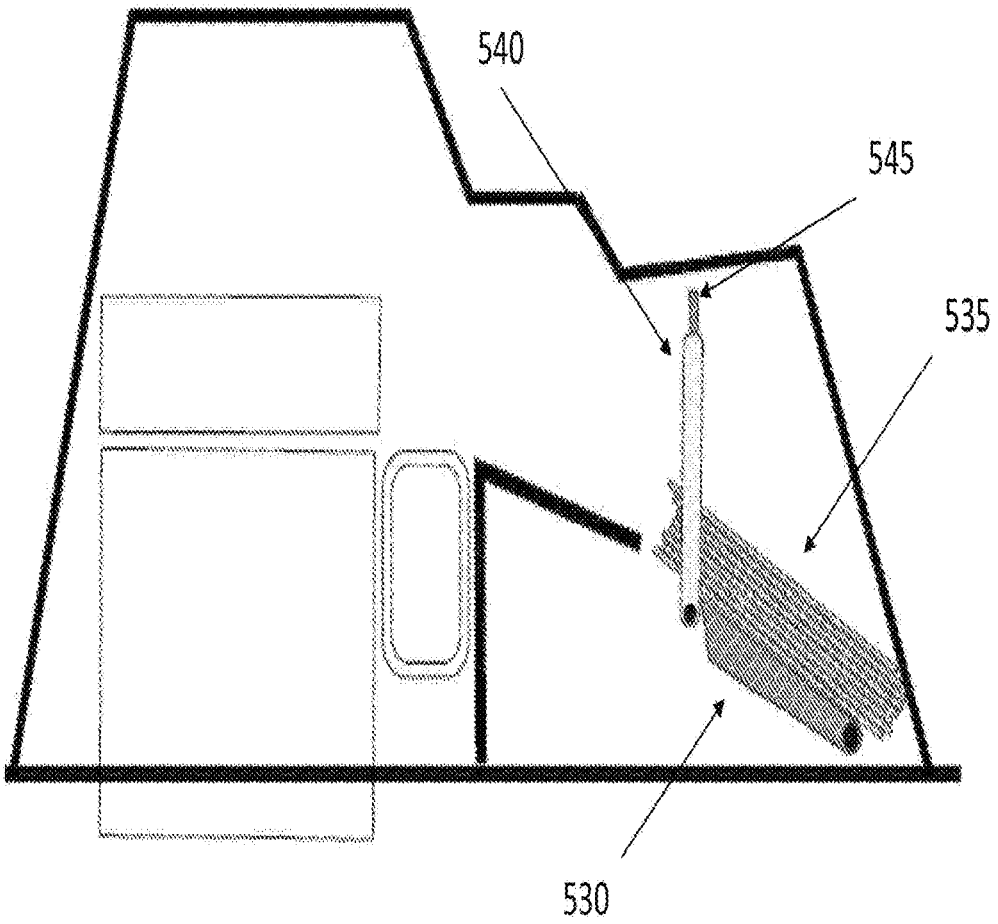
Figure 19C:
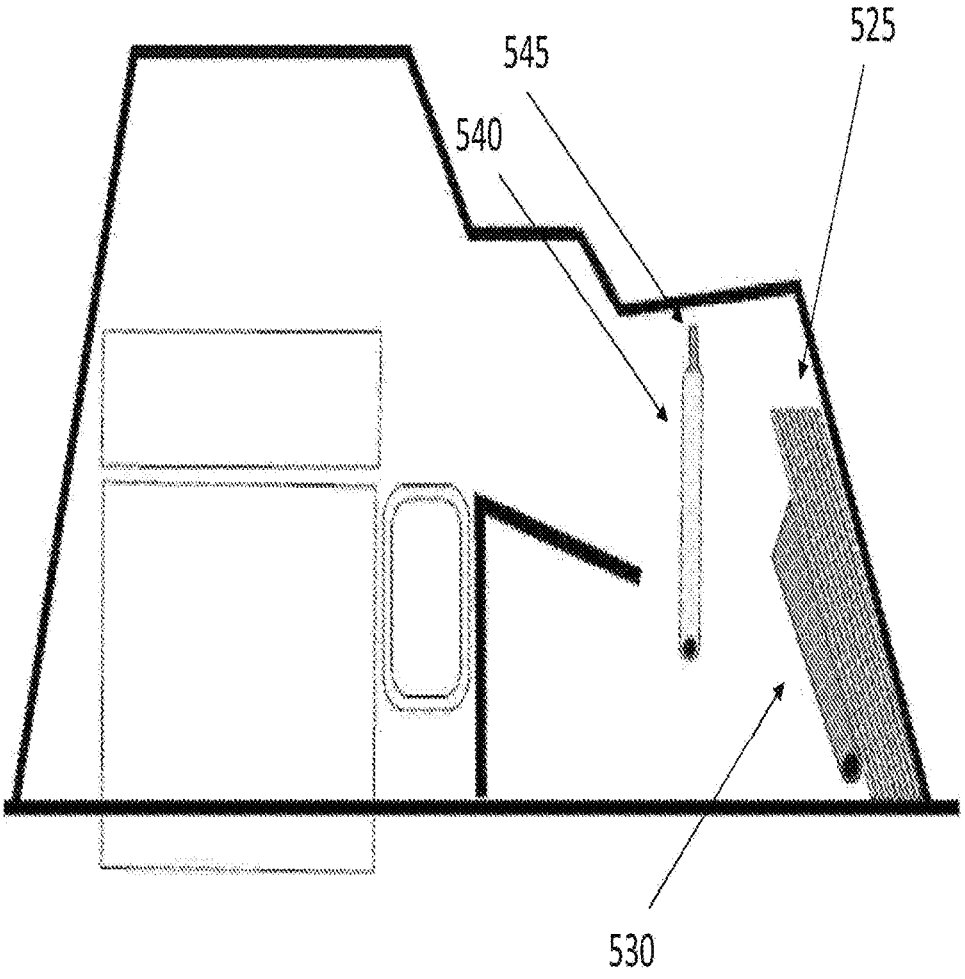
Figure 19D:
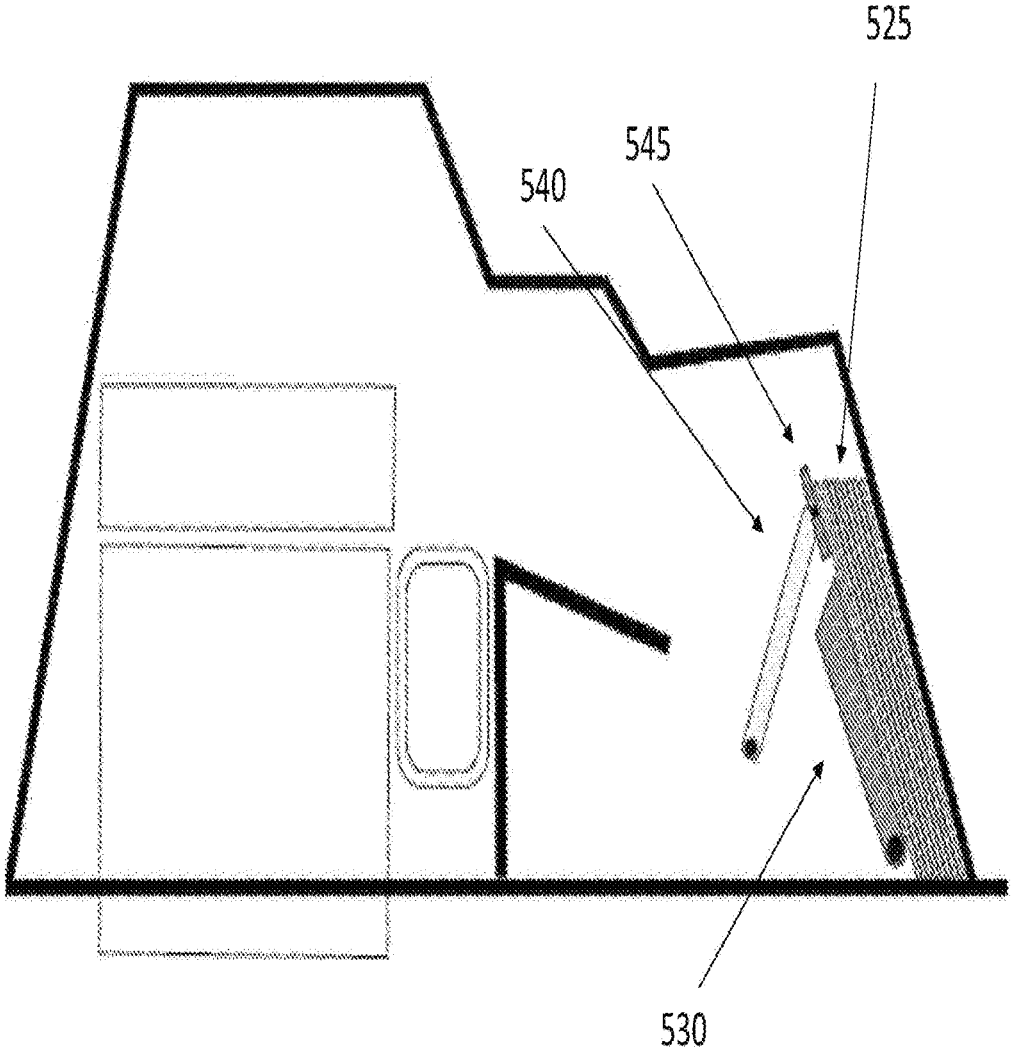
Figure 19E:
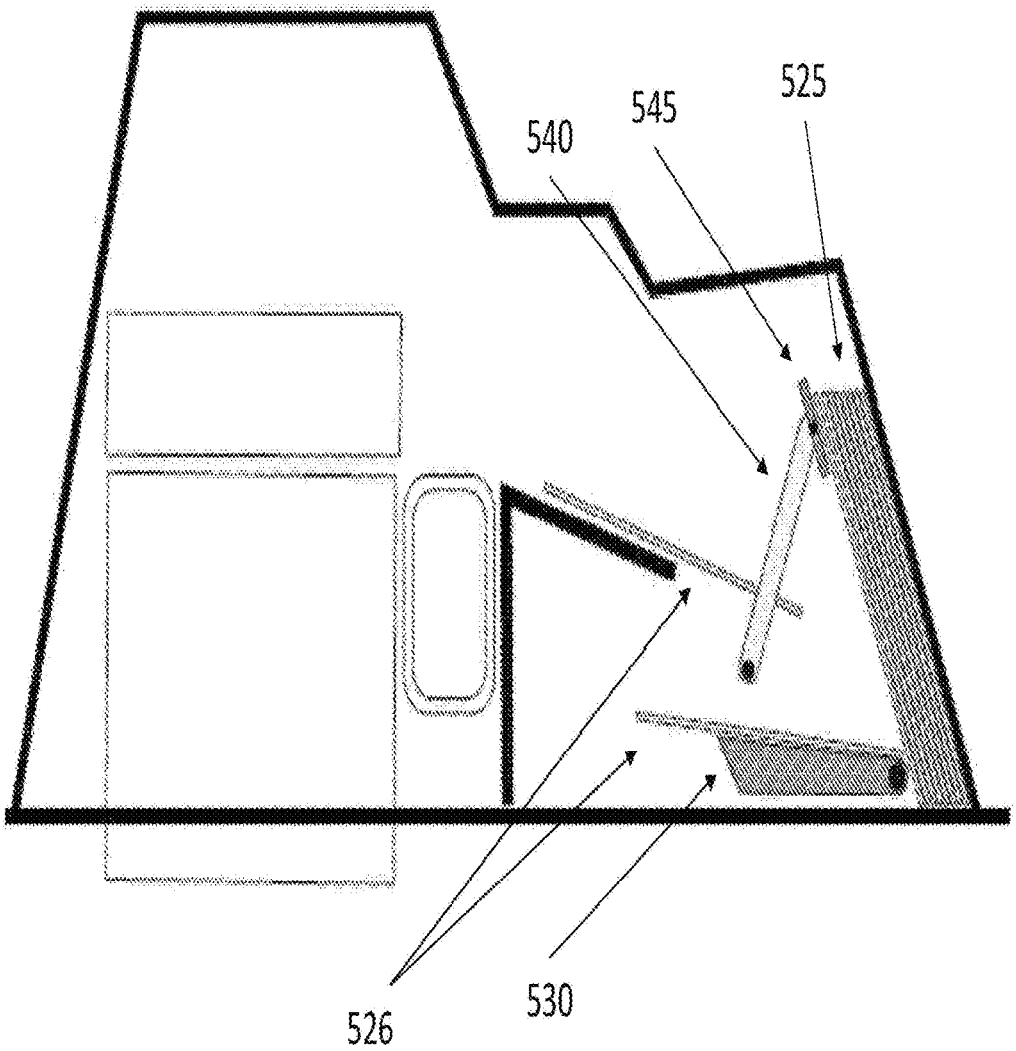
Figure 19F:
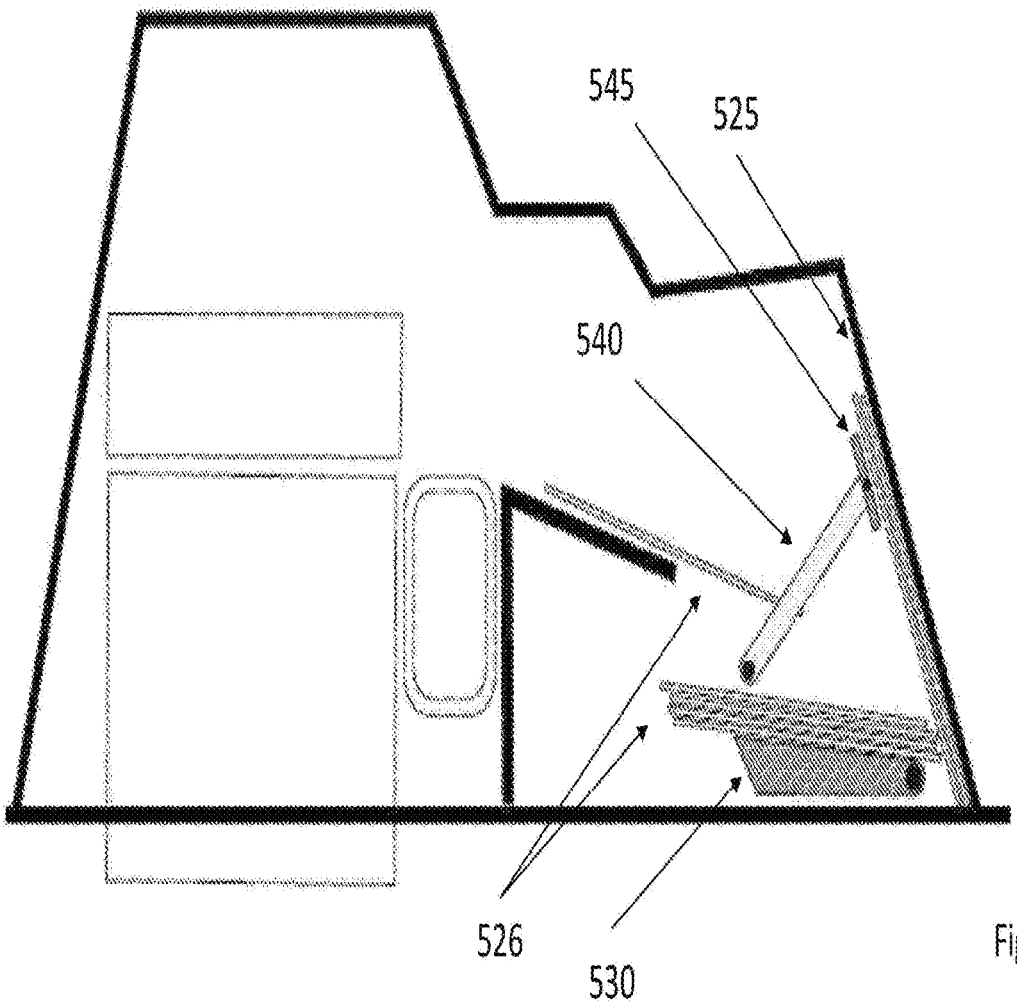
Figure 19G:
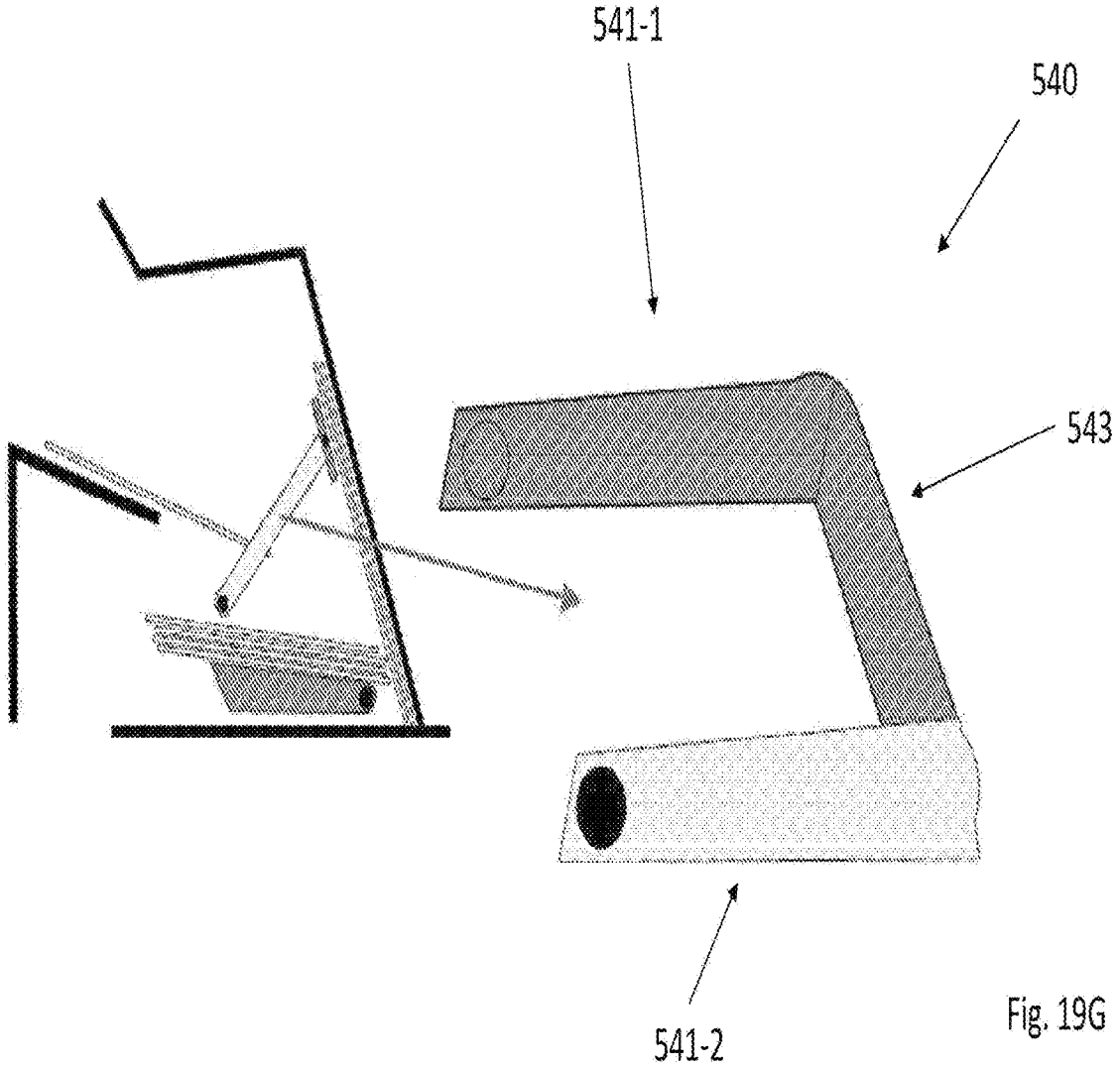

FIGS. 19A-19M show cross-sectional side views of a first embodiment of a Baccarat shuffler 500 having housing 505. The housing 505 includes an integral dealing shoe 510 providing access to the shuffled cards. From the sectional side view, only one shuffler device 515 is viewable as the second shuffler device is positioned behind. Card slides 520 (the other card slide is not visible as it is behind the visible card slide) direct the cards propelled by the two shuffler devices 515 into a common card-receiving area 525 and on to a card flipper 530. As best shown in FIGS. 19B and 19C, the card flipper 530 rotates roughly about one end thereof to force shuffled cards 535 in the card-receiving area 525 against a face plate 511 of integral dealing shoe 510. The card flipper 530 may be rotatably hinged to a bottom of the housing 505 or otherwise rotatably attached to the housing 505 (or other internal component) and serves as the floor of the card-receiving area 525. Responsive to sensor outputs, a stepper motor, servo or other electromechanical element drives the card flipper 530 to force the shuffled cards 535 against the face plate 511 and back to a home position in the card-receiving area 525 and the buffer-holder member 540 in a down position.

Figure 19H:
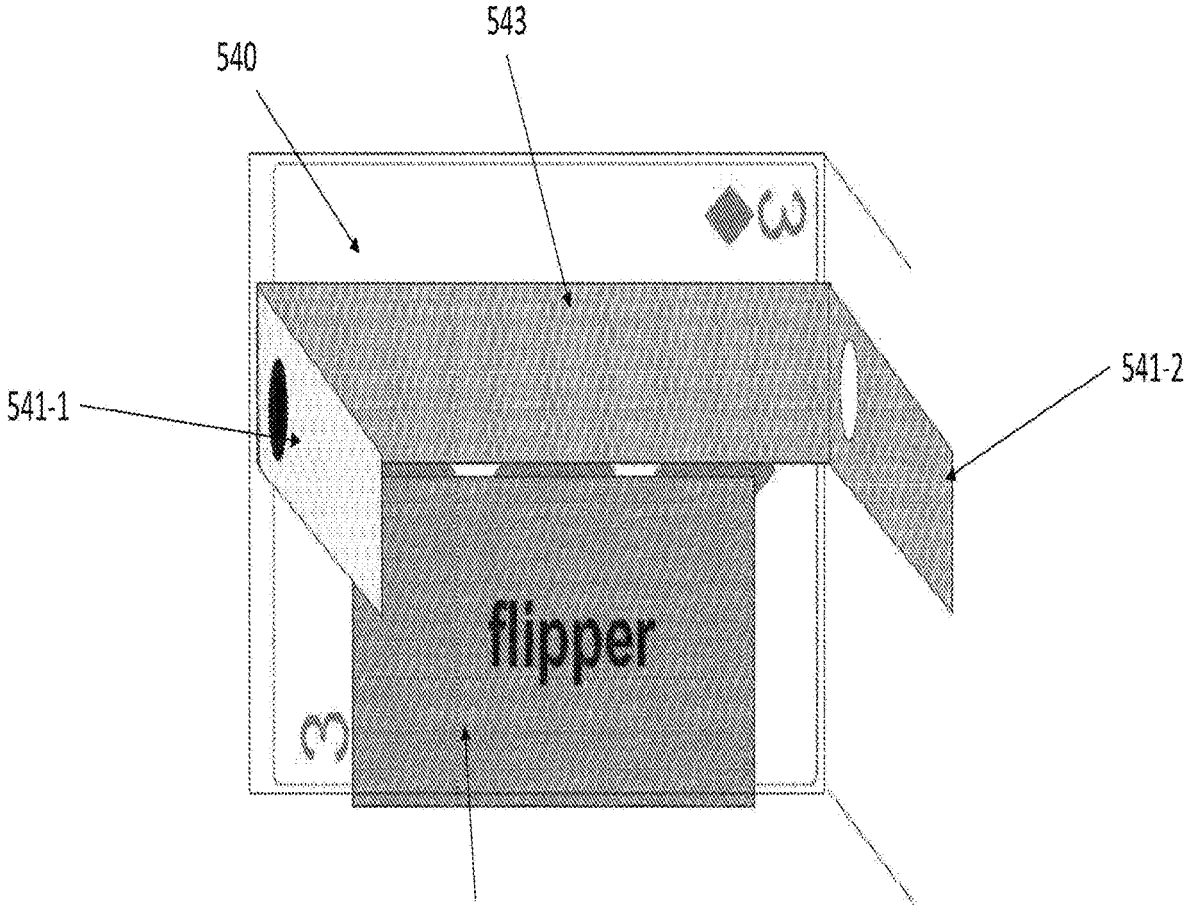
Figure 19I:
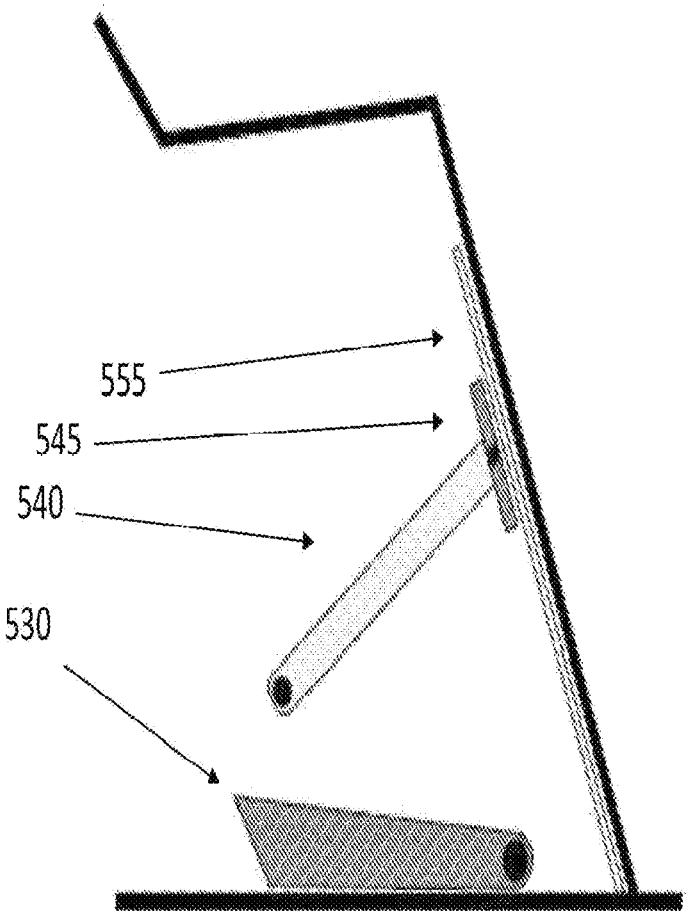
Figure 19J:
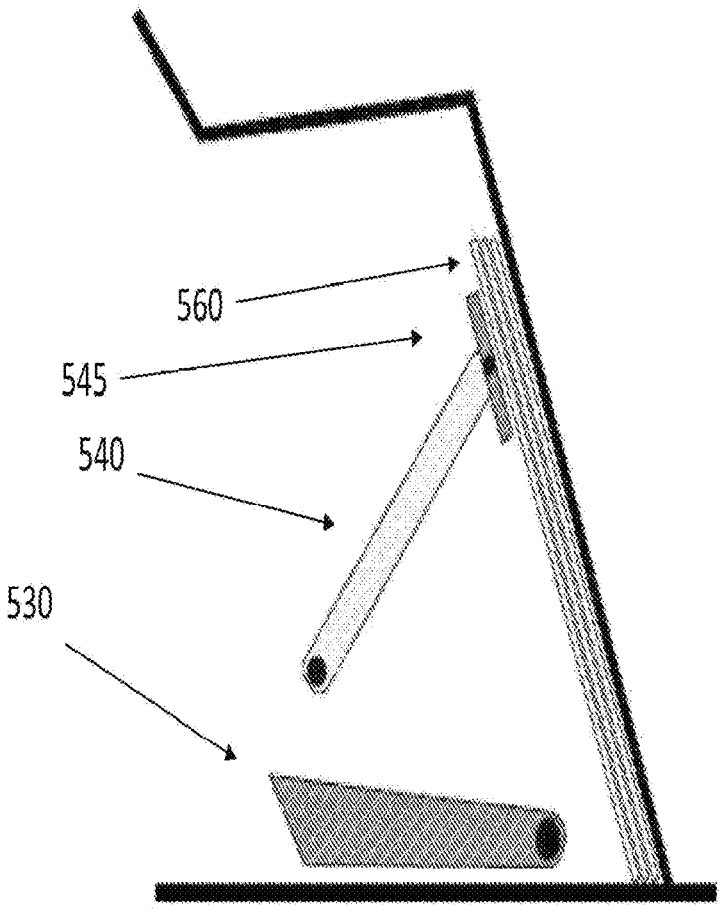
Figure 19K:
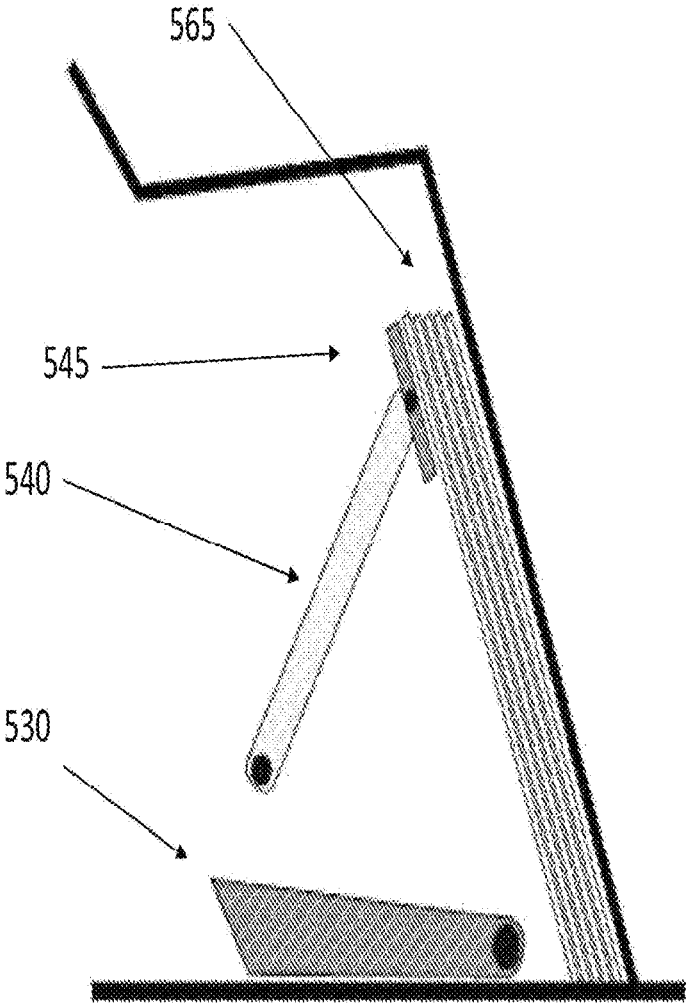
Figure 19L:
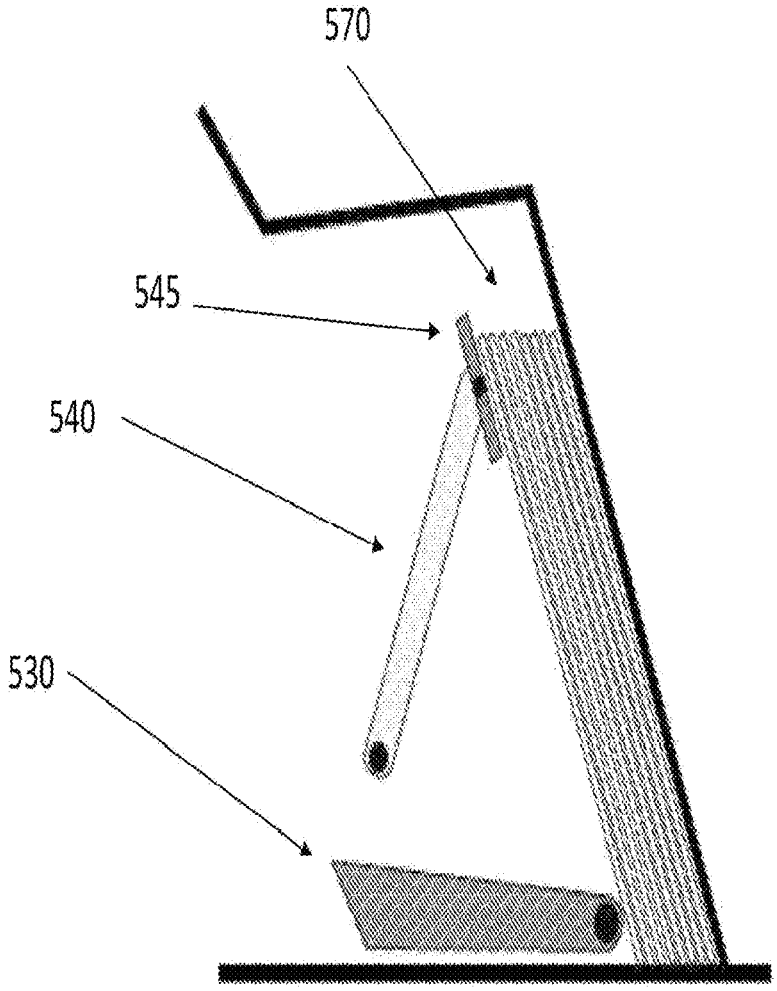
Figure 19M:
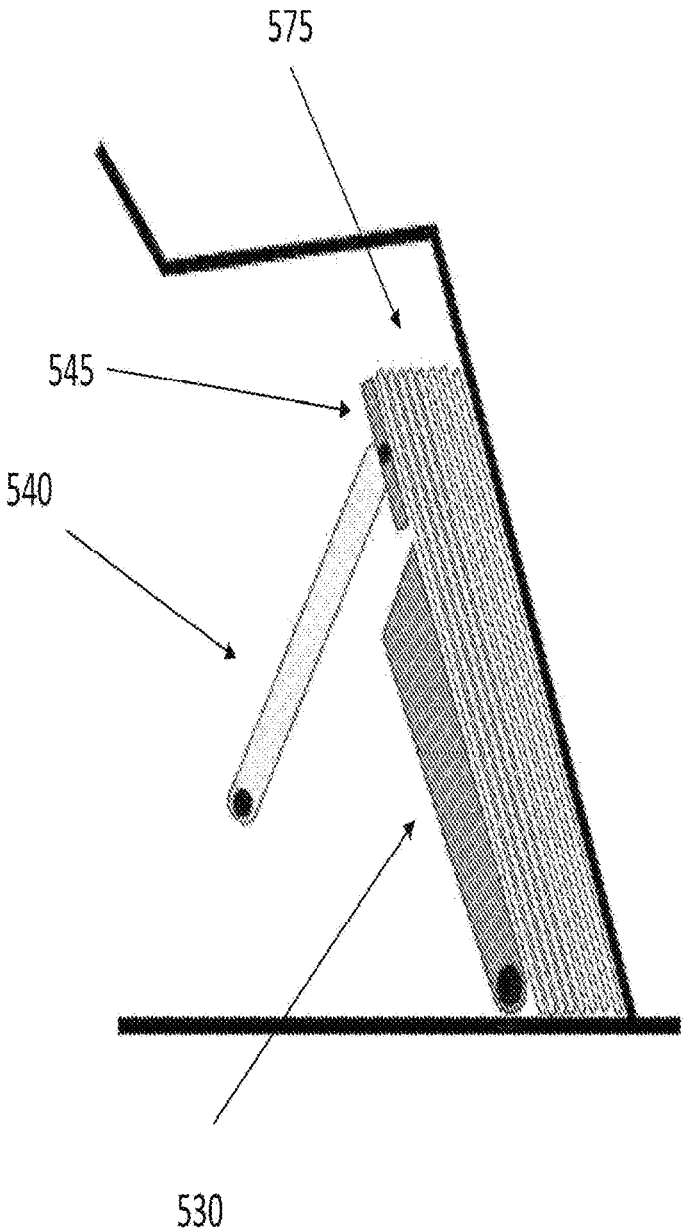

A buffer-holder member 540 is configured to maintain the shuffled cards 535 (a.k.a. buffer cards) against the face plate 511 once the card flipper 530 returns to the home position. Like the card flipper 530, the buffer-holder member 540 is rotatably attached to the housing 505 (or other internal component). In one embodiment, as best shown in 19G and 19H, the buffer-holder member 540 is U-shaped with two arms 541-1, 541-2 and a support 543 connecting the two arms 541-1, 541-2. A plate 545 may be attached to the support 543 to provide more contact area with the shuffled cards being maintained against the face plate 511. The plate 545 may have a soft covering to prevent damage to the buffer cards 535. Responsive to sensor outputs, a stepper motor, servo or other electromechanical element drives the buffer-holder member 540 to maintain the buffer cards 535 against the face plate 511 and back to a home position. FIGS. 19I through 19L show the buffer-holder member 540 maintaining a one-card buffer 555, three-card buffer 560, five-card buffer 565 and eight-card buffer 570. FIG. 19M shows an eight-card buffer 575 with the card flipper 530 in an upper position.

The buffer-holder member 540 and card flipper 530 operate in concert to move shuffled cards against the face plate 511 and maintain the shuffled cards against the face plate 511. Referring to FIGS. 19A through 19F show operation of the Baccarat shuffler 500. In FIG. 19A, cards have been randomly selected and propelled into the card-receiving area 525 on to the card flipper 530; in FIG. 19B, once eight cards have been propelled into the card-receiving area 525, the card flipper 530 begins rotating; in FIG. 19C, the card flipper 530 forces the eight cards against the face plate 511; in FIG. 19D, once the card flipper 530 has forced the cards against the face plate 511, the buffer-holder member 540 rotates into place against the eight buffer cards 535 (FIG. 19H shows another view of the buffer-holder member 540 against the buffer cards 535); in FIG. 19E, the card flipper 530 returns to a home position and the shuffler devices 515 begin randomly selecting and propelling cards 526 into the card-receiving area 525 and on to the card flipper 530; and in FIG. 19F, the card flipper 530 remains in the home position while the shuffler devices 515 continue randomly selecting and propelling cards into the card-receiving area 525 and on to the card flipper 530 while the buffer cards 535 are being dealt to players. The buffer-holder member 540 moves to a home position when the next group of cards is ready to be acted upon by the card flipper 530.

FIGS. 20A-20F show a cross-sectional side views of a second embodiment of a Baccarat shuffler 600 and housing 605 according to the embodiments of the present invention.

The primary difference between Baccarat shuffler 500 and Baccarat shuffler 600 is the mechanism for maintaining the buffer cards against a face plate 625 of a dealing shoe 630. In this instance, an upper card stop 610 works in concert with lower card flipper 615. The lower card flipper 615 forces buffer cards 620 against the face plate 625 of the dealing shoe 630 and upper card stop 610 maintains the buffer cards 620 against the face plate 625 allowing the lower card flipper 615 to return to a home position for new shuffled cards. Card slides 635 (only one is visible) guide cards to the lower card flipper 615 when propelled from the shuffler devices 612 (only one is visible).

Figure 20A:
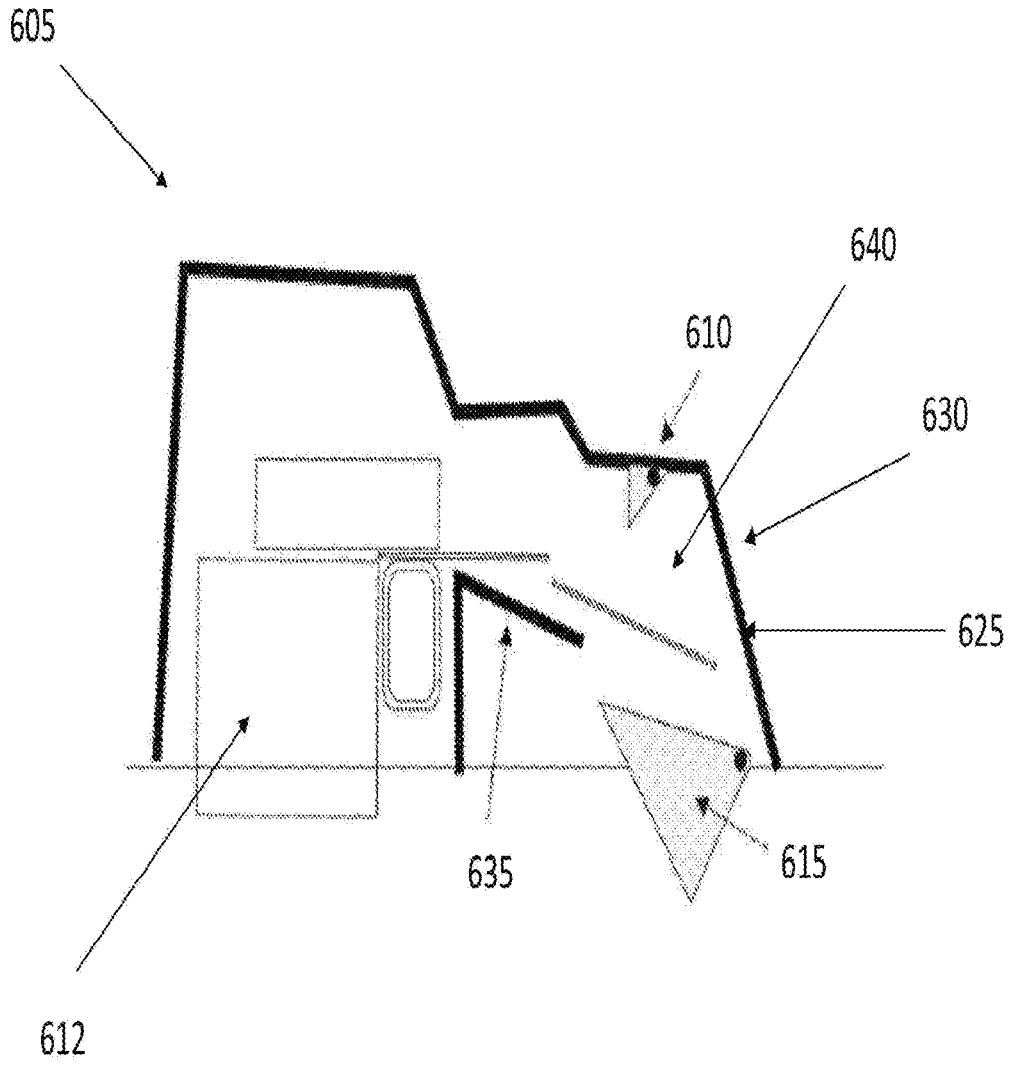
FIGS. 20A-20F illustrate a cross-sectional view of a second embodiment of a Baccarat shuffler and buffer apparatus according to the embodiments of the present invention.
Figure 20B:
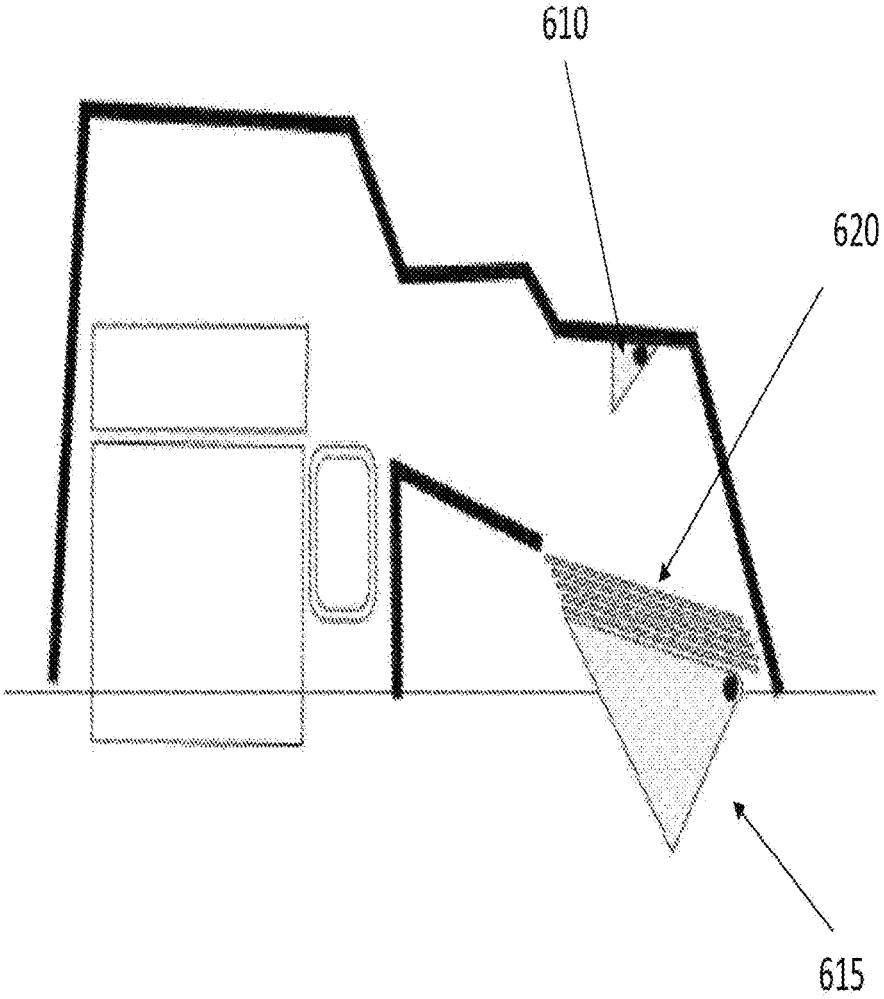
Figure 20C:
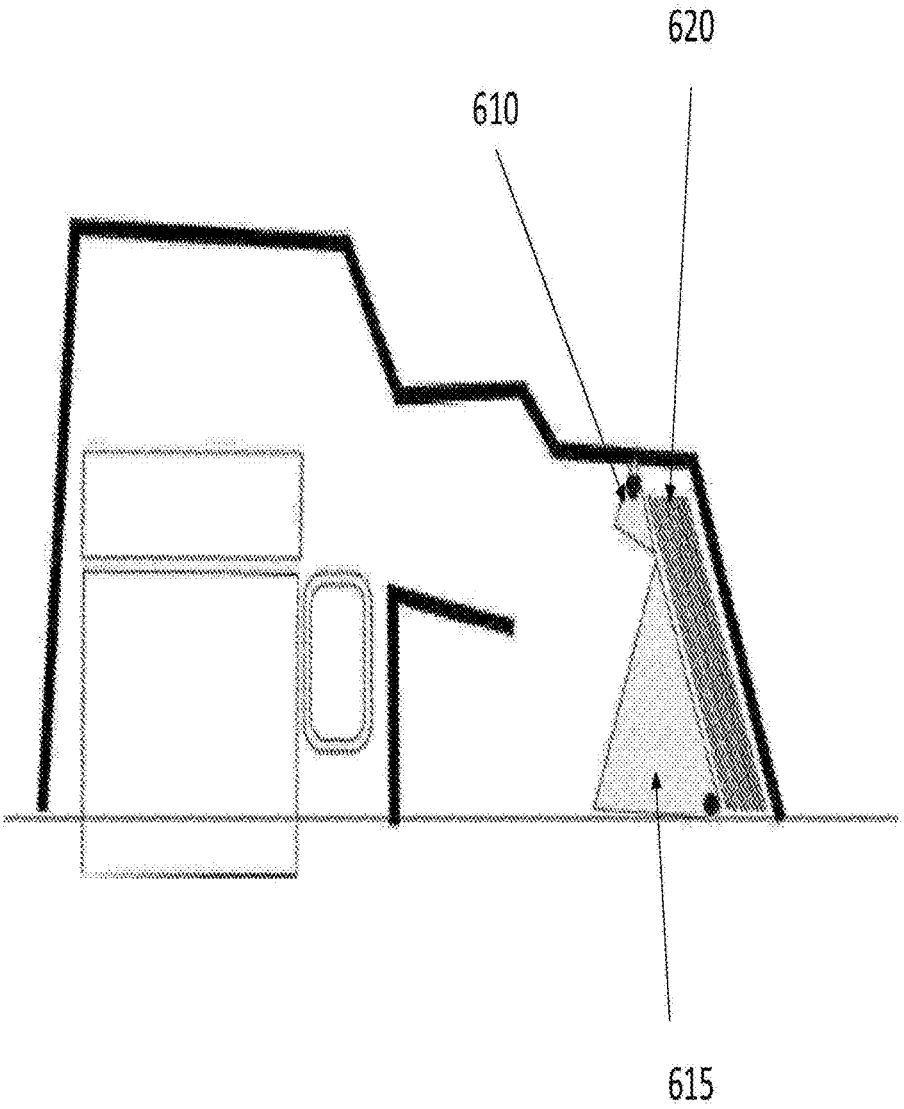
Figure 20D:
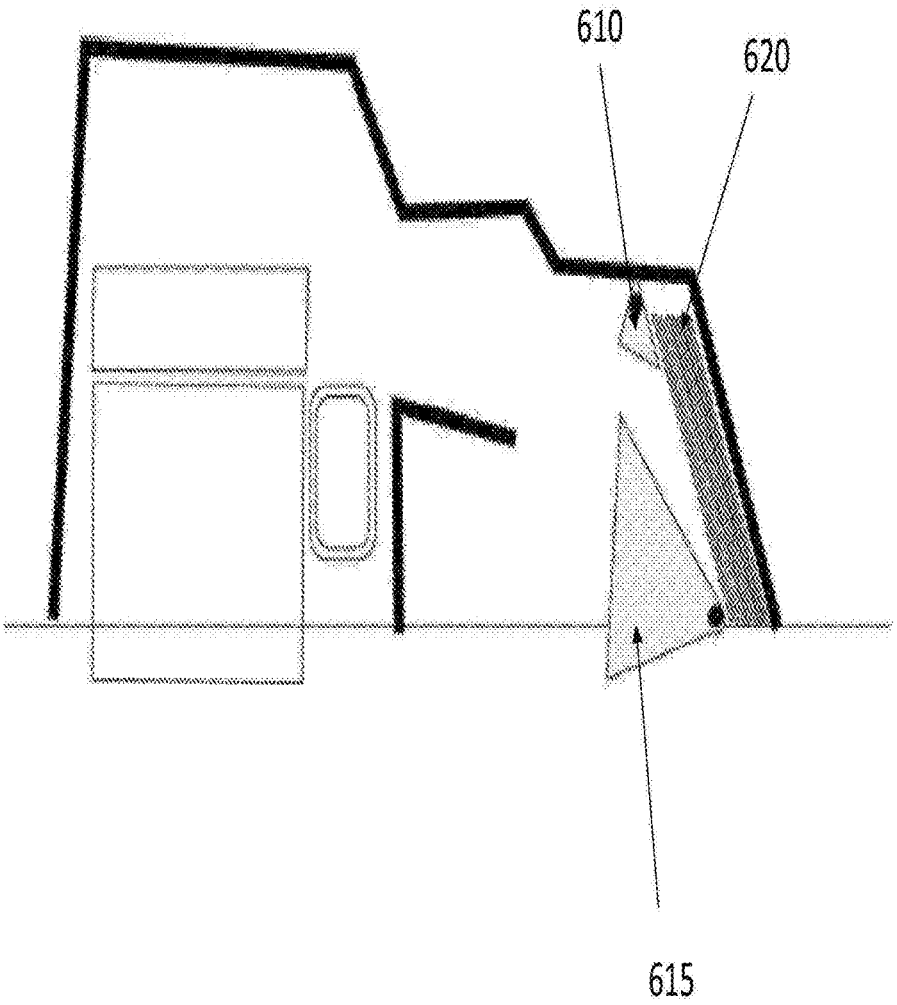
Figure 20E:
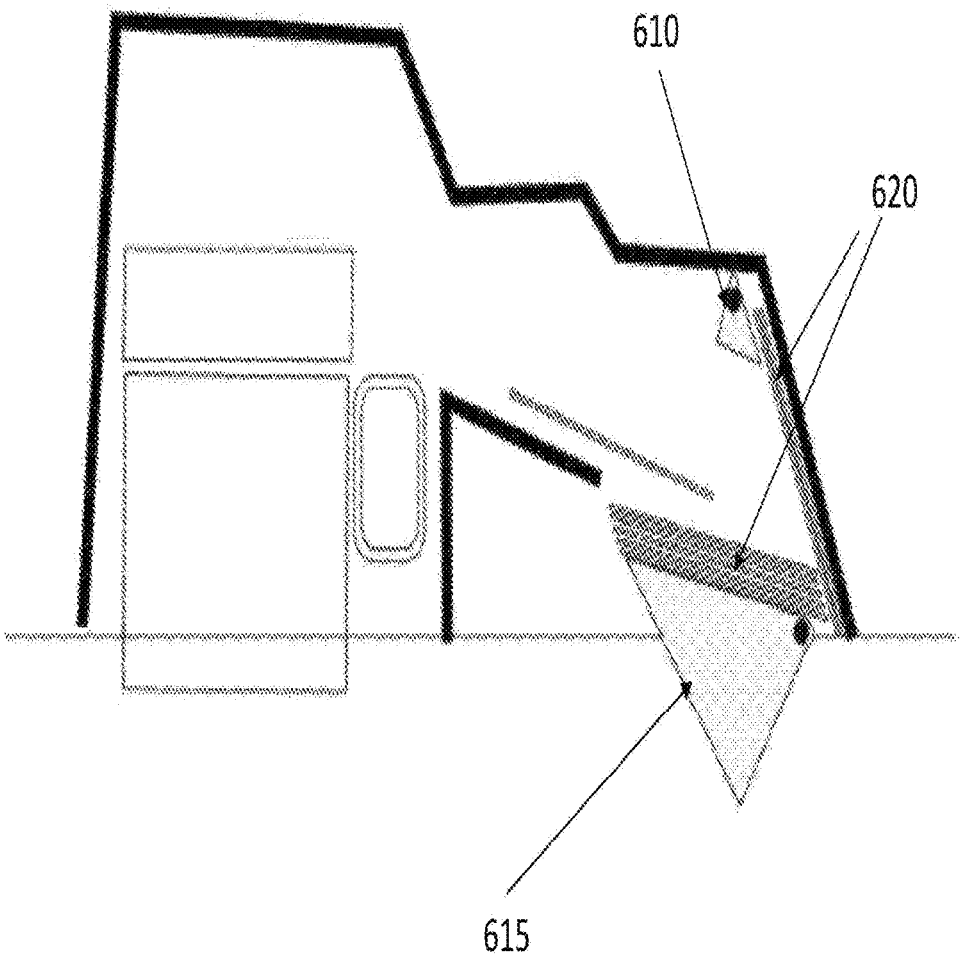
Figure 20F:
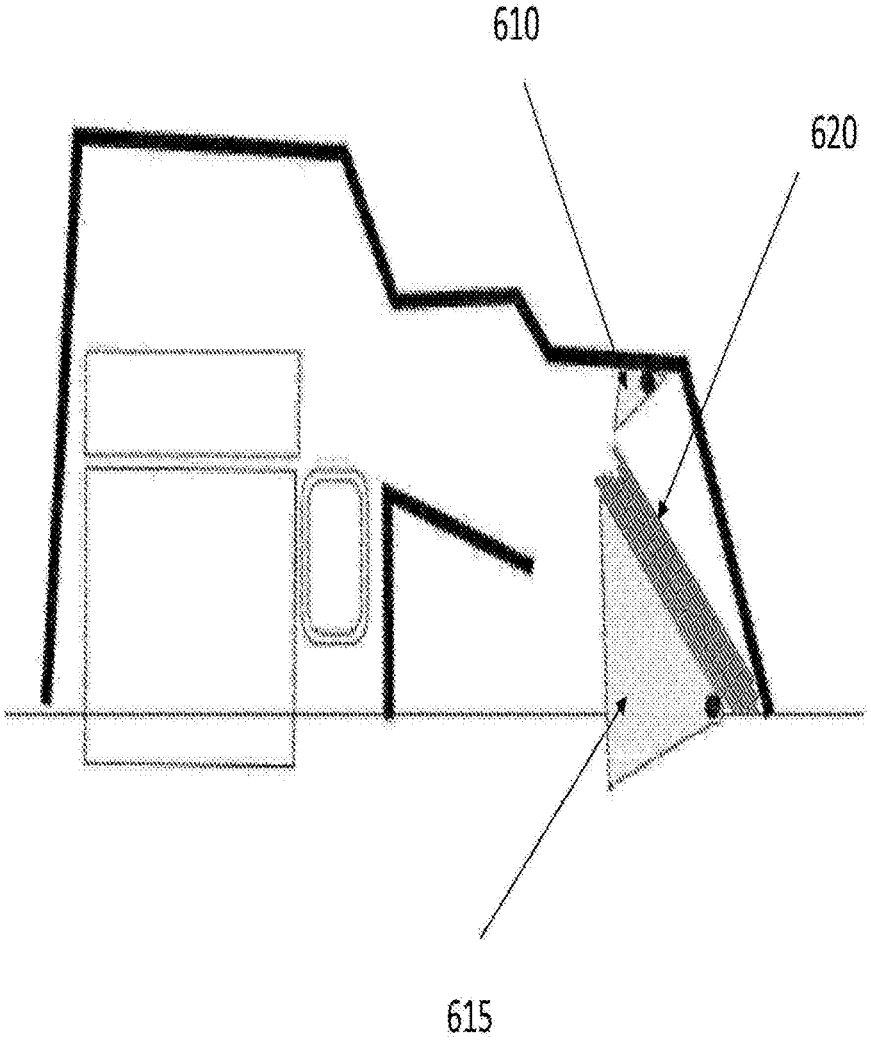

In FIG. 20A, cards have been randomly selected and propelled into the card-receiving area 630 and on to the lower card flipper 615; in FIG. 20B, once eight cards have been propelled into the card-receiving area 640, the lower card flipper 615 begins rotating; in FIG. 20C, the lower card flipper 615 forces the eight cards against the face plate 625; in FIG. 20D, once the lower card flipper 615 has forced the buffer cards 620 against the face plate 625, the upper card stop 610 rotates into place against the eight buffer cards 620; in FIG. 20E, the lower card flipper 615 returns to a home position and the shuffler devices begin randomly selecting and propelling cards into the card-receiving area 640 and on to the lower card flipper 615; and in FIG. 20F, the lower card flipper 615 remains in the home position while the shuffler devices continue randomly selecting and propelling cards into the card-receiving area 630 and on to the lower card flipper 615 while the buffer cards 620 are being dealt to players. The upper card stop 610 moves to a home position when the next group of cards is ready to be acted upon by the lower card flipper 615.

Sensors in or near the card-receiving area and integral dealing shoe provide the necessary outputs for controlling dealing operations, including movement of the card flipper 530 and buffer-holder member 540, of the Baccarat shufflers 500, 600. The sensors detect the number of cards propelled from the shuffler devices as well as number of cards removed from the dealing shoe. The collected sensor data or outputs is used by the processor to control the card flipper and buffer-holder member.

Figure 21:
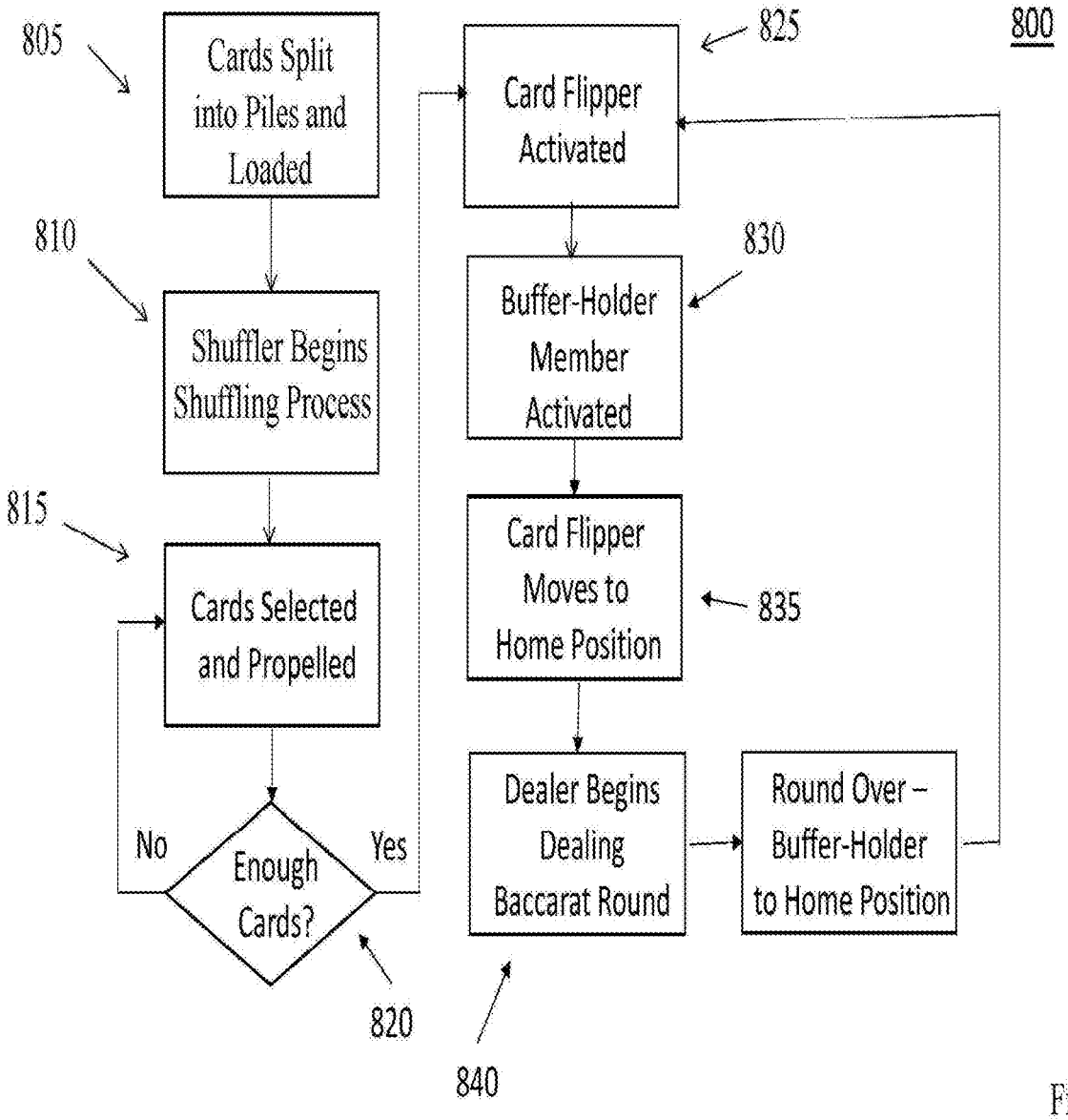
FIG. 21 illustrates a flow chart detailing operation of the Baccarat shuffler according to the embodiments of the present invention.

FIG. 21 shows a flow chart 800 detailing one methodology of operating a Baccarat shuffler according to the embodiments of the present invention. At 805, cards are split into two piles and loaded into the pre-shuffle bins of the two shuffler devices. At 810, the Baccarat shuffler is instructed to shuffle. At 815, the two shuffler devices randomly select cards and propel them toward the card slides and on to the card flipper in the card-receiving area. At 820, it is determined if a sufficient number of buffer cards (e.g., eight) have been propelled to the card flipper. If so, at 825, the card flipper activates to force the cards into the face plate of the integral dealing shoe. At 830, a buffer-holder member or similar mechanical device activates to maintain the buffer cards against the face plate of the dealing shoe. At 835, the card flipper moves to a home position and the flow chart 800 loops back to 815. At 840, the dealer begins dealing a round of Baccarat. At 845, the Baccarat round ends and the buffer-holder returns to a home position. The flow chart 800 loops back to 825 as cards have been propelled to the card-receiving area and on to the card flipper as the round was being dealt. This process allows the Baccarat game to proceed very quickly compared to other shufflers.

Figure 17A:
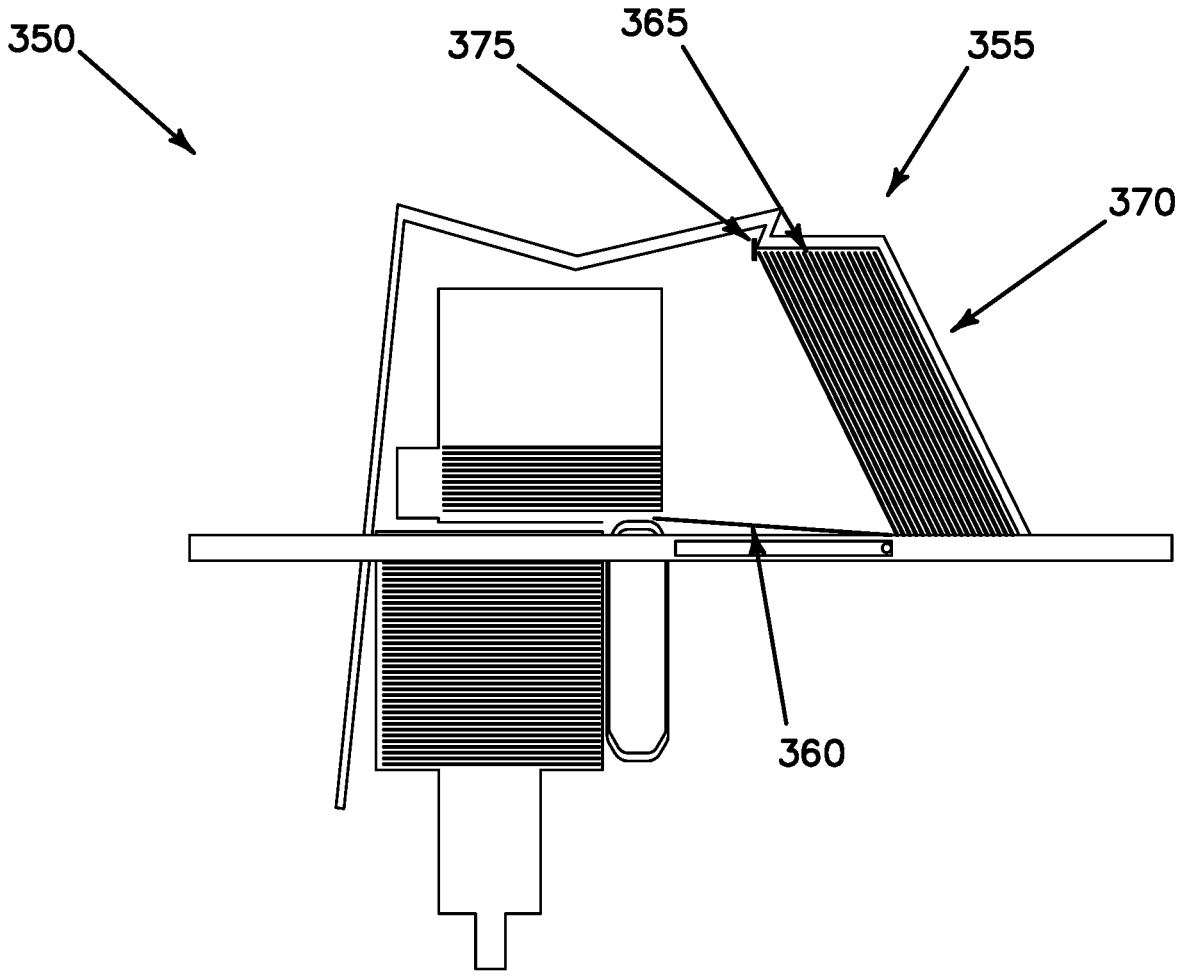
FIGS. 17A-17C illustrate a continuous shuffler according to the embodiments of the present invention.
Figure 17B:
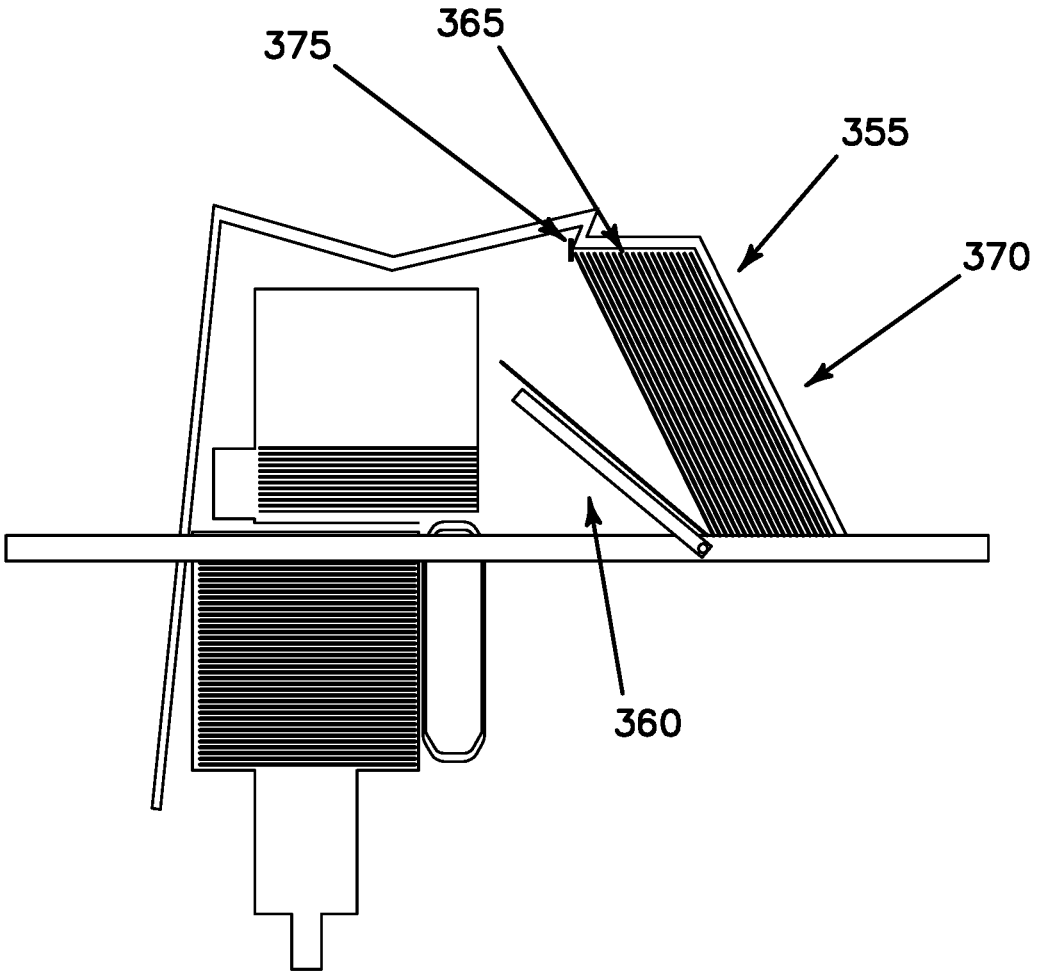
Figure 17C:
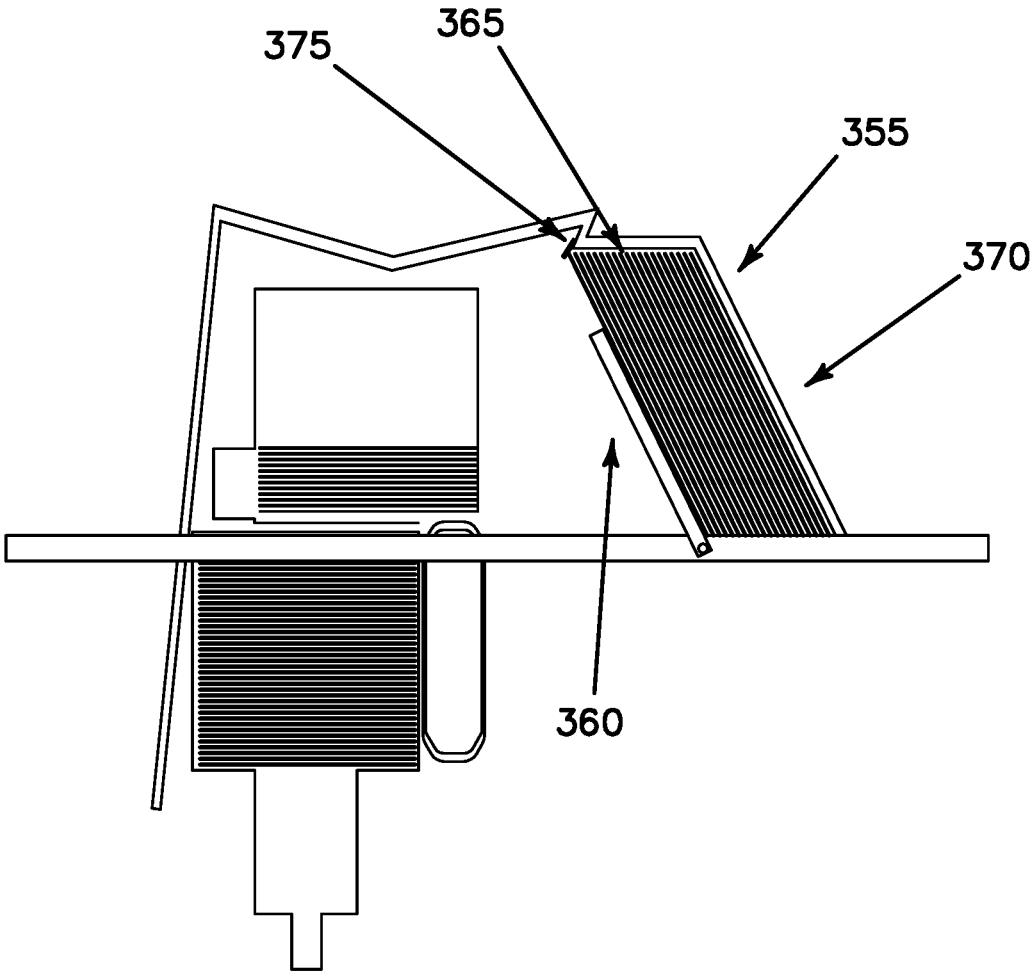

In another embodiment, the shuffler technology is used in a continuous shuffler 350 as shown in FIGS. 17A-17C. For example, in a six-deck dealing shoe, starting the continuous process comprises the random number generator selects a position from 1-312 and moves the corresponding card forward to the front of a dealing shoe 355 and then selects a card from 1-311 and moves the corresponding card forward to the front of the dealing shoe 355 and so on. After are-established number of cards (e.g., 13) have been moved forward in the dealing shoe 355, discards can be placed into a pre-shuffle bin with the remaining cards. A lever (or flipper) 360 is configured to lift randomly-selected cards 365 against a dealing shoe face plate 370 for dealer access. A clip 375 or other mechanism may hold the cards 365 against the face plate 370 while the lever 360 drops back down to a horizontal position to receive more cards. This process can continue indefinitely resulting in continuous shuffled group of cards in the dealing shoe 355.

Figure 22:
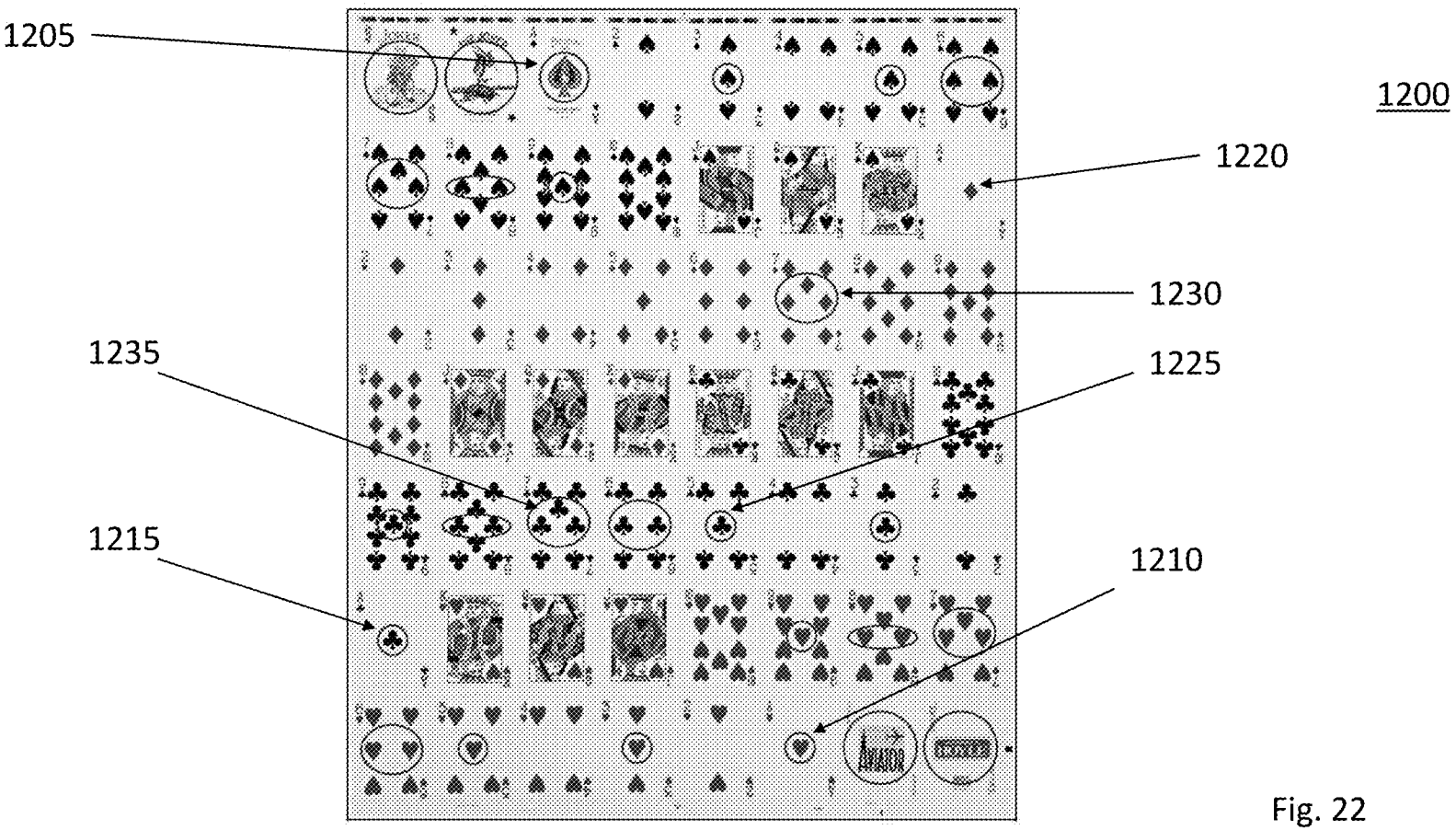
FIG. 22 illustrates a prior art sheet of playing cards.

FIG. 22 illustrates a prior art sheet of playing cards 1200 with certain portions highlighted representing markings or information which permit a top or upper edge of the playing cards to be identified. For example, the orientation of the single Spade 1205 on the Ace of Spades allows the top (orientation) of the playing card to be identified. That is, the faces of the cards are asymmetric. The single Heart 1210 and Club 1215 on the Ace of Hearts and Ace of Clubs, respectively, also allow the top (orientation) of each playing card to be identified. To the contrary, the symmetric Diamond 1220 on the Ace of Diamonds does not serve to indicate a top of the playing card. The center pip or arrangement of pips of various other cards serve to indicate a top of the playing cards. For example, the orientation of the center Club 1225 of the Five of Clubs serves to indicate the top (orientation) of the playing card. Similarly, the orientation of the three center Diamonds 1230 and three center Clubs 1235 serve to indicate the top (orientation) of the Seven of Diamonds and Seven of Clubs, respectively. Twenty-two cards of the fifty-two cards in a standard deck of playing cards have a pip or arrangement of pips which allow a top (orientation) of the subject playing card to be identified. The other thirty playing cards in a standard deck of playing cards are symmetric and do not have an identifiable top.

Certain embodiments of the present invention include a modified deck of playing cards whereby the top of each of the fifty-two playing cards can be identified. The modified deck of playing cards includes the inclusion of new information (e.g., markings, relative position of card face information, etc.) on the face of the cards. The new information may take many forms but tend to fall into three groups comprising (i) independent, foreign marks including ultraviolet (UV) and infrared (IR) marks (naked to the eye); (ii) modifications to the card value, corner pip or regular pip and (iii) modifications to the position of the card value, corner pip or regular pip. Other marks, such as barcodes, magnetic encoding and machine readable code, may be utilized as well to identify card orientation.

While this detailed description focuses on marks on the card faces, in other embodiments the markings (whether visible or invisible) may be on the card backs or card sides. Regardless of position, the purpose of the information (e.g., marks) is to identify card orientation.

Figure 23:
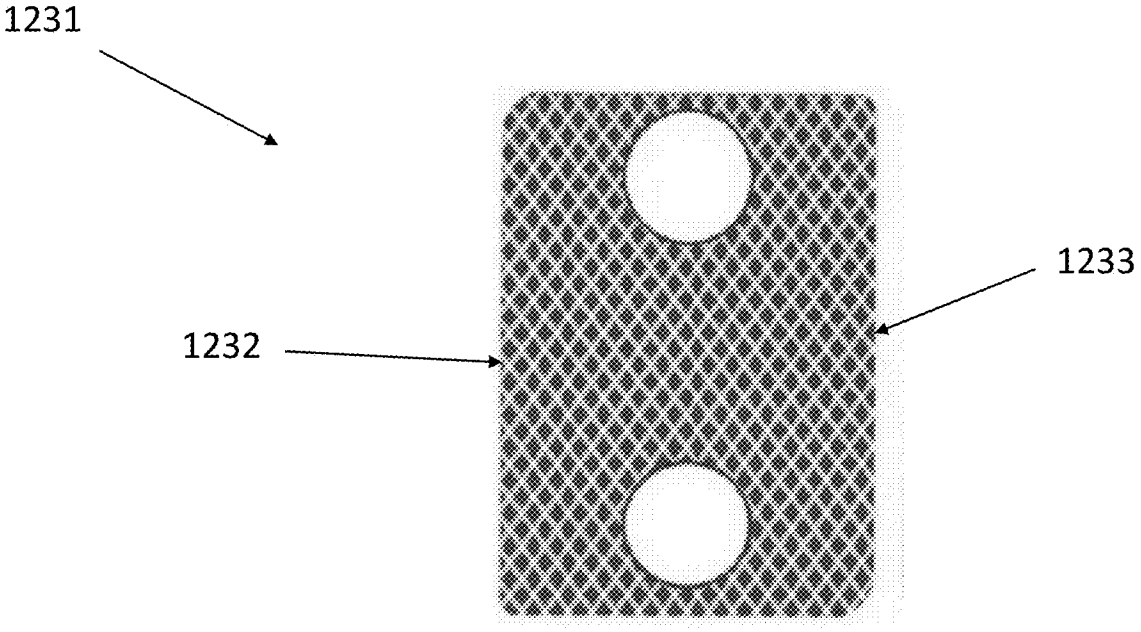
FIG. 23 illustrates playing cards subject to edge sorting and cheating.

FIG. 23 shows an example of standard playing card 1231 with asymmetries rendering the card 1231 subject to edge sorting. The asymmetries in this instance are the sizes of the diamonds 1232 running along the left edge compared to the sizes of the diamonds 1233 running along the right edge. Specifically, diamonds 1232 are smaller than diamonds 1233. The practice of edge sorting involves players and/or casino personnel arranging the orientation of the cards to take advantage of the asymmetries.

Figure 24:
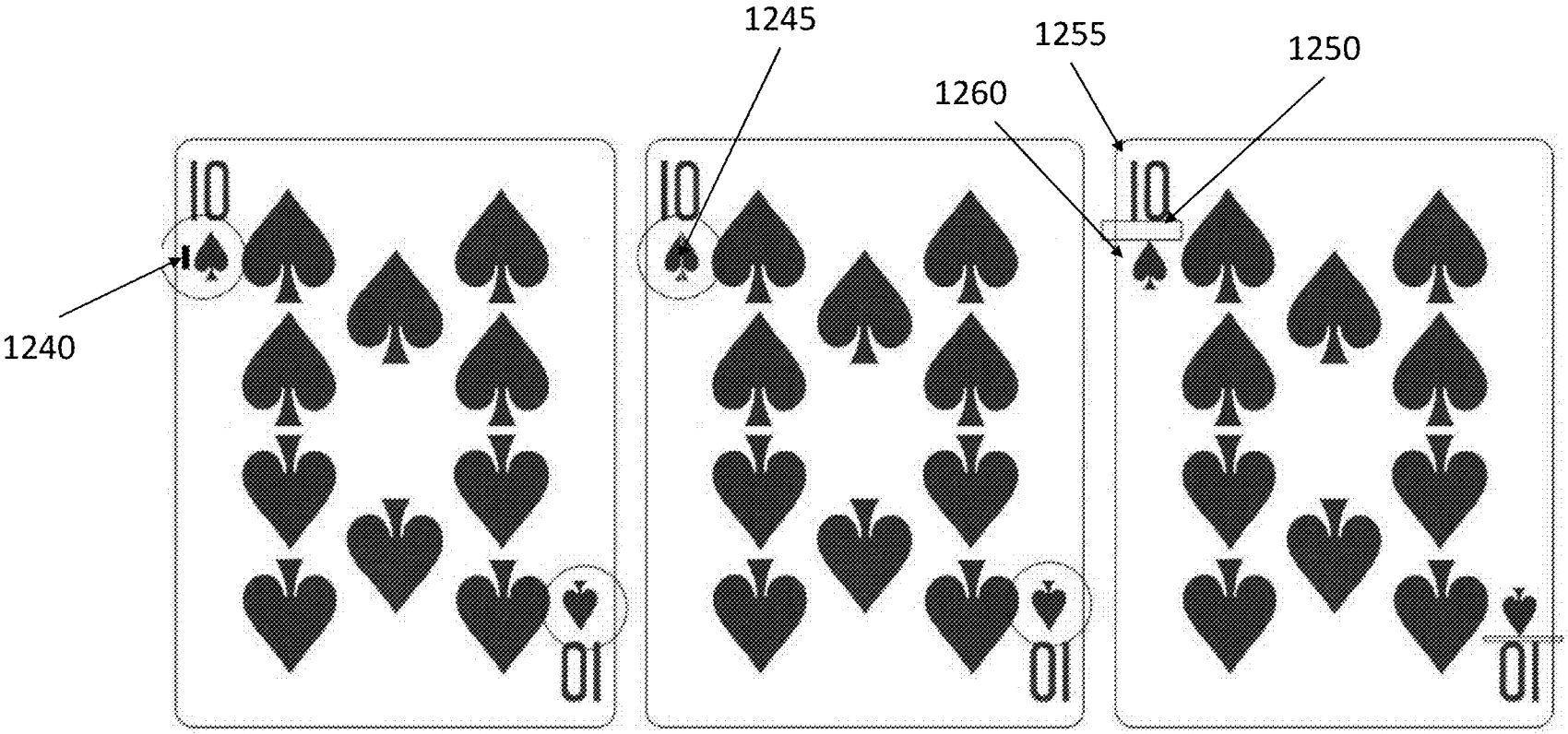
FIG. 24 illustrates exemplary modified playing cards according to the embodiments of the present invention.
Figure 25:
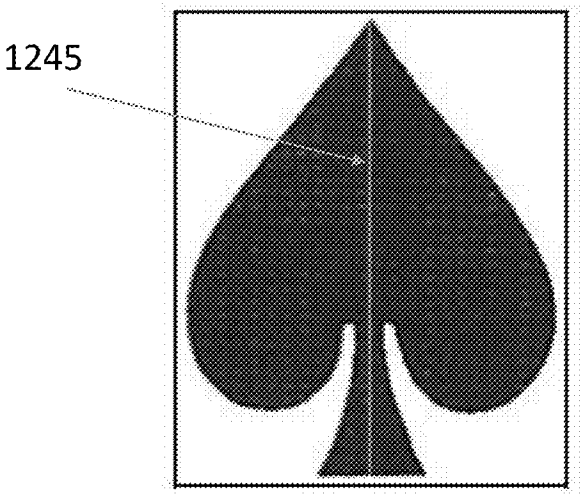
FIG. 25 illustrates exemplary modified playing card pip according to the embodiments of the present invention.
Figure 26:
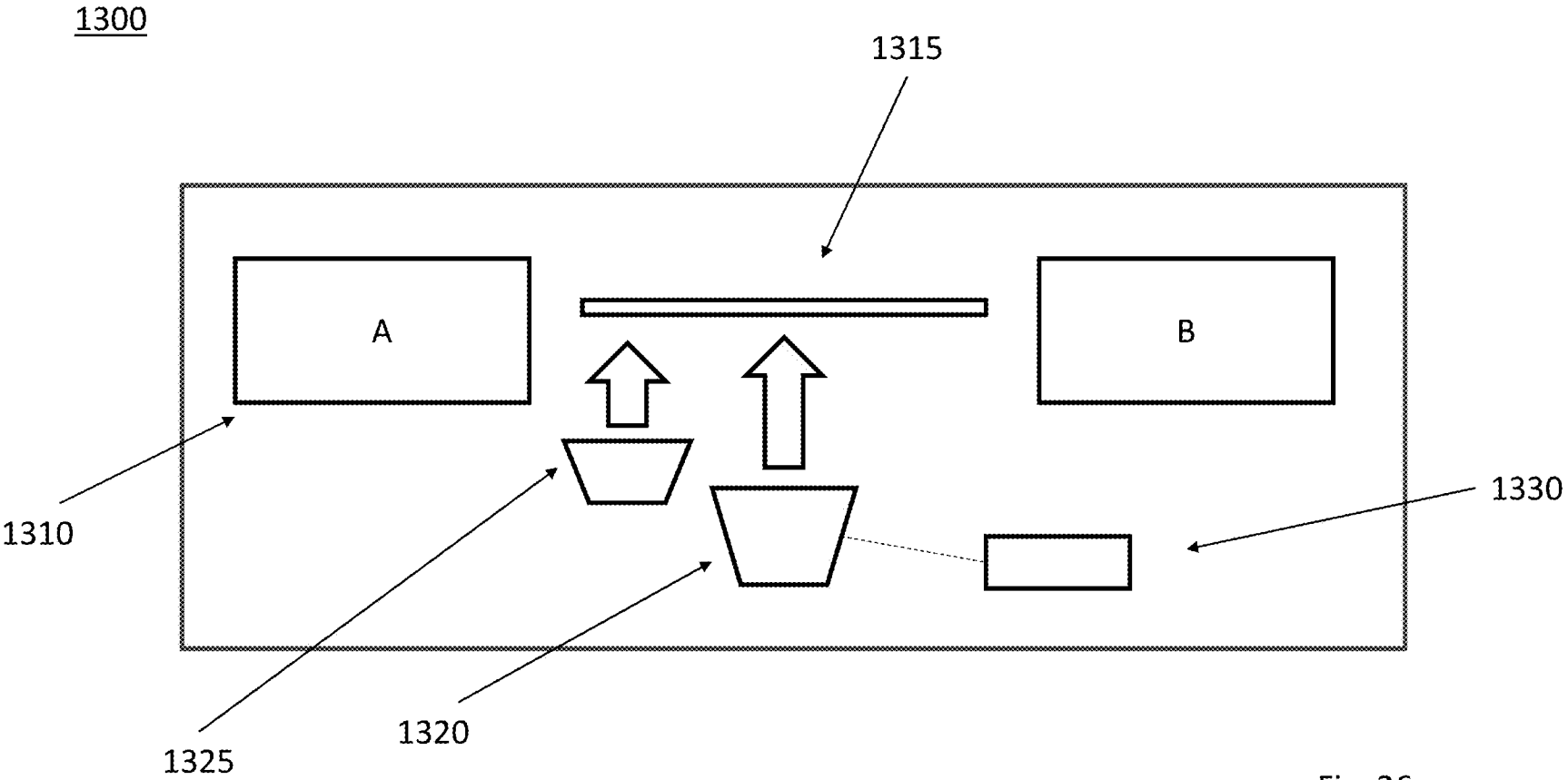
FIG. 26 illustrates a block diagram of an automatic playing card shuffler configured to read modified playing cards according to the embodiments of the present invention.

FIG. 24 shows various modifications to a conventional Ten of Spades. A first modification involves the addition of a foreign mark 1240 on one end of the playing card only. A second modification involves the inclusion of a thin white vertical line 1245 through one of the corner pips. FIG. 25 shows a close-up of the thin vertical white line 1245 through the corner pip. Depending on a sensitivity of the automatic playing card shuffler, the vertical line 1245 may be extremely thin so as not to be noticeable to most players. A third modification involves changing the distance 1250 between one card value 1255 and associated pip 1260. The various modifications can be used in combination as well such that certain playing cards in the deck may use the vertical line and certain other playing cards may use the foreign mark. As shown, each modification is inserted near the would-be top of the playing card. Those skilled in the art will recognize that other modifications may be made to a standard deck of playing cards to facilitate the embodiments of the present invention. Indeed, any modification to the face (or edges or back) of the playing cards to identify a top of the playing cards (or a bottom) may be used.

Depending on the embodiment, the modifications identified in FIG. 24 and any others may be placed on all fifty-two playing in a standard deck of playing cards (fifty-four including Jokers) or just the thirty playing cards that are symmetric without any orientation-defining features.

In combination with the modified deck of playing cards is an automatic playing card shuffler configured to read the modifications and identify playing card orientations. If the modifications are used on just thirty playing cards without any orientation-defining features, the automatic playing card shuffler is also configured to identify the orientation of the remaining twenty-two playing cards via the integral orientation-defining features discussed above and shown in FIG. 22.

Advantageously, most if not all automatic card shufflers, including those detailed herein can be used to practice the embodiments of the present invention. Shuffle Master® is the dominant player in the automatic playing card shuffler market manufacturing and selling the MD3, one2six, ShuffleStar, Deck Mate® to name a few. Automatic playing card shufflers come in many forms from continuous to single deck to multiple deck and so on. To undertake the embodiments of the present invention, the subject shuffler needs to incorporate a sensor and/or image-capturing device positioned to view at least a portion of the face (or back or side) of each playing card so that playing card orientation can be identified from information depicted thereon. Automatic playing card shufflers separate, at some point, individual cards from the plurality of cards placed therein so that a sensor may acquire information from the playing card face (or side or rear). For example, as part of the randomizing process, the single deck shuffler 100 shown herein grabs single cards from the deck of playing cards placed into the shuffler 100. The single cards are propelled from the original deck of playing cards into the post-shuffle bin 200.

FIG. 25 shows a block diagram 1300 of an automatic playing card shuffler including a mechanism 1310 (e.g., elevators, platforms, shelves, ejectors, pushers, rollers, stepper motors, etc.) configured to separate an individual playing card 1315 for movement from a first position A (e.g., pre-shuffle bin) to a second position B (e.g., post-shuffle bin); an image capturing device 1320 configured to read card values and suits; a sensor 1325 configured to determine the presence, absence or arrangement of information which along with the card value and suit allows the determination of identity and orientation of each individual card passing from position A to position B; and a processor 1330 for receiving the card value and suit read by the image-capturing device and card-orientation information detected by the sensor 1335. It is conceivable that image capturing device 1320 and sensor 1325 may be a single device or separate devices. Indeed, a single device may detect and/or capture card identity and orientation. As set forth, below various combinations of sensors and/or image capturing devices may be used to read and/or detect the necessary information required to determine the orientation of the shuffled playing cards.

Depending on the embodiment, a camera may read the card values and suits and a sensor may detect the presence, absence or arrangement of the card marks; two sensors may detect the two distinct marks; or a camera may read the card values and suits and presence, absence or arrangement of the marks. Alternatively, the suits may not need to be read to determine an exploitable orientation as long as the card values are associated with the card orientations. As used herein the term "sensors" may comprise UV readers, IR readers, photoelectric devices, non-imaging capturing devices and any device capable of detecting and/or identifying visible or invisible marks, designs and/or symbols on a face, back and/or side of a playing card. As used herein the term "image capturing device" comprises static and video cameras, scanners, readers and any device capable of obtaining an image of a portion or all of the face, back and/or sides of a playing card.

In one embodiment, the sensor 1325 may be configured to measure the intensity of light reflecting off a card face or portion thereof. Such a sensor may be photoelectric, contrast, color, etc. Relative to playing cards, black/red marks absorb light and white portions reflect light. The automatic playing card shuffler 1305 only requires that the sensor 1325 detect either black/red or white commensurate with the inclusion or absence of a modified marking. Black or red indicates a card in an original new-deck orientation while a white mark or no mark indicates a card in an opposite orientation.

During normal play, the orientation of the cards changes from round-to-round based on pickup and discard procedures by the dealer and inadvertent spinning of cards by players and purposeful spinning of cards (e.g., habit, superstition, etc.). Each shuffle produces a two-way combination. The first combination comprises those cards still in new deck orientation while the second group comprises cards that have been turned 180°. For most games, such as Blackjack, the analysis comprises counting the number of significant (i.e., high) cards (e.g., 10s, Jacks, Queens, Kings and Aces) in the same orientation. In Baccarat, the significant cards Are the 6s, 7s, 8s and 9s. If the number of significant cards in the same orientation is above a threshold number (e.g., 66%), an alert is logged.

Whether by edge-sorting or a rogue employee, once a deck is in an exploitable orientation, it must remain largely intact to be profitable for the advantage player or cheat. This is the one common feature of all strategies and scams targeting asymmetries from manufacturing variances. Accordingly, in one embodiment, if three consecutive shuffles produce exploitable deck orientations, edge sorters or cheats are present at the game. Of course, if the threshold number from one shuffle is extremely high (e.g., 95% to 100% of all high cards), edge sorters or cheats may be present at the game as well. The automatic playing card shuffler may be configured to send alerts for various single or consecutive shuffle outcomes as detailed below.

Figure 27:
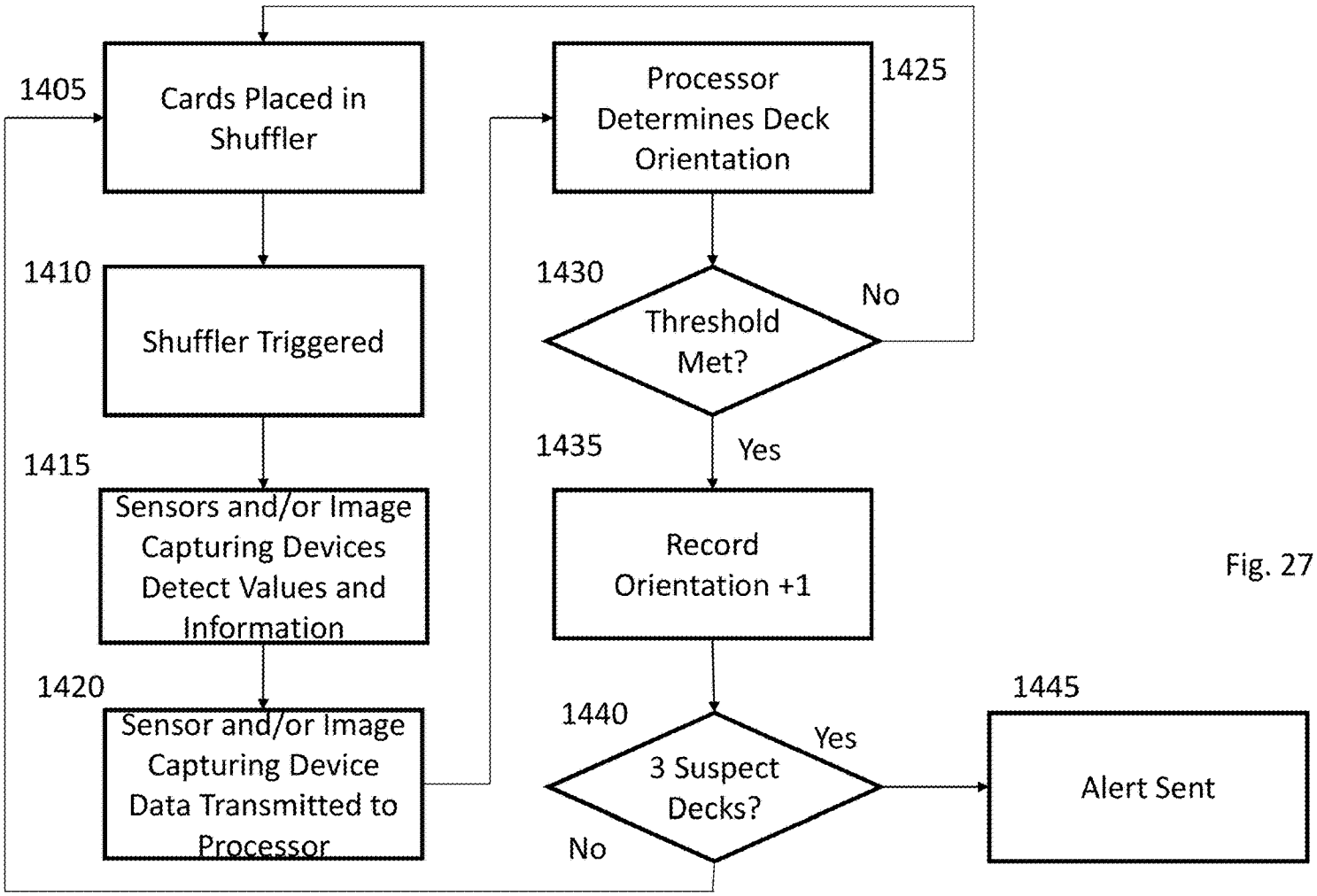
FIG. 27 illustrates a flow chart detailing a methodology for utilizing the modified playing cards with an automatic card shuffler according to the embodiments of the present invention.

FIG. 27 shows a flow chart 1400 detailing one methodology for operating the automatic card shuffler and modified playing cards according to the embodiments of the present invention. At 1405, one or more decks of cards are placed into the shuffler. At 1410, the shuffler is activated. As the playing cards are shuffled by the automatic playing card shuffler, at 1415, an image capturing device identifies the card value and suit of each playing card and the sensor (e.g., photoelectric sensor) detects the presence, absence or arrangement of the information on the playing cards. At 1420, reader and sensor data are transmitted to the processor. The processor may be local to the automatic playing card shuffler or remote (e.g., casino server). At 1425, the processor determines the deck orientation using the reader and sensor data. At 1430, it is determined if the deck orientation includes a threshold number of significant cards in the same orientation. If so, at 1435, the orientation is recorded and +1 is added to a zero count. At 1440, it is determined if the count has reached three consecutive deck orientations meeting the troubling threshold. If so, at 1445, an alert is sent to casino personnel via a display on the automatic playing card shuffler, text message, email and/or other means. Whatever the form, the transmission should be concealed to prevent the advantage player or cheat from being alerted.

There are situations when the system may recognize a scam after as few as one shuffle. For example, with a reader/imaging system disclosed above the shuffler knows when a new deck is being shuffled. Using the random-selection shuffler 100 disclosed herein, if the first three random positions selected are 52, 6 and 2 and the imaging system reads the first shuffled card to be the King of Spades (the $52^{nd}$ card in new-deck order), six of Hearts (the $6^{th}$ card in new-deck order) and two of hearts (the $2^{nd}$ card in new-deck order) the shuffler will quickly determine that the deck started in a new-deck order. Thus, if the reader/imaging systems detects an exploitable orientation on the first shuffler of a new deck, the system will quickly recognize a scam involving a rogue casino supervisor or other employee since players have not had access to the new deck yet.

In an alternative embodiment, each playing card forming a deck or group of cards has one of two distinct marks or alterations (i.e., information). Such a deck modification eliminates the need for identifying cards by card value and suit as detailed in the first embodiment above. Relative to this embodiment, the two most important combinations must be predetermined. For example, in a game of Baccarat, 6s, 7s, 8s and 9s form the first group of cards while all other cards form the second group. In high-card format games (e.g., Blackjack), the first group of cards comprise 10s, Jacks, Queens, Kings and Aces and the second group comprises all other cards. In either instance, each card includes a mark or other information on one end of the card with the marks or other information on the first group of cards being distinct from the marks or other information on the second group of cards.

A sensor in the automatic playing card shuffler is positioned and configured to detect one of three possible articles of information on the card face: (i) a first group mark indicating the original top of a card in the first group; (ii) a second group mark indicating the original top of the second group; and (iii) an absence of a any mark indicating the original bottom of a card from the first or second group.

In one embodiment, the top corner of each playing card in the first group of cards depicts a thin white vertical line while the top corner pip of the second group of cards depicts a pair of thin white vertical lines. The bottom pip on each card is conventional with no vertical white lines.

With this embodiment, each shuffle produces two numbers based on card orientation. For example, in a high-card format game, sensor readings of 15 high-card marks, 15 low-card marks and 22 no marks mean 15 high cards and 15 low cards are in the new deck orientation and 22 cards are in the opposite direction indicative of them being turned 180° for one reason or another. From this data, it can be deduced that of the 22 cards in the opposite direction (i.e., no marks) there are 5 high cards (20−15=5) because each deck starts with 20 high cards in new-deck orientation and 17 low cards (32−15=17) because each deck starts with 32 low cards in the new-deck orientation.

Should the sensor detect 20 high-card marks and no marks on the remaining 32 cards, or vice versa, the deck is in its most vulnerable or exploitable orientation given there are two discernable combinations comprising high cards and low cards. In one embodiment, if 66% of the cards fall into the readable orientation, the deck is deemed exploitable.

In one embodiment, a determination of 95% or more of the cards falling into the readable orientation after two consecutive shuffles causes an alert to be transmitted to casino personnel of a scam in progress. In another embodiment, a sustained determination of 55% or more, for example, of the cards falling into the readable orientation after three consecutive shuffles causes an alert to be transmitted to casino personnel of a scam in progress.

From the data, two models emerge. Reading accuracy increasing round-by-round is indicative of one or more players edge sorting during play whereas a 95%-100% instantaneous reading of exploitable orientated cards is indicative of a scam possibly perpetrated with help of a supervisor. Table 1 below represents the previous ten shuffling results of a shuffler configured to determine card orientation. In one embodiment, the orientation of the high cards is indicative of a strategy or scam (e.g., Blackjack). The final three shuffles (i.e., shuffles 8, 9 and 10) show a sustained higher than normal orientation of high cards of 55%, 65% and 75%. Accordingly, an alert is recorded and/or transmitted to casino personnel. An established normal orientation of high cards is 38.5% (10/26). The shuffler can be set by the casino to establish a desired threshold indicative of a strategy or scam in progress. The first seven shuffles (i.e., shuffles 1-7) show a normal orientation of high cards.

TABLE 1

| LAST 10 SHUFFLES | HIGH CARD % | OUTCOME | ANALYSIS |
|---|---|---|---|
| 1 | 38% | Normal Range | No Threat |
| 2 | 42% | Normal Range | No Threat |
| 3 | 41% | Normal Range | No Threat |
| 4 | 37% | Normal Range | No Threat |
| 5 | 37% | Normal Range | No Threat |
| 6 | 38% | Normal Range | No Threat |
| 7 | 40% | Normal Range | No Threat |
| 8 | 55% | Progressively Higher - Sustained Orientation | Alert |
| 9 | 65% | Progressively Higher - Sustained Orientation | Alert |
| 10 | 75% | Progressively Higher - Sustained Orientation | Alert |

Using the embodiments of the present design creates a versatile, reliable, inexpensive and elegant system and method for identifying exploitable orientations in lieu of detecting minor card imperfections. This is especially true when the vast number of card designs and different types of variances are considered. Thus, the system and method described herein reduce or eliminate the need to even look at card backs for manufacturing asymmetries.

Figure 28:
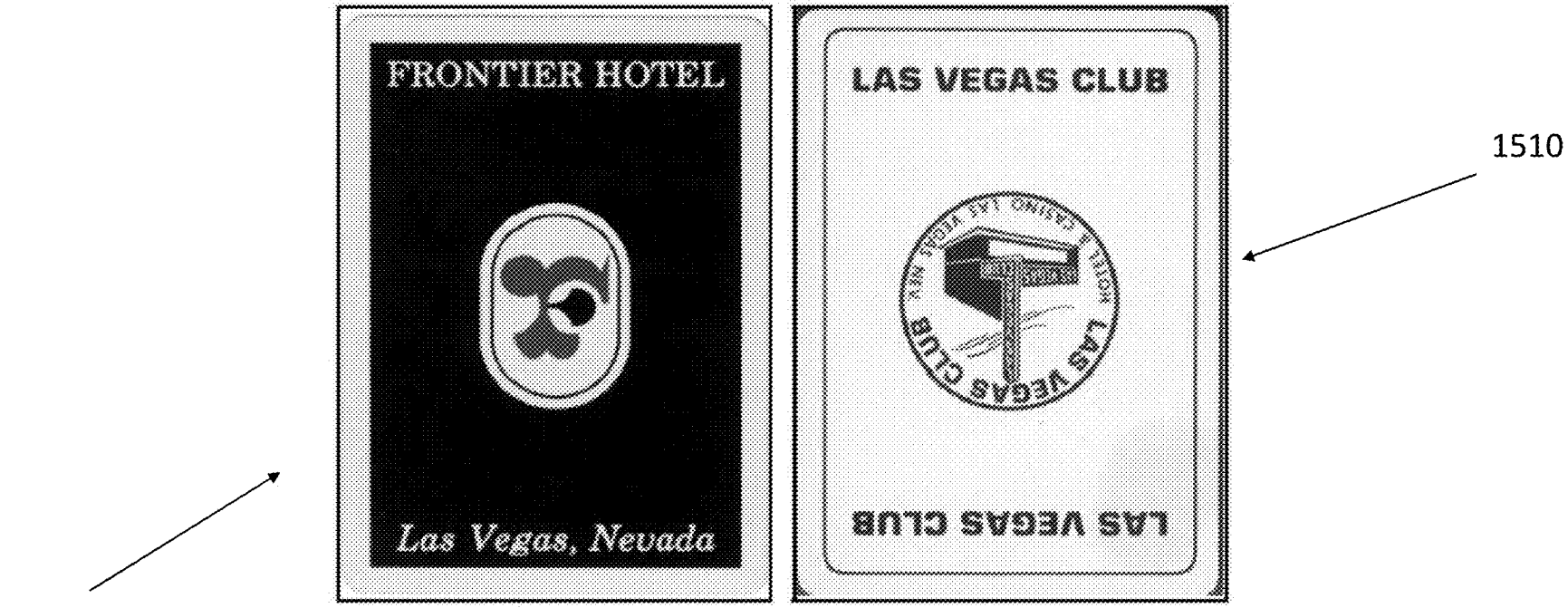
FIG. 28 illustrates exemplary playing cards having one-way card backs which may be used with the system and method according to the embodiments of the present invention.

In another embodiment, the system and method determine card orientation via cards utilizing one-way backs as shown in FIG. 28. Cards 1500 and 1510, have backs which render each card's orientation obvious from the back. The system herein may be modified to read the card backs, of the type shown in FIG. 28, to detect exploitable orientations. With such an embodiment, a first image capturing device is positioned and configured to read the card values and suits of each card and a second image capturing device is positioned and configured to read the one-way card backs. It is conceivable that a single image capturing device may read both the faces and backs or each card (e.g., using mirrors).

In an alternative embodiment, the one-way backs may be read by overhead security cameras prevalent in casinos (or any camera proximate to the casino table and/or automatic card shuffler). The overhead security cameras are sensitive enough identify the one-way card backs as the cards are dealt by the dealer to the players at the table. In this embodiment, the automatic card shuffler includes one or more sensors and/or image capturing devices to detect the card values of each shuffled card. The one-way card back information and card values are correlated to one another by the system. In one embodiment, the one-way card back information and card values may be transmitted to a casino server for analysis to determine the deck orientation. The card values may also be transmitted to the automatic card shuffler which is configured to correlate the card values with the one-way card back information to determine the deck orientation.

While automatic card shufflers are detailed herein for determining deck orientation, in other embodiments, card discard racks and dealing shoes may integrate one or more sensors and/or image capturing devices to detect card values and card-orientation information for use in determining deck orientation.

Although the invention has been described in detail with reference to several embodiments, additional variations and modifications exist within the scope and spirit of the invention as described and defined in the following claims.

We claim:

1. An automatic playing card shuffler system comprising:

a group of playing cards including both asymmetric and symmetric arrangements of suits comprising hearts, diamonds, clubs and spades on faces thereof wherein at least each said face of each playing card within said group of playing cards having a symmetric arrangement of suits further includes additional information from which an orientation of each said playing card having a symmetric arrangement of suits can be determined, said additional information including one or more of (i) independent, foreign marks, including marks invisible to the naked eye; (ii) modifications to card value, corner pip and/or regular pip; and/or (iii) modifications to a position of said card value, corner pip and/or regular pip;

an automatic playing card shuffler comprising:

a pre-shuffle area configured to receive said group of playing cards;

one or more mechanisms for automatically executing a shuffling procedure of said group of playing cards for game play;

one or more image-capturing devices and/or sensors configured to detect at least (i) card values of each of said playing cards forming said group of playing cards; (ii) determine the presence and/or arrangement of said additional information from said faces of said playing cards having a symmetric arrangement of suits and (iii) a top or bottom of said playing cards having an asymmetric arrangement of suits by reference to said asymmetric arrangement of suits; and a processor configured to control certain automatic card shuffler operations including said one or more mechanisms; and wherein said processor is further configured to utilize outputs of said one or more image capturing devices and/or sensors to (i) determine an orientation and associated card value of each of said playing cards placed into said pre-shuffle area and subsequently shuffled during said shuffling procedure based on said additional information and asymmetric arrangement of suits; (ii) analyze said determined orientation of said playing cards in conjunction with the card value of each card and (iii) based on said analysis, determine whether said orientation of any sub-group of said shuffled playing cards within said group of playing cards is indicative of a purposeful arrangement of said playing cards intended to take advantage of a casino operating said automatic playing card shuffler system.

2. The automatic playing card shuffler system of claim 1 wherein said one or more mechanisms are selected from the group including elevators, platforms, shelves, ejectors, pushers, rollers and stepper motors.

3. The automatic playing card shuffler system of claim 1 wherein said one or more image-capturing devices and/or sensors are configured to read light reflected off of cards or portions thereof.

4. The automatic card shuffler system of claim 1 wherein said processor is configured to transmit an alert responsive to a determination that said orientation of said shuffled playing card is indicative of a purposeful arrangement of said playing cards.

5. The automatic playing card shuffler system of claim 1 wherein said additional information comprises a thin vertical white line through a corner pip.

6. The automatic playing card shuffler system of claim 1 wherein said additional information comprises an increased distance between one card value and associated corner pip relative to the other card value and associated corner pip.

7. An automated method of shuffling playing cards comprising:

utilizing a group of playing cards including both asymmetric and symmetric arrangements of suits comprising hearts, diamonds, clubs and spades on faces thereof wherein at least said face of each playing card within said group of playing cards having a symmetric arrangement of suits further includes additional information from which an orientation of each of said playing cards having a symmetric arrangement of suits can be determined, said additional information including one or more of (i) independent, foreign marks, including marks invisible to the naked eye; (ii) modifications to card value, corner pip and/or regular pip; and/or (iii) modifications to a position of said card value, corner pip and/or regular pip;

configuring an automatic playing card shuffler having one or more sensors and at least one processor to undertake a process during casino card game play, said process comprising:

(i) detecting, via said one or more sensors, at least a card value of each of said playing cards forming said group of playing cards as each of said playing cards forming said group of playing cards is subjected to an automatic playing card shuffling process undertaken by said automatic playing card shuffler;

(ii) detecting, via said one or more sensors, the presence or arrangement of said additional information on said faces of said playing cards having a symmetric arrangement of suits as said playing cards having a symmetric arrangement of suits are subjected to an automatic playing card shuffling process undertaken by said automatic playing card shuffler;

(iii) detecting, via said one or more sensors, a top or bottom of said playing cards having an asymmetric arrangement of suits as said playing cards having an asymmetric arrangement of suits are subjected to an automatic playing card shuffling process undertaken by said automatic playing card shuffler;

(iv) utilizing, via said at least one processor, said at least card value, and presence and/or arrangement of said additional information on said faces of said playing cards having a symmetric arrangement of suits and top or bottom of said playing cards having an asymmetric arrangement of suits by reference to said asymmetric arrangement of suits to determine an orientation of each said playing card subjected to said automatic playing card shuffling process;

(v) analyzing, via said at least one processor, said determined orientation of said playing cards in conjunction with the card value of each card; and (vi) based on said analysis, determining, via said at least one processor, whether said orientation of any sub-group of said playing cards within said group of playing cards subjected to said automatic playing card shuffling process is indicative of a purposeful arrangement of said playing cards intended to take advantage of a casino operating said automatic playing card shuffler.

8. The method of shuffling playing cards of claim 7 further comprising utilizing one or more image capturing devices and/or sensors configured to read light reflected off of cards or portions thereof.

9. The method of shuffling playing cards of claim 7 further comprising configuring said automatic playing card shuffler to transmit an alert responsive to a determination that said orientation of said playing cards subjected to said automatic playing card shuffling process is indicative of a purposeful arrangement of said playing cards.

10. The method of shuffling playing cards of claim 7 wherein said additional information comprises a thin vertical white line through a corner pip.

11. The method of shuffling playing cards of claim 7 wherein said additional information comprises an increased distance between one card value and associated corner pip relative to the other card value and corner pip.

12. An automatic playing card shuffler system comprising:

a group of playing cards wherein a face of each playing card includes a first group of information or a second group of information from which an orientation of each of said playing cards can be determined, said first group of information corresponding to the more significant cards, namely ten-valued cards and Aces for a blackjack game and 6s, 7s, 8s and 9s for a baccarat game, said first group and/or second group of information including one or more of (i) independent, foreign marks, including marks invisible to the naked eye; (ii) modifications to card value, corner pip and/or regular pip; and/or (iii) modifications to a position of said card value, corner pip and/or regular pip;

an automatic card shuffler comprising:

a playing card area configured to receive said group of playing cards;

one or more mechanisms configured to undertake an automatic playing card shuffling process of said group of playing cards for game play;

one or more image capturing devices and/or sensors configured to detect the absence, presence and/or arrangement of said first group information and said second group information from faces of said playing cards as said playing cards are subjected to said playing card shuffling process;

a processor configured to control said automatic playing card shuffling process; and wherein said processor is configured to utilize outputs of said one or more image capturing devices and/or sensors to (i) determine an orientation of each of said playing cards subjected to said automatic playing card shuffling process based on said absence, presence and/or arrangement of said first group information and said second group information; (ii) analyze said determined orientation of said playing cards and (iii) based on said analysis, determine whether said orientation of each of said playing cards shuffled having said first group information and/or second group information is indicative of a purposeful arrangement of said playing cards intended to take advantage of a casino operating said automatic playing card shuffler system.

13. The automatic playing card shuffler system of claim 12 wherein said one or more mechanisms are selected from the group including elevators, platforms, shelves, ejectors, rollers, pushers and stepper motors.

14. The automatic playing card shuffler system of claim 12 wherein said one or more image-capturing devices and/or sensors are configured to read light reflected off of cards or portions thereof.

15. The automatic card shuffler system of claim 12 wherein said processor is further configured to transmit an alert responsive to a determination that said shuffled playing cards is indicative of a purposeful arrangement of said playing cards.

16. The automatic playing card shuffler system of claim 12 wherein said first group and/or second group of information comprises one or more thin vertical white lines through a corner pip.

17. The automatic playing card shuffler system of claim 12 wherein said first group and/or second group of information comprises an increased distance between one card value and associated corner pip relative to the other card value and associated corner pip.

18. An automated method of shuffling playing cards comprising:

utilizing a group of playing cards wherein a face of each playing card includes a first group of information or a second group of information from which an orientation of each said playing card can be determined, said first group of information corresponding to the more significant cards namely ten-valued cards and Aces for a blackjack game and 6s, 7s, 8s and 9s for a baccarat game, said first group and/or second group of information including one or more of (i) independent, foreign marks, including marks invisible to the naked eye; (ii) modifications to card value, corner pip and/or regular pip; and/or (iii) modifications to a position of said card value, corner pip and/or regular pip;

configuring an automatic playing card shuffler having one or more sensors and at least one processor to undertake a process during casino card game play, said process comprising:

(i) detecting, via said one or more sensors, the presence, absence and/or arrangement of said first group information and said second group information on faces of said playing cards as said playing cards are subjected to an automatic playing card shuffling process undertaken by said automatic playing card shuffler;

(ii) utilizing, via said at least one processor, said presence, absence and/or arrangement of said first group information and said second group information to determine an orientation of each of said playing cards subjected to said automatic playing card shuffling process;

(iii) analyzing, via said at least one processor, said determined orientation of said playing cards in conjunction with the first group information or second group information; and (iv) based on said analysis, determining, via said at least one processor, whether said orientation of each of said playing cards having said first group information and/or second group information subjected to said automatic playing card shuffling process is indicative of a purposeful arrangement of said playing cards intended to take advantage of a casino operating said automatic playing card shuffler.

19. The method of shuffling playing cards of claim 18 further comprising utilizing one or more image capturing devices and/or sensors configured to read light reflected off of cards or portions thereof.

20. The method of shuffling playing cards of claim 18 further comprising configuring said automatic playing card shuffler to transmit an alert responsive to a determination that said orientation of said playing cards subjected to said automatic playing card shuffling process is indicative of a purposeful arrangement of said playing cards.

21. The method of shuffling playing cards of claim 18 wherein said first group and/or second group of information comprises a thin vertical white line through a corner pip.

22. The method of shuffling playing cards of claim 18 wherein said first group and/or second group of information comprises an increased distance between one card value and associated corner pip relative to the other card value and associated corner pip.

* * * * *